US012351354B2

(12) United States Patent
Bennett

(10) Patent No.: US 12,351,354 B2
(45) Date of Patent: Jul. 8, 2025

(54) PAPER WRAPPING DEVICE AND RELATED METHODS

(71) Applicant: Atlantic Corporation of Wilmington, Inc., Charlotte, NC (US)

(72) Inventor: Chip Bennett, Charlotte, NC (US)

(73) Assignee: ATLANTIC CORPORATION OF WILMINGTON, INC., Charlotte, NC (US)

( * ) Notice: Subject to any disclaimer, the term of this patent is extended or adjusted under 35 U.S.C. 154(b) by 61 days.

(21) Appl. No.: 18/388,318

(22) Filed: Nov. 9, 2023

(65) Prior Publication Data

US 2024/0150056 A1 May 9, 2024

Related U.S. Application Data

(60) Provisional application No. 63/537,517, filed on Sep. 10, 2023, provisional application No. 63/423,865, filed on Nov. 9, 2022.

(51) Int. Cl.

| | |
|---|---|
| ***B65B 11/10*** | (2006.01) |
| ***B65B 45/00*** | (2006.01) |
| ***B65B 51/02*** | (2006.01) |

(52) U.S. Cl.
CPC ..... *B65B 45/00* (2013.01); *B65B 51/02* (2013.01)

(58) Field of Classification Search
CPC ..... B65B 51/02; B65B 45/00; B65B 11/10
USPC ..... 53/203
See application file for complete search history.

(56) References Cited

U.S. PATENT DOCUMENTS

| | | | | |
|---|---|---|---|---|
| 3,147,576 | A * | 9/1964 | Jones | B65B 7/20 53/376.5 |
| 3,222,844 | A * | 12/1965 | Smith | B65B 11/08 53/221 |
| 3,343,334 | A * | 9/1967 | Bode | B65B 27/08 53/389.5 |
| 3,938,304 | A * | 2/1976 | Utsumi | B65B 45/00 53/229 |
| 4,355,496 | A * | 10/1982 | Teates | B65B 11/04 100/15 |
| 5,038,549 | A * | 8/1991 | Nordstrom | B65B 35/50 414/794.9 |

(Continued)

FOREIGN PATENT DOCUMENTS

| | | | |
|---|---|---|---|
| DE | 102013106368 | A1 | 12/2014 |
| DE | 102020108161 | A1 | 9/2021 |

(Continued)

OTHER PUBLICATIONS

International Search Report and Written Opinion for PCT/US2023/037075, dated Jan. 17, 2024.

*Primary Examiner* — Andrew M Tecco
(74) *Attorney, Agent, or Firm* — Barnes & Thornburg LLP

(57) ABSTRACT

A device adapted to seal a paper overwrap around a package includes a stationary support frame, a conveyor mounted to the support frame, and an adhesive application device mounted to the stationary support frame. The conveyor is configured to transport the package wrapped in the paper overwrap in a conveyor direction through the support frame. The adhesive application device is configured to tension the paper overwrap, while opening the seam so that an adhesive may be applied to the bottom of the package and the seam sealed together.

20 Claims, 38 Drawing Sheets

(56) References Cited

U.S. PATENT DOCUMENTS

| | | | | |
|---|---|---|---|---|
| 5,687,544 | A * | 11/1997 | Watabe | B65B 5/022 53/284.7 |
| 10,450,094 | B2 * | 10/2019 | Lelie | B65B 11/10 |
| 11,524,800 | B2 | 12/2022 | Stuhlmann | |
| 11,834,208 | B2 * | 12/2023 | Bonnain | B65B 49/08 |
| 11,884,429 | B2 * | 1/2024 | Pattuzzi | B65B 11/22 |
| 11,905,047 | B2 | 2/2024 | Cox et al. | |
| 12,017,810 | B2 * | 6/2024 | Cox | B65B 11/10 |
| 2013/0298500 | A1 * | 11/2013 | Laudet | B65B 5/06 53/284.5 |
| 2022/0009663 | A1 * | 1/2022 | Wiley | B65B 43/52 |
| 2022/0250776 | A1 | 8/2022 | Lelie et al. | |
| 2022/0281624 | A1 * | 9/2022 | Wagner | B65B 13/22 |
| 2023/0115847 | A1 | 4/2023 | Jörissen et al. | |
| 2023/0182943 | A1 | 6/2023 | Bonnain et al. | |
| 2024/0150056 | A1 | 5/2024 | Bennett | |

FOREIGN PATENT DOCUMENTS

| | | | |
|---|---|---|---|
| EP | 3010809 | A1 | 4/2016 |
| EP | 3606832 | B1 | 2/2020 |
| JP | 4825428 | B2 | 11/2011 |
| WO | 2023034385 | A2 | 3/2023 |
| WO | 2024061846 | A2 | 3/2024 |

* cited by examiner

PAPER WRAPPING DEVICE AND RELATED METHODS

CROSS REFERENCE TO RELATED APPLICATIONS

This application claims priority to and the benefit of U.S. Provisional Patent Application No. 63/423,865, filed 9 Nov. 2022 and U.S. Provisional Patent Application No. 63/537,517, filed 10 Sep. 2023, the disclosure of which is now expressly incorporated herein by reference.

FIELD OF THE DISCLOSURE

The present disclosure relates generally to wrapping devices, and more specifically to wrapping devices using paper materials.

BACKGROUND

Current market forces dictate a shift away from plastic film towards paper for securing goods. Plastic requires the use of petroleum or non-renewable sources while paper may be recycled.

SUMMARY

A device is provided that seals a paper overwrap to itself around a tray of one or more products/goods inside a cavity of the tray. The tray may be fabricated from paper or cardboard and particularly suited to secure or store cans or bottles. The paper overwrap is wrapped around a top portion, two side portions and a bottom portion of the tray such that two ends of the paper overwrap meet at a bottom portion of the tray and form a seam. The paper overwrap is adhered or sealed along the seam on the bottom portion of the tray. In view of the foregoing application of the paper overwrap, two sides of the tray remain exposed/open without any paper overwrap.

DETAILED DESCRIPTION

Figure 1:
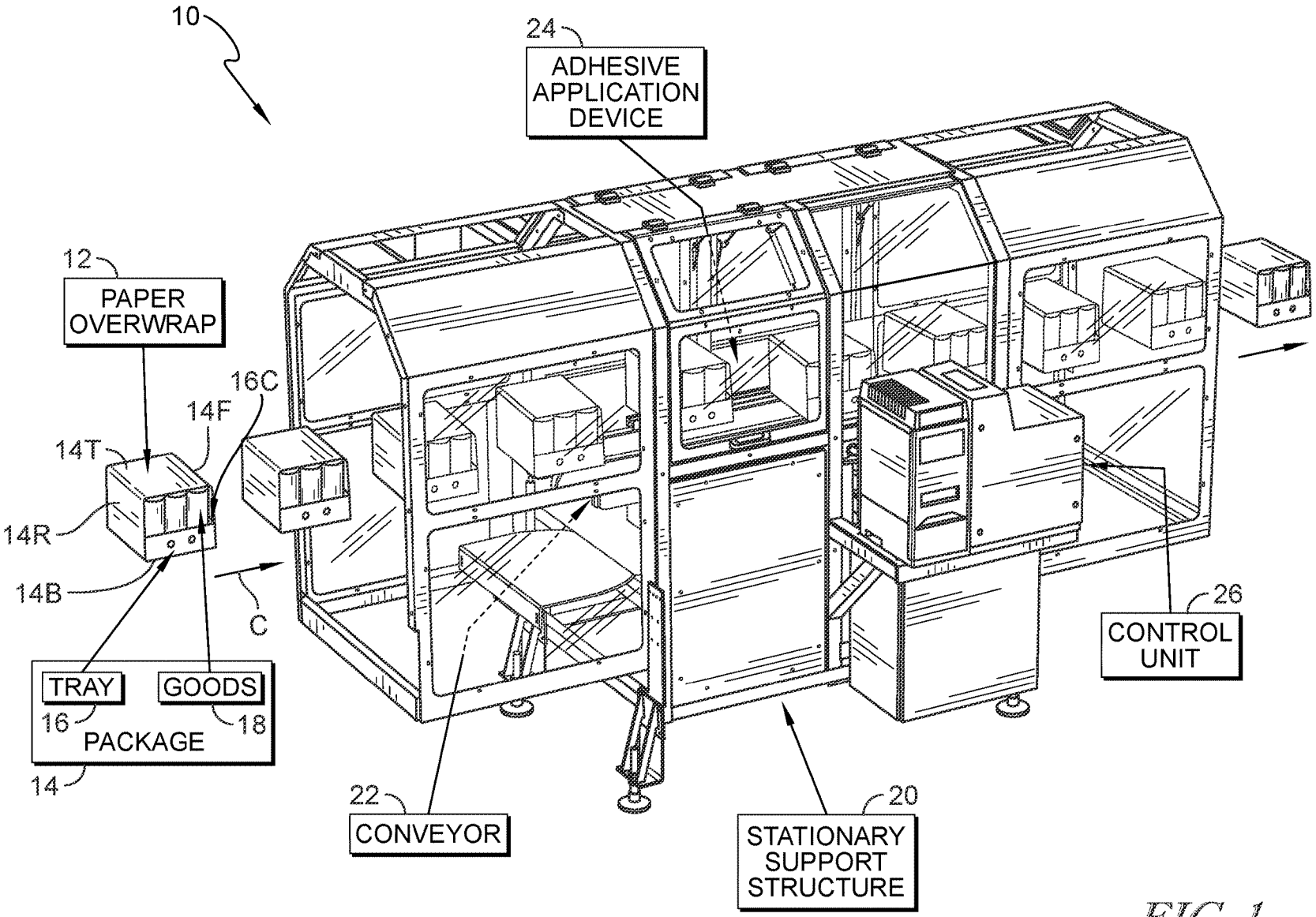
FIG. 1 is a perspective view of one embodiment of a device adapted to fix a paper overwrap around packages each having a tray that holds a plurality of goods in a cavity of the tray showing the device includes a stationary support frame and a conveyor mounted to the support frame and configured to transport the package wrapped in the paper overwrap in a conveyor direction through the support frame to an adhesive application device mounted to the support frame that is configured to fix the paper overwrap to the package.

The present disclosure will now be described more fully hereinafter with reference to exemplary embodiments thereof. These exemplary embodiments are described so that this disclosure will be thorough and complete, and will fully convey the scope of the disclosure to those skilled in the art. Indeed, the present disclosure may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

An illustrative embodiment of a device 10 adapted to seal a paper overwrap 12 around a package 14 is shown in FIGS. 1-12. The package 14 includes a tray 16 holding a plurality of goods 18 in a cavity 16C of the tray 16. The paper overwrap 12 is wrapped around a bottom side 14B of the tray 16, a top side 14T opposite the bottom side, and front and rear sides 14F, 14R that extend between and interconnect the top and bottom sides 14B, 14T of the package 14 so that free ends 12F, 12R of the paper overwrap 12 overlap on the bottom side 14B of the package 14 to form a seam or flap 12S. The device 10 is adapted to seal the seam 12S of the package overwrap 12 thereby fixing the paper overwrap 12 in place around the package 14 so that the paper overwrap 12 holds the plurality of goods 18 in place in the cavity 16C of the tray 16.

The device 10 includes a stationary support frame 20, a conveyor 22 mounted to the support frame 20, and an adhesive application device 24 mounted to the stationary support frame 20 as shown in FIGS. 1-12. The conveyor 22 is configured to transport the package 14 wrapped in the paper overwrap 12 in a conveyor direction through the support frame 20 as suggested by arrow C. The seam 12S of the paper overwrap 12 on the bottom side 14B of the package 14 faces the conveyor 22. The adhesive application device 24 is configured to tension the paper overwrap 12, while opening the seam 12S so that an adhesive may be applied to the bottom side 14B of the package 14 and the seam 12S sealed together.

Other package wrapping devices may use a plastic film material to wrap a package thereby securing the goods inside the tray. The plastic film material may be shrink wrapped to the package to hold the goods inside the tray. While this method is effective at securing the goods inside the tray, the plastic film material uses non-renewable sources and is typically not recyclable.

Using paper material to wrap the package may be a preferred method over using plastic film material because the paper material may be recycled. However, it may be difficult to tension the paper overwrap around the package and maintain the tension while securing the paper overwrap around the package. If the paper overwrap is not tightly secured around the package, the goods in the tray may be able to move out of the cavity of the tray.

The device 10, therefore, includes the adhesive application device 24 to tension the paper overwrap 12 and maintain that tension while opening the seam 12S so that an adhesive may be applied to the bottom side 14B of the package 14. This way, when the seam 12S is sealed closed, the paper overwrap 12 remains tensioned around the package 14 to hold the plurality of goods 18 in the tray 16.

The adhesive application device 24 includes a package transport device 30, a paper overwrap tension device 32, a paper overwrap retraction device 34, and adhesive applicators 36 as shown in FIGS. 2 and 6-12. The package transport device 30 provides package transport means for lifting the wrapped package 14 away from conveyor along a vertical axis 40A perpendicular to the conveyor 22 as the wrapped package 14 continues to move in the conveyor direction C and for lowering the wrapped package 14 along the vertical axis 40A toward the conveyor 22 after the adhesive has been applied. The paper overwrap tension device 32 provides means for pulling the free ends 12F, 12R of the paper overwrap 12 in opposed directions around the package 14 to tension the paper overwrap 12 around the package 14 and maintain the tension as the adhesive is applied. The paper overwrap retraction device 34 provides means for moving a first free end 12F of the paper overwrap 12 in a first direction away from the bottom side 14B of the package 14 after the paper overwrap 12 is tensioned around the package 14 to uncover a portion of the bottom side 14B of the package 14 and the second free end 12R of the paper overwrap 12 and for moving the first free end 12F of the paper overwrap 12 in a second direction opposite the first direction toward the bottom side 14B of the package 14 after the adhesive is applied. Each adhesive applicator 36 is configured to apply the adhesive to the uncovered portion of the bottom side 14B of the package 14 and the second free end 12R of the paper overwrap 12 when the first free end 12F is moved away from the bottom side 14B of the package 14.

The adhesive application device 24 includes package transport means for lifting the wrapped package 14 away from the conveyor 22 along the vertical axis 40A perpendicular to the conveyor 22 as the wrapped package 14 continues to move in the conveyor direction C and for lowering the wrapped package 14 along the vertical axis 40A toward the conveyor 22 after the adhesive has been applied as shown in FIGS. 2-12. The package transport means, or the package transport device 30, lifts the wrapped package 14 to expose the free ends 12F, 12R of the paper overwrap 12 on the bottom side 14B of the package 14 so that the free ends 12F, 12R of the paper overwrap 12 are free to be moved relative to the package 14 to tension the paper overwrap 12 before an adhesive is applied to the bottom side 14B of the package 14. The package transport device 30 lowers the wrapped package 14 along the vertical axis 40A toward the conveyor 22 after the adhesive has been applied to set the wrapped package 14 back on the conveyor 22.

Figure 7:
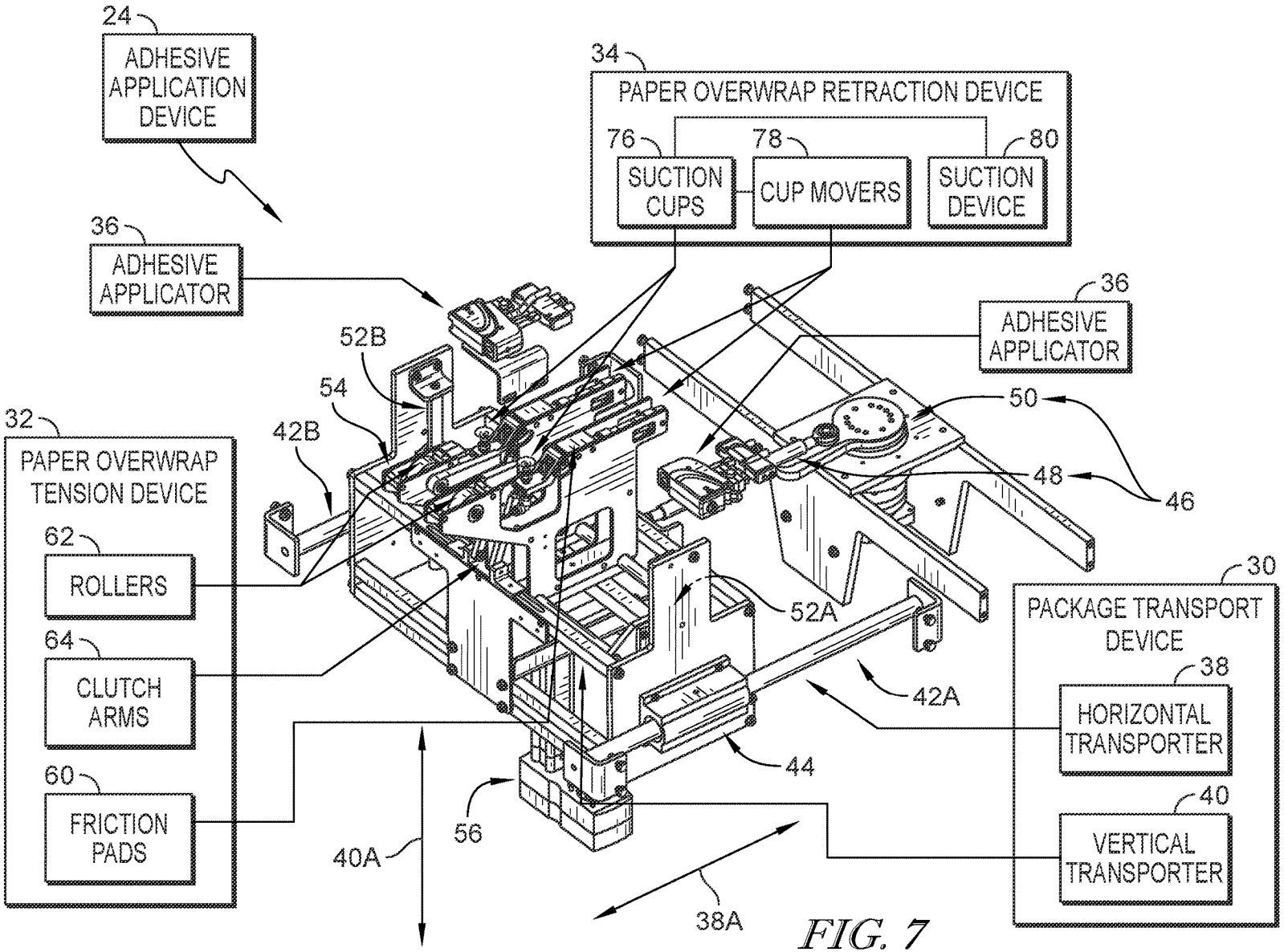
FIG. 7 is a perspective view of the adhesive application device in FIG. 6 showing the package transport device includes a horizontal transporter configured to move horizontally along a horizontal axis and a vertical transporter coupled to the horizontal transporter for movement therewith and configured to move vertically along a vertical axis, showing the paper overwrap tension device includes a set of rollers, a set of clutch arms coupled to the set of rollers, and a set of friction pads spaced apart from the set of rollers, and showing the paper overwrap retraction device includes a set of suction cups, a set of cup movers coupled to the suction cups and pivotably coupled to the vertical transporter, and a suction device coupled to the suction cups.
Figure 8:
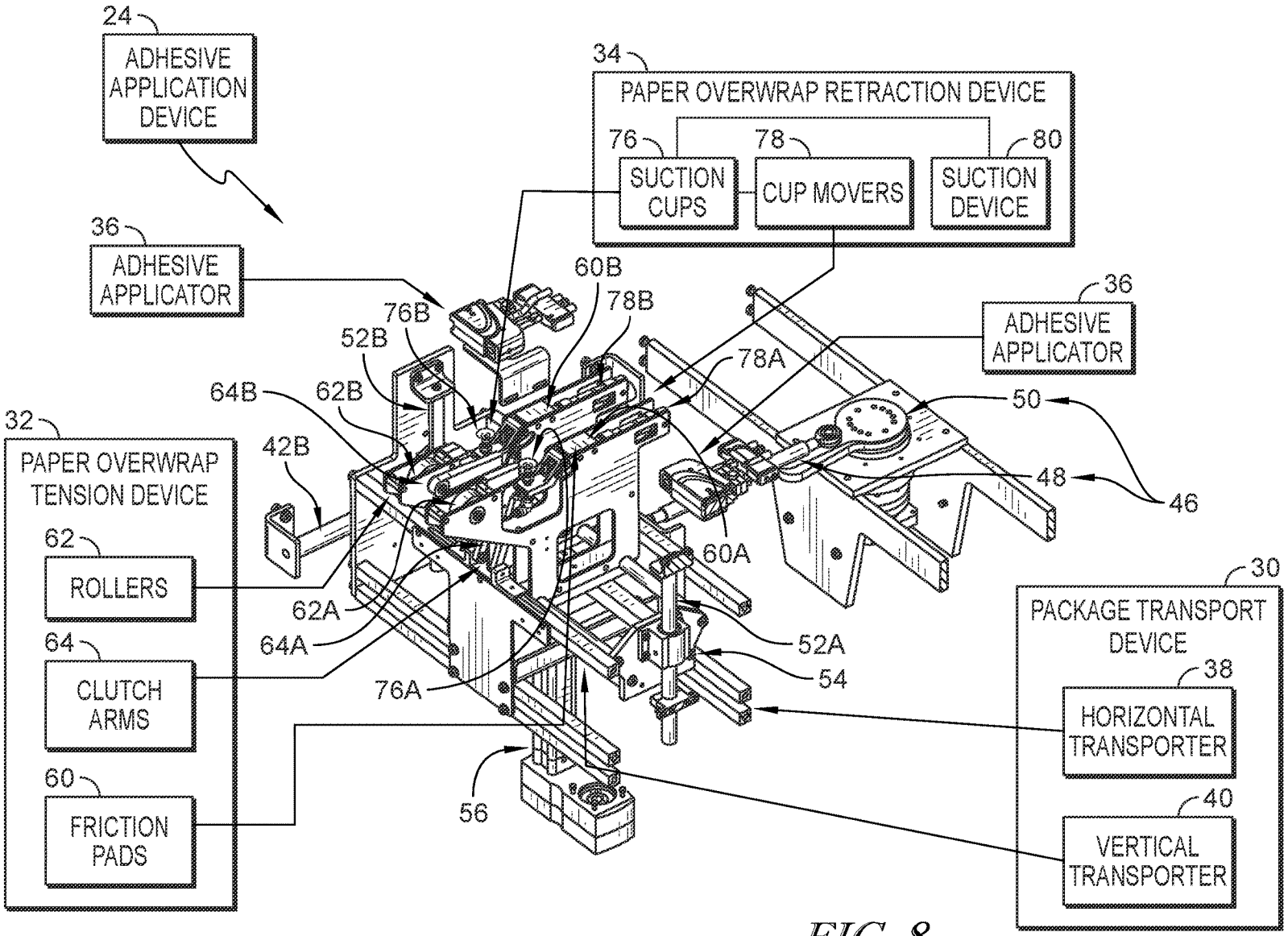
FIG. 8 is a cross-section view of the adhesive application device of FIG. 7.
Figure 9:
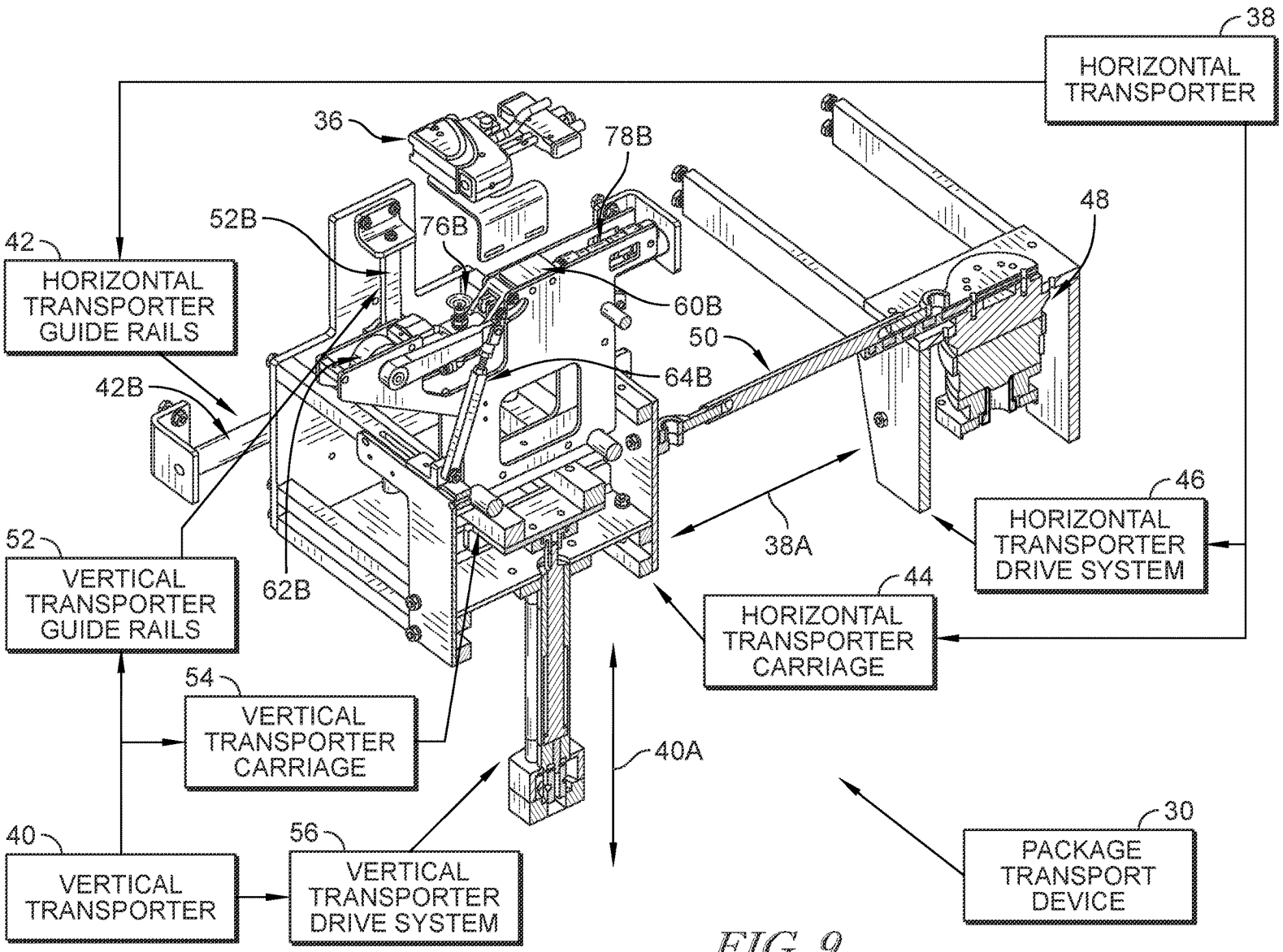
FIG. 9 is a cross-section view of the adhesive application device of FIG. 7 showing the horizontal transporter includes a pair of horizontal guide rails fixed to the support frame, a horizontal transporter carriage mounted on the horizontal guide rails to move horizontally back and forth relative to the horizontal axis, and a horizontal transporter drive system coupled to the horizontal transporter carriage to drive movement of the horizontal transporter carriage along the horizontal guide rails, and further showing the vertical transporter includes a pair of vertical guide rails fixed to the horizontal transporter carriage for movement therewith, a vertical transporter carriage mounted on the vertical guide rails to move vertically back and forth relative to the vertical axis, and a vertical transporter drive system coupled to the vertical transporter carriage to drive movement of the vertical transporter carriage along the vertical guide rails.

The package transport device 30 includes a horizontal transporter 38 and a vertical transporter 40 as shown in FIGS. 7-9. The horizontal transporter 38 is mounted to the support frame 20 for reciprocating horizontal movement along a horizontal axis 38A as shown in FIGS. 2-7. The vertical transporter 40 is mounted to the horizontal transporter 38 for reciprocating vertical movement along the vertical axis 40A perpendicular to the horizontal axis 38A as shown in FIGS. 2-7.

The horizontal transporter 38 and the vertical transporter 40 of the package transport device 30 is configured to lift and lower the wrapped package 14 relative to the conveyor 22 while continuing to move the wrapped package 14 horizontally to expose the free ends 12F, 12R of the package overwrap 12. In the illustrative embodiment, the conveyor 22 includes a pair of conveyor belts 23 and a conveyor controller 25. The conveyor controller 25 is coupled to the conveyor belts 23 and configured to drive movement of the conveyor belts 23 in the conveyor direction C.

Figure 4:
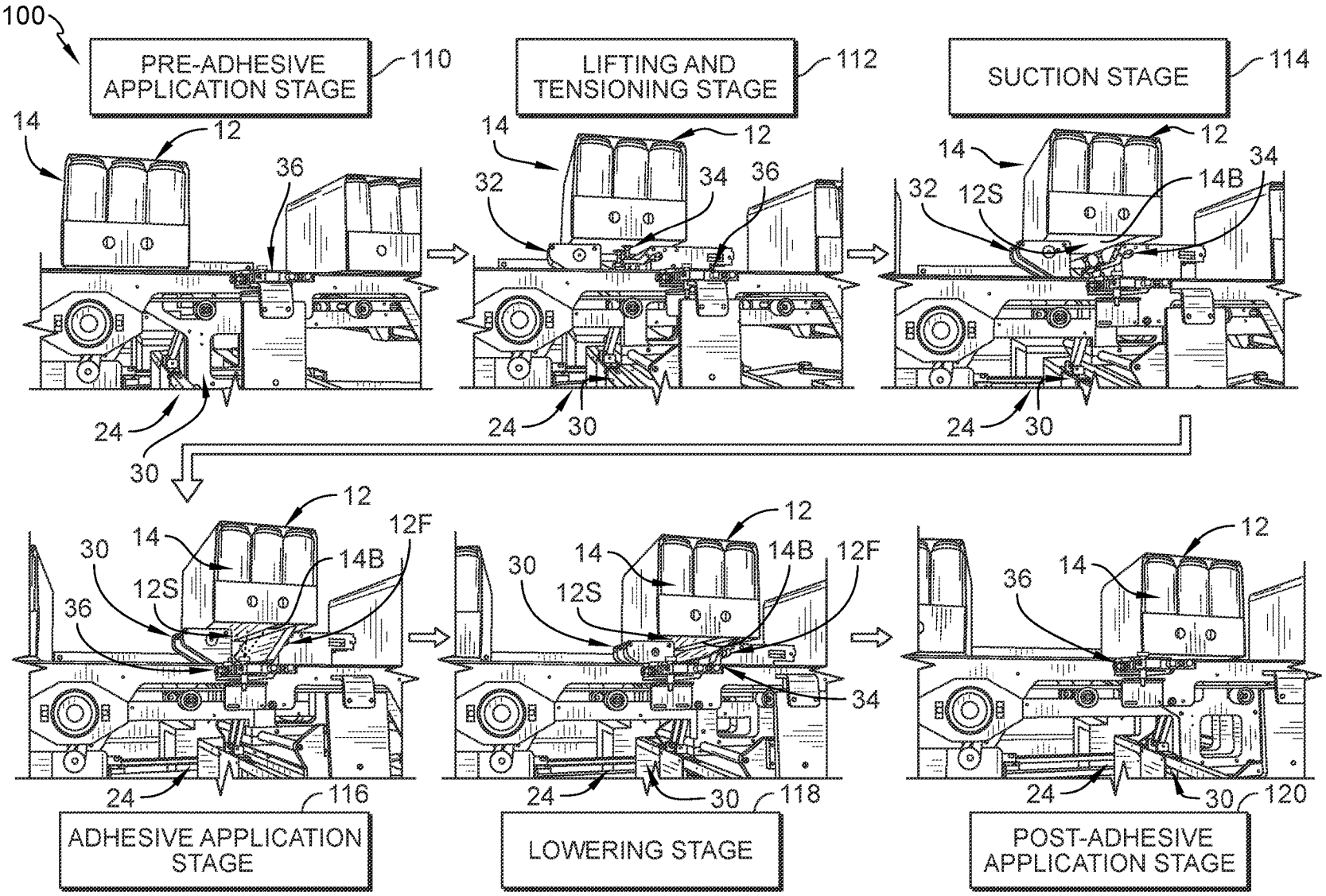
FIG. 4 is a diagrammatic view of the device of FIG. 1 showing the adhesive application device moves through (i) the pre-adhesive application stage in which the package wrapped in the paper overwrap is in a conveyor position in which the wrapped package rests on the conveyor to move in the conveyor direction and the adhesive application device is in a lowered mode in which the adhesive application device is below the conveyor so that the adhesive application device is spaced apart from the wrapped package and does not engaged the wrapped package, (ii) the lifting and tensioning stage in which the adhesive application device has changed from the lowered mode to a lifted mode to cause the wrapped package to move from the conveyor position to a raised position in which the wrapped package is spaced apart from the conveyor to expose the free ends of the paper overwrap so that the paper overwrap tension device may pull the free ends of the paper overwrap in opposed directions around the package to tension the paper overwrap around the package to keep the paper overwrap in a taut position around bottom, top, front, and rear sides of the package, (iii) the suction stage in which the adhesive application device remains in the lifted mode with the paper overwrap held in the taut position by the paper overwrap tension device while the paper overwrap retraction device pivots the first free end of the paper overwrap in a first direction away from the bottom side of the packaging to a retracted position in which a portion of the bottom side of the package and the second free end of the paper overwrap are uncovered so that the adhesive may be applied, (iv) the adhesive application stage in which adhesive is applied to the portion of the bottom side of the package and the second free end of the paper overwrap while the paper overwrap retraction device holds the first free end in the retracted position, (v) the lowering stage in which the adhesive application device changes from the lifted mode to the lowered mode to cause the wrapped package to move from the raised position back to the conveyor position while the paper overwrap retraction device also pivots the first free end of the paper overwrap in a second direction opposite the first direction toward the bottom side of the packaging to an engaged position in which the freed ends of the paper overwrap are fixed to the package to secure the paper overwrap around the package in the taut position, and (vi) the post-adhesive application stage in which the adhesive application device is in the lowered mode to cause the wrapped package to be in the conveyor position.

The horizontal transporter 38 comprises a pair of horizontal guide rails 42A, 42B mounted to the support frame 20, a horizontal transporter carriage 44, and a horizontal transporter drive system 46 as shown in FIGS. 7-9. The horizontal transporter carriage 44 is mounted on the pair of horizontal guide rails 42A, 42B to move horizontally back and forth relative to the horizontal axis 38A between a first horizontal position and a second horizontal position as shown in FIG. 4. In the first horizontal position, the horizontal transporter carriage 44 is closer towards a first end 22R of the conveyor 22. In the second horizontal position, the horizontal transporter carriage 44 is closer towards a second end 22F of the conveyor 22. The horizontal transporter drive system 46 is coupled to the horizontal transporter carriage 44 to drive movement of the horizontal transporter carriage 44 along the horizontal guide rails 42A, 42B back and forth between the first and second horizontal positions.

The horizontal transporter drive system 46 includes a motor 48 and a drive shaft 50 coupled to the motor 48 as shown in FIGS. 7-9. The drive shaft 50 transfers the rotational motion of the motor 48 to linear motion to cause the horizontal transporter carriage 44 to reciprocate along the horizontal axis 38A in the illustrative embodiment. In other embodiments, another suitable drive system may be used such as a linear actuator.

The vertical transporter 40 comprises a pair of vertical guide rails 52A, 52B mounted to the horizontal transporter carriage 44, a vertical transporter carriage 54, and a vertical transporter drive system 56 as shown in FIGS. 7-9. The vertical transporter carriage 54 is mounted on the pair of vertical guide rails 52A, 52B to move vertically back and forth relative to the vertical axis 40A between a first vertical position and a second vertical position as shown in FIG. 4. In the first vertical position, the vertical transporter carriage 54 is located below the conveyor 22 so that the wrapped package 14 remains on the conveyor 22. In the second vertical position, the vertical transporter carriage 54 extends above the conveyor 22 to lift the wrapped package 14 away from the conveyor 22 at a predetermined distance. The vertical transporter drive system 56 is coupled to the vertical transporter carriage 54 to drive movement of the vertical transporter carriage 54 along the vertical guide rails 52A, 52B between the first and second vertical positions.

The vertical transporter drive system 56 includes a linear actuator in the illustrative embodiment in FIG. 9. In other embodiments, another suitable actuator or drive system may be used.

The adhesive application device 24 includes paper overwrap tension controller means for pulling the free ends 12F, 12R of the paper overwrap 12 in opposed directions around the package 14 to tension the paper overwrap 12 around the package 14 as shown in FIGS. 2-12. The paper overwrap tension controller means, or the paper overwrap tension device 32, pulls the free ends 12F, 12R of the paper overwrap 12 in opposed directions around the package 14 as or after the wrapped package 14 is lifted away from the conveyor 22 to tension the paper overwrap 12 around the package 14 before the adhesive is applied to the bottom side 14B of the package 14 to keep the paper overwrap 12 taut around the bottom, top, front, and rear sides 14B, 14T, 14F, 14R of the package 14. The paper overwrap 12 is kept taut around the package 14 as the adhesive is applied to the bottom side 14B of the package 14 so that the paper overwrap 12 remains taut once the seam 12S is sealed to hold the plurality of goods 18 in place in the cavity 16C of the tray 16 once the adhesive has been applied to fix the paper overwrap 12 in place on the package 14.

The paper overwrap tension device 32 comprises a pair of friction pads 60, a pair of rollers, 62, and a pair of clutch arms 64 as shown in FIGS. 7-12. Each friction pad 60A, 60B of the pair of friction pads 60 are coupled to the vertical transporter carriage 54 of the vertical transporter 40. The friction pads 60A, 60B are configured to engage the wrapped package 14 as the conveyor 22 moves the wrapped package 14 onto the vertical transporter carriage 54. Each roller 62A, 62B of the pair of rollers 62 is mounted to the vertical transporter carriage 54 of the vertical transporter 40 to rotate about a roller axis 58. The rollers 62A, 62B are located upstream of the friction pads 60A, 60B. Each clutch arm 64A, 64B of the pair of clutch arms 64 is coupled to one of the rollers 62A, 62B. Each clutch arm 64A, 64B is configured to rotate the respective roller 62A, 62B in a downstream direction D around the roller axis 58 as the wrapped package 14 is lifted to cause the pair of rollers 62A, 62B to pull the free ends 12F, 12R of the paper overwrap 12 in opposite directions around the package 14.

In the illustrative embodiment, the paper overwrap tension device 32 includes two friction pads 60A, 60B, two rollers, 62A, 62B, and two clutch arms 64A, 64B. In some embodiments, the paper overwrap tension device 32 may include a single friction pad 60A, roller, 62A, and clutch arm 64A. In some embodiments, the paper overwrap tension device 32 may include more than two friction pads 60A, 60B, more than two rollers, 62A, 62B, and more than two clutch arms 64A, 64B.

In the illustrative embodiment, the left and right friction pads 60 are substantially similar. In the illustrative embodiment, the left and right rollers 62A, 62B are substantially similar. In the illustrative embodiment, the left and right clutch arms 64A, 64B are substantially similar.

Figure 10:
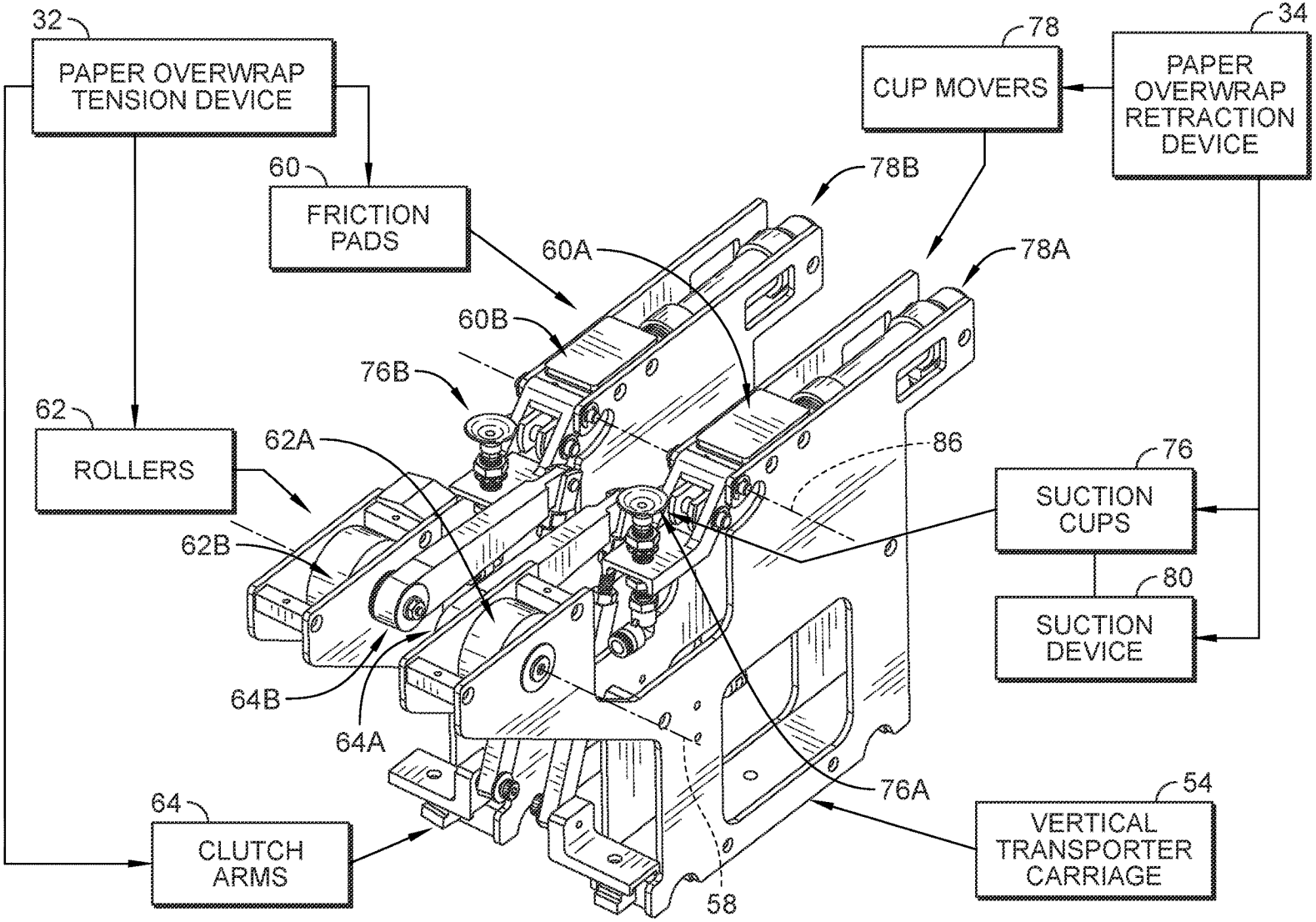
FIG. 10 is a perspective view of a portion of the adhesive application device of FIG. 7.
Figure 11:
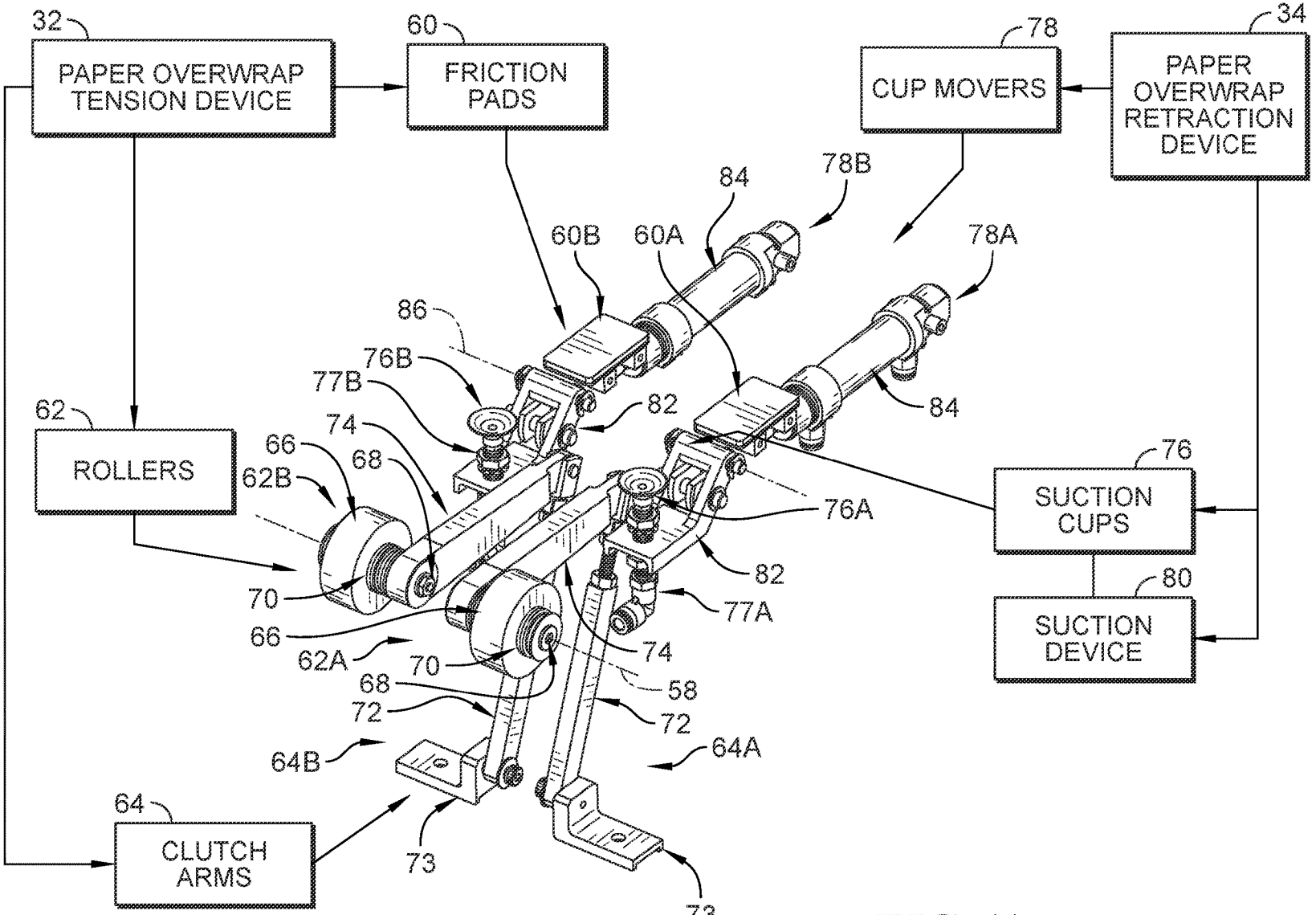
FIG. 11 is a view similar to FIG. 10 with the vertical transporter carriage removed to show the components of the paper overwrap tension device and the paper overwrap retraction device.
Figure 12:
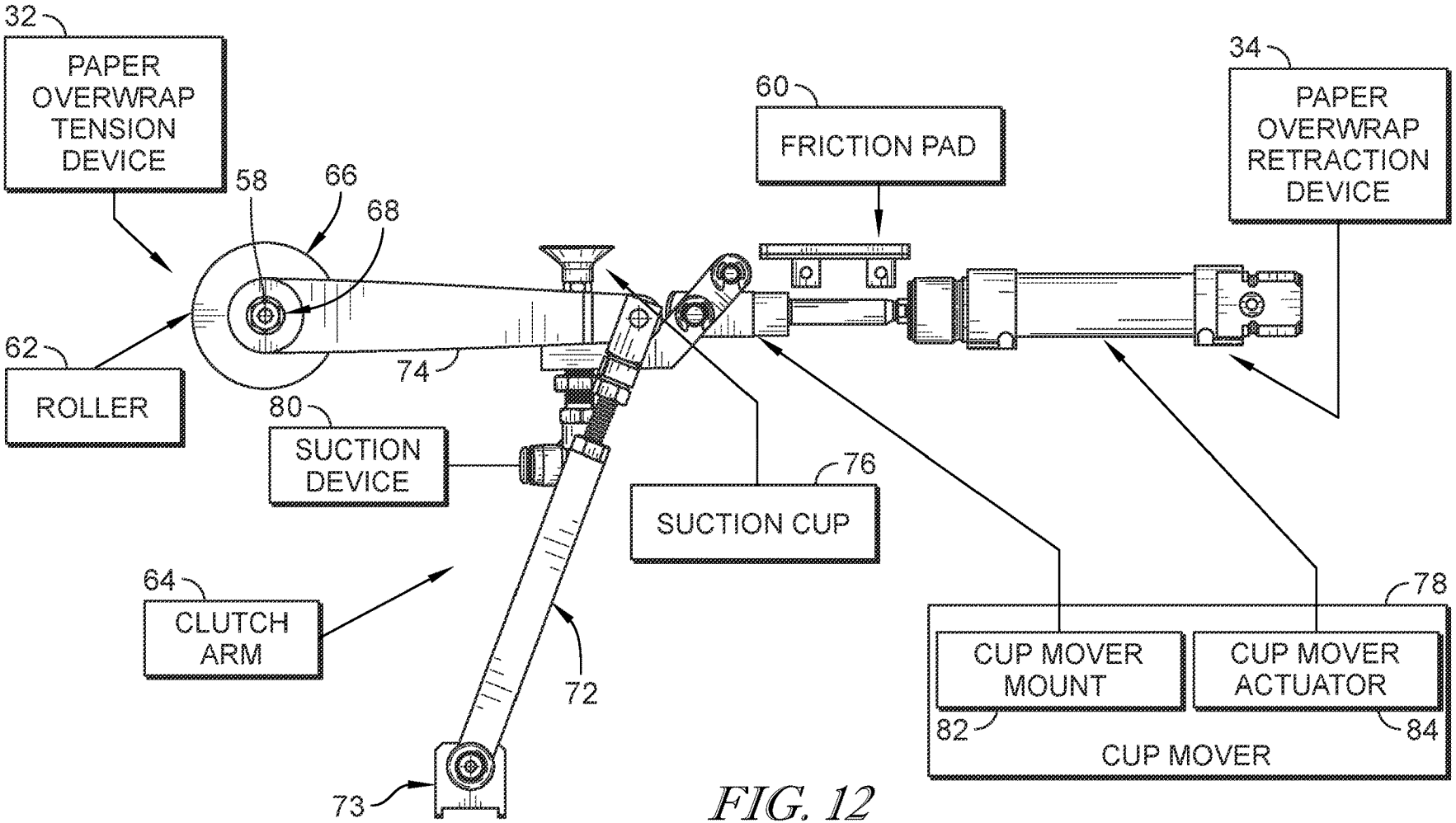
FIG. 12 is a side view of the paper overwrap tension device and the paper overwrap retraction device of FIG. 11 showing the paper overwrap tension device includes the friction pads, the rollers and the clutch arms, and showing the paper overwrap retraction device includes the suction cups, the cup moves, and the suction device.

Each roller 62A, 62B includes a roller wheel 66, a shaft 68, and bearings 70 as shown in FIGS. 10-12. The roller wheel 66 is coupled to the shaft 68 for rotation therewith. The bearings 70 are coupled to the vertical transporter carriage 54 of the vertical transporter 40. The bearings 70 support either end of the shaft 68 for rotation about the roller axis 58.

Figure 12A:
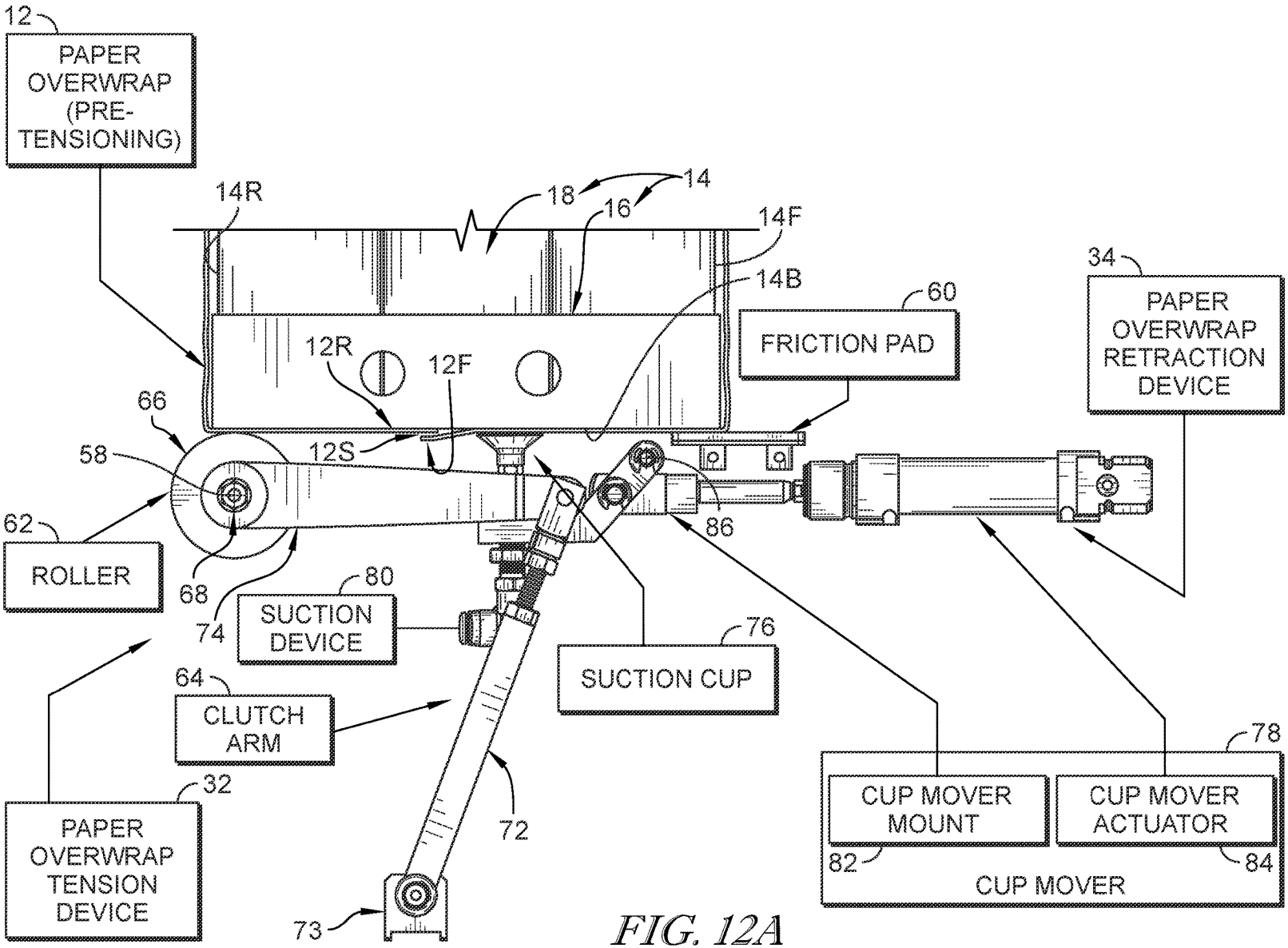
FIG. 12A is a view similar to FIG. 12 showing the device is in the pre-adhesive stage in which the clutch arm is in the pre-tension orientation such that the paper overwrap is not yet tensioned and the cup mover actuator is in the extended position to cause the cup mount is in the engaged position.
Figure 12B:
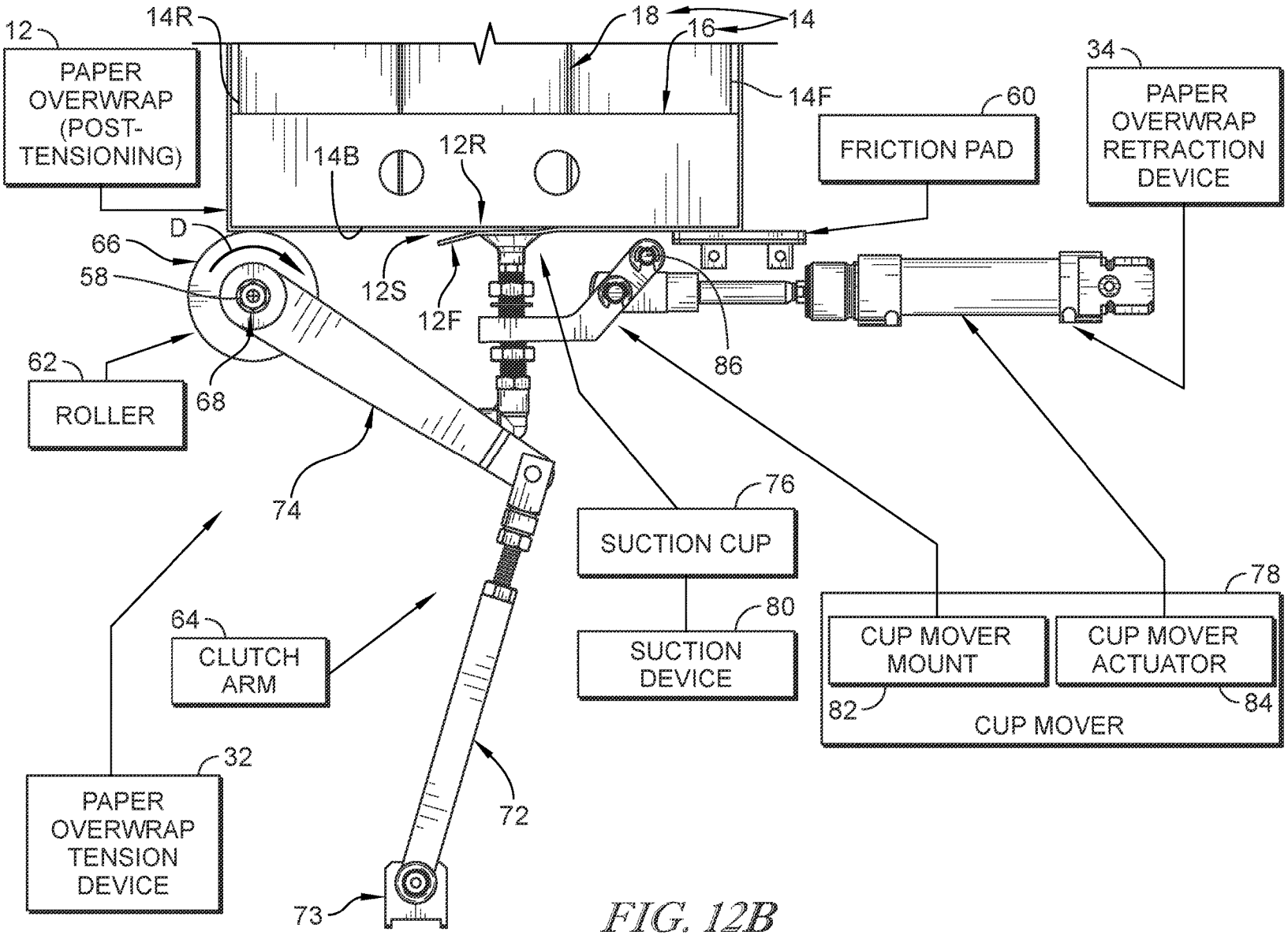
FIG. 12B is a view similar to FIG. 12A showing the device has moved to the lifting and tensioning stage in which the clutch arm has moved to the tensioned orientation to cause the rollers to rotate downstream and tension the paper overwrap and the cup mover actuator remains in the extended position to cause the cup mount to remain in the engaged position.
Figure 12C:
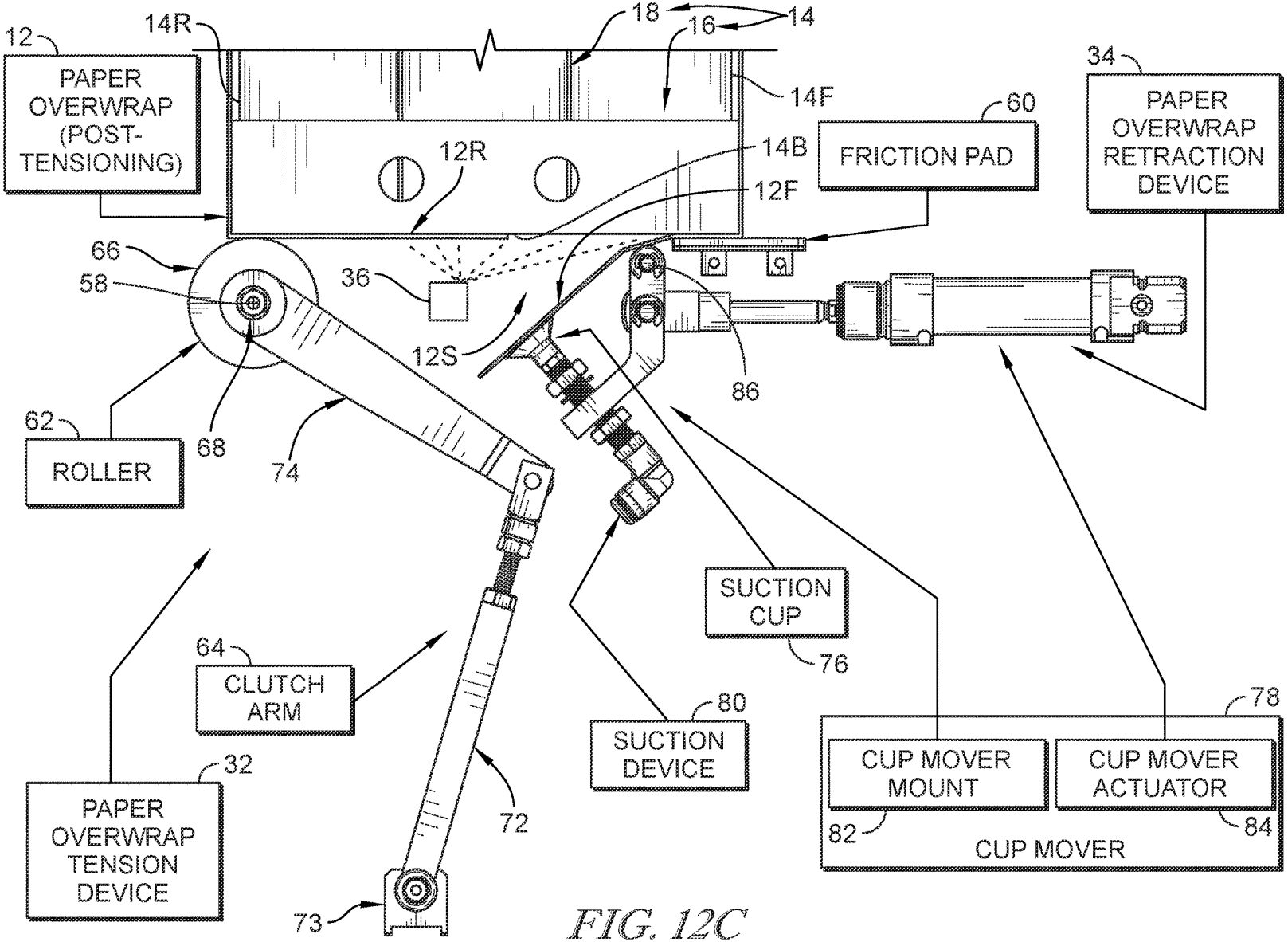
FIG. 12C is a view similar to FIG. 12B showing the device has moved to the suction stage in which the clutch arm remains in the tensioned orientation to keep the paper overwrap taut around the package and the cup mover actuator has moved from the extended position to the retracted position to cause the cup mount to move from the engaged position to the retracted position to uncover the bottom side of the package and the second free end of the paper overwrap so that the adhesive may be applied by the adhesive applicators.
Figure 12D:
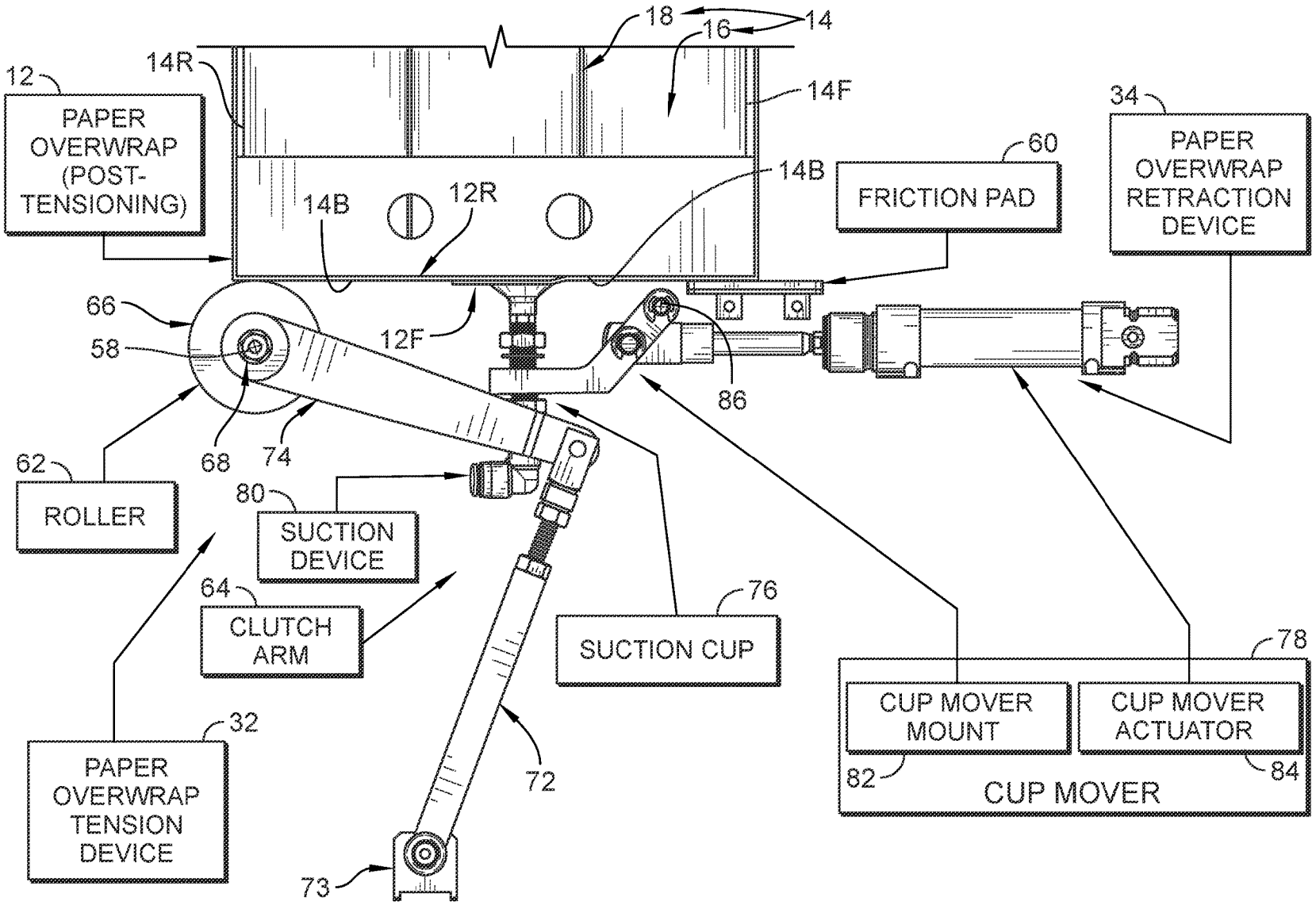
FIG. 12D is a view similar to FIG. 12C showing the device has moved to the lowering stage in which the clutch arm begins to move back to the original orientation and the cup mover actuator has moved from the retracted position to the extended position to cause the cup mount to move from the retracted position to the engaged position to engage the first free end with the adhesive applied by the adhesive applicator to the bottom side of the package and the second free end of the paper overwrap so that the seam is sealed and the paper overwrap secured around the package.

Each clutch arm 64A, 64B is configured to change between a pre-tension orientation as shown in FIGS. 12A and 12D and a post-tension orientation as shown in FIGS. 12B and 12C. Each clutch arm 64A, 64B changes from the pre-tension orientation to the post-tension orientation to cause the respective roller 62A, 62B to rotate in the downstream direction D around the roller axis 58 as shown in FIGS. 12A and 12B. In this way, the pair of rollers 62A, 62B pull the free ends 12F, 12R of the paper overwrap 12 in opposite directions around the package 14 as shown in FIG. 12B.

Each clutch arm 64A, 64B includes a base link member 72 and a connecting link member 74 as shown in FIGS. 10-12. The base link member 72 extends between a first end that is pivotally coupled to the horizontal transporter carriage 44 and a second end spaced apart from the first end. In the illustrative embodiment, the first end of the base link member 72 is pivotally coupled to the horizontal transporter carriage 44 with a mount bracket 73. The connecting link member 74 extends between a first end pivotally coupled to the second end of the base link member 72 and a second end that is coupled to the respective roller 62A, 62B.

The second end of the base link member 72 is fixed to the shaft 68 so that vertical movement of the vertical transporter carriage 54 from the first vertical position to the second vertical position causes clutch arms 64A, 64B to rotate rollers 62A, 62B in the downstream direction D about the roller axis 58. The roller wheels 66 of each roller 62A, 62B are made of a material that creates relative high coefficient of friction with the paper overwrap 12 so that rotation of the rollers 62A, 62B pulls the free end 12F of the paper overwrap 12 taut around the package 14. The friction pads 60A, 60B hold the other free end 12R of the paper overwrap 12 in place as the free end 12F is pulled to tension the paper overwrap 12 around the package 14.

The adhesive application device 24 includes paper overwrap retraction means for moving a first free end 12F of the paper overwrap 12 in a first direction away from the bottom side 14B of the package 14 after the paper overwrap 12 is tensioned around the package 14 to uncover a portion of the bottom side 14B of the package 14 and the second free end 12R of the paper overwrap 12 and for moving the first free end 12F of the paper overwrap 12 in a second direction opposite the first direction toward the bottom side 14B of the package 14 after the adhesive is applied as shown in FIGS. 2-12. The paper overwrap retraction means, or the paper overwrap retraction device 34, moves the first free end 12F of the paper overwrap 12 in the first direction so that the adhesive can be applied to the portion of the bottom side 14B of the package 14 and the second free end 12R. Then the paper overwrap retraction device 34 moves the first free end 12F of the paper overwrap 12 in the second direction opposite the first direction back toward the bottom side 14B of the package 14 after the adhesive is applied to seal the first free end 12F with the bottom side 14B of the package 14 and the second free end 12R thereby sealing the seam 12S and fixing the paper overwrap 12 in place on the package 14.

The paper overwrap retraction device 34 comprises a pair of suction cups 76, a pair of cup movers 78, and a suction device 80 as shown in FIGS. 7-12. Each suction cup 76A, 76B of the pair of suction cups 76 is pivotably coupled to the vertical transporter carriage 54 to pivot in the first direction away from the bottom side 14B of the package 14 and in the second direction opposite the first direction toward the bottom side 14B of the package 14. Each cup mover 78A, 78B of the pair of cup movers 78 is coupled to one of the suction cups 76A, 76B and configured to pivot the suction cups 76A, 76B in the first direction and the second direction. The suction device 80 is coupled to the suction cups 76A, 76B and configured to apply a suction or vacuum force to the first free end 12F of the paper overwrap 12 through the suction cups 76A, 76B to cause the paper overwrap 12 to be fixed to the suction cups 76A, 76B so that the first free end 12F of the paper overwrap 12 moves with the pair of suction cups 76 in the first and second directions.

In the illustrative embodiment, the left and right suction cups 76A, 76B are substantially similar. In the illustrative embodiment, the left and right cup moves 78A, 78B are substantially similar.

Each suction cup 76A, 76B has hosing 77A, 77B that extends between and interconnects the suction cups 76A, 76B to the suction device 80 so that the suction cups 76A, 76B to the suction device 80 are in fluid communication. The hosing 77A, 77B may interconnect to a single suction device 80. In some embodiments, the hosing 77A, 77B couples each respective suction cup 76A, 76B to a separate suction device 80.

Each cup mover 78A, 78B includes a suction cup mount 82 and an actuator 84 as shown in FIGS. 7-12. Each suction cup mount 82 is pivotably coupled to the vertical transporter carriage 54 to pivot between an engaged position as shown in FIG. 12A and a retracted position as shown in FIG. 12C. Each suction cup mount 82 is configured to pivot about a mover axis 86 relative to the vertical transporter carriage 54 in the first and second directions with the corresponding suction cup 76A, 76B. Each actuator 84 is coupled to the corresponding suction cup mount 82. Each actuator 84 is configured to drive pivoting of the suction cup mount 82 about the mover axis 86 between the engaged and retracted positions.

In the illustrative embodiment, the actuator 84 is a linear actuator configured to move between an extended actuator position as shown in FIG. 12A and a retracted actuator position as shown in FIG. 12C. In some embodiments, the actuator 84 is a pneumatic linear actuator. In some embodiments, another suitable actuator or drive system may be used.

In the engaged position, the actuator 84 is in the extended actuator position to cause the suction cup mount 82 to be relatively parallel with the bottom side 14B of the wrapped package 14 so that the suction cups 76A, 76B engage the bottom side 14B of the wrapped package 14 as shown in FIGS. 12A, 12B, and 12D. In the retracted position, the actuator 84 is in the retracted actuator position to cause the suction cup mount 82 to be angled relative to the bottom side 14B of the wrapped package 14 so that the suction cups 76A, 76B are spaced apart from the bottom side 14B of the wrapped package 14 as shown in FIG. 12C.

The actuator 84 moves from the extended actuator position to the retracted actuator position to cause the suction cup mount 82 to move from the engaged position to the retracted position so that a portion of the bottom side 14B of the package 14 and the second free end 12R of the paper overwrap 12 are uncovered to be able to apply the adhesive as shown in FIGS. 12B and 12C. The actuator 84 moves from the retracted actuator position to the extended actuator position to cause suction cup mount 82 to move from the retracted position to the engaged position so that the first free end 12F is engaged with the adhesive on the portion of the bottom side 14B of the package 14 and the second free end 12R of the paper overwrap 12 to fix the paper overwrap 12 in place on the package 14 as shown in FIGS. 12C and 12D.

The adhesive application device 24 includes the adhesive applicator 36 as shown in FIGS. 2 and 6-8. The adhesive applicator 36 is configured to apply the adhesive to the seam 12S on the package 14. The adhesive applicator 36 may be a glue gun, a tape dispenser, or another suitable adhesive applicator. The adhesive may be glue, tape, or another suitable adhesive.

Figure 2:
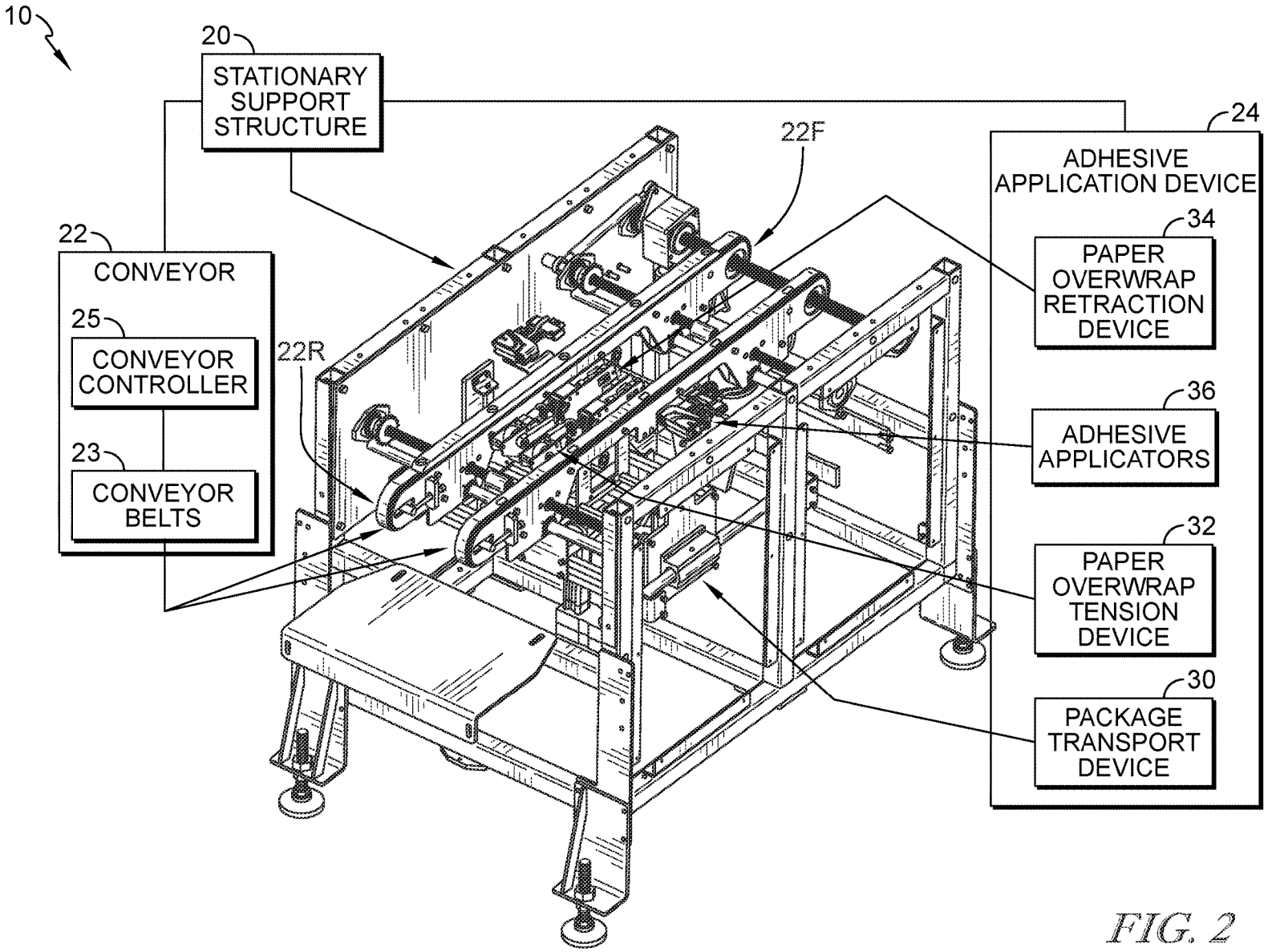
FIG. 2 is a perspective view of the device of FIG. 1 with a portion of the support frame broken away to show the conveyor includes a pair of conveyor belts and a conveyor controller configured to drive movement of the conveyor belts in the conveyor direction, and further showing the adhesive application device of the device includes a package transport device configured to lift and lower the wrapped package relative to the conveyor along a vertical axis perpendicular to the conveyor as the wrapped package continues to move in the conveyor direction to temporarily expose the free ends of the paper overwrap on a bottom side of the package as shown in FIGS. 3-5, a paper overwrap tension device configured to pull the free ends of the paper overwrap in opposed directions around the package as the package is lifted away from the conveyor to tension the paper overwrap around the package before the adhesive is applied to the bottom side of the package as shown in FIGS. 3-5, and a paper overwrap retraction device configured to pivot a first free end of the paper overwrap in away from the bottom side of the package after the paper overwrap is tensioned around the package to uncover a portion of the bottom side of the package and the second free end of the paper overwrap so that the adhesive may be applied before the package is lowered back onto the conveyor as shown in FIGS. 3-5.

In the illustrative embodiment, the device 10 includes the stationary support frame 20, the conveyor 22 mounted to the support frame 20, the adhesive application device 24 mounted to the stationary support frame 20, and a control unit 26 coupled to the conveyor 22 and the adhesive application device 24 as shown in FIGS. 1 and 2. The control unit 26 is configured to control movement of the conveyor 22 and the adhesive application device 24. The control unit 26 may be coupled to the conveyor controller 25 and to direct the conveyor controller 25 to start and stop the conveyor 22. The control unit 26 may be configured to start and stop the adhesive application device 24. The control unit 26 may be configured to adjust the speed of the conveyor 22 and the adhesive application device 24 and/or adjust the timing of the different stages. The control unit 26 may be configured to increase or decrease the suction force applied by the suction device 80. The control unit 26 may be configured to increase or decrease the amount of adhesive applied. The control unit 26 may have a user interface to allow a user to adjust different functions of the device 10.

Figure 3:
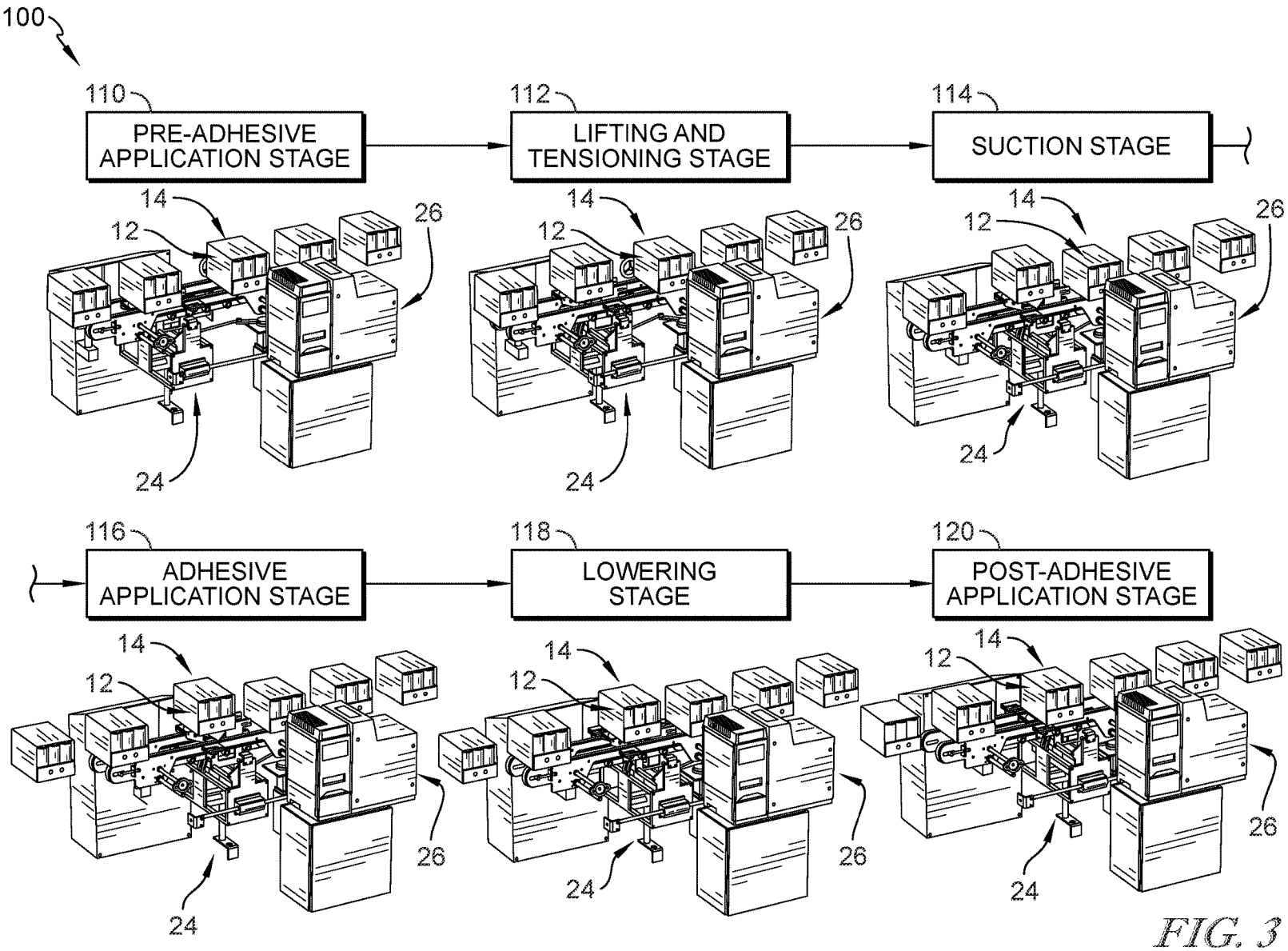
FIG. 3 is diagrammatic view of the device of FIG. 1 with the support frame hidden to show the adhesive application device moves through a pre-adhesive application stage, a lifting and tensioning stage, a suction stage, an adhesive application stage, a lowering stage, and a post-adhesive application stage.
Figure 5:
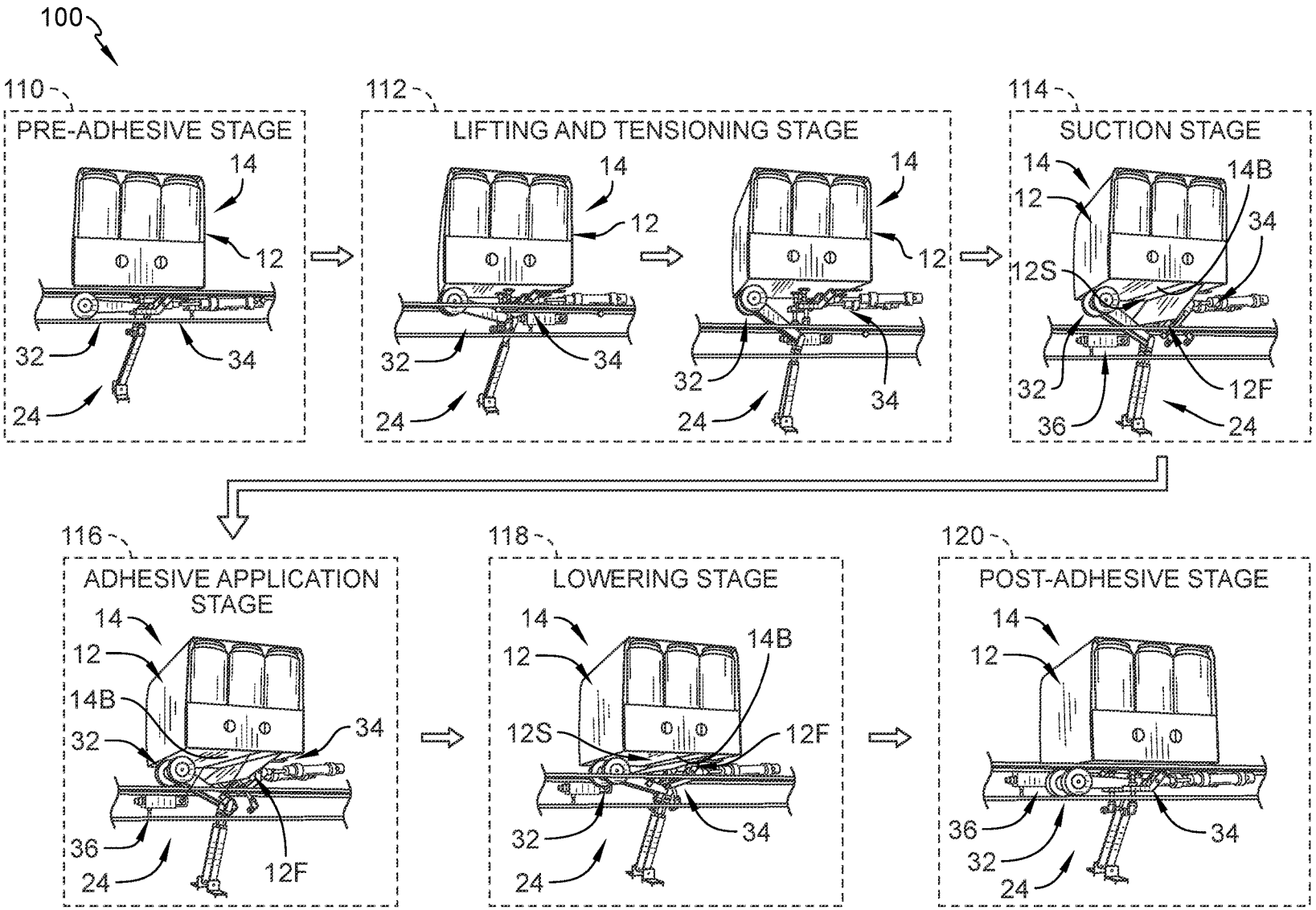
FIG. 5 is a diagrammatic view similar to FIG. 4 with portions of the conveyor belts removed to show the paper overwrap tension device and the paper overwrap retraction device at each the pre-adhesive application stage, the lifting and tensioning stage, the suction stage, the adhesive application stage, the lowering stage, and the post-adhesive application stage.
Figure 6:
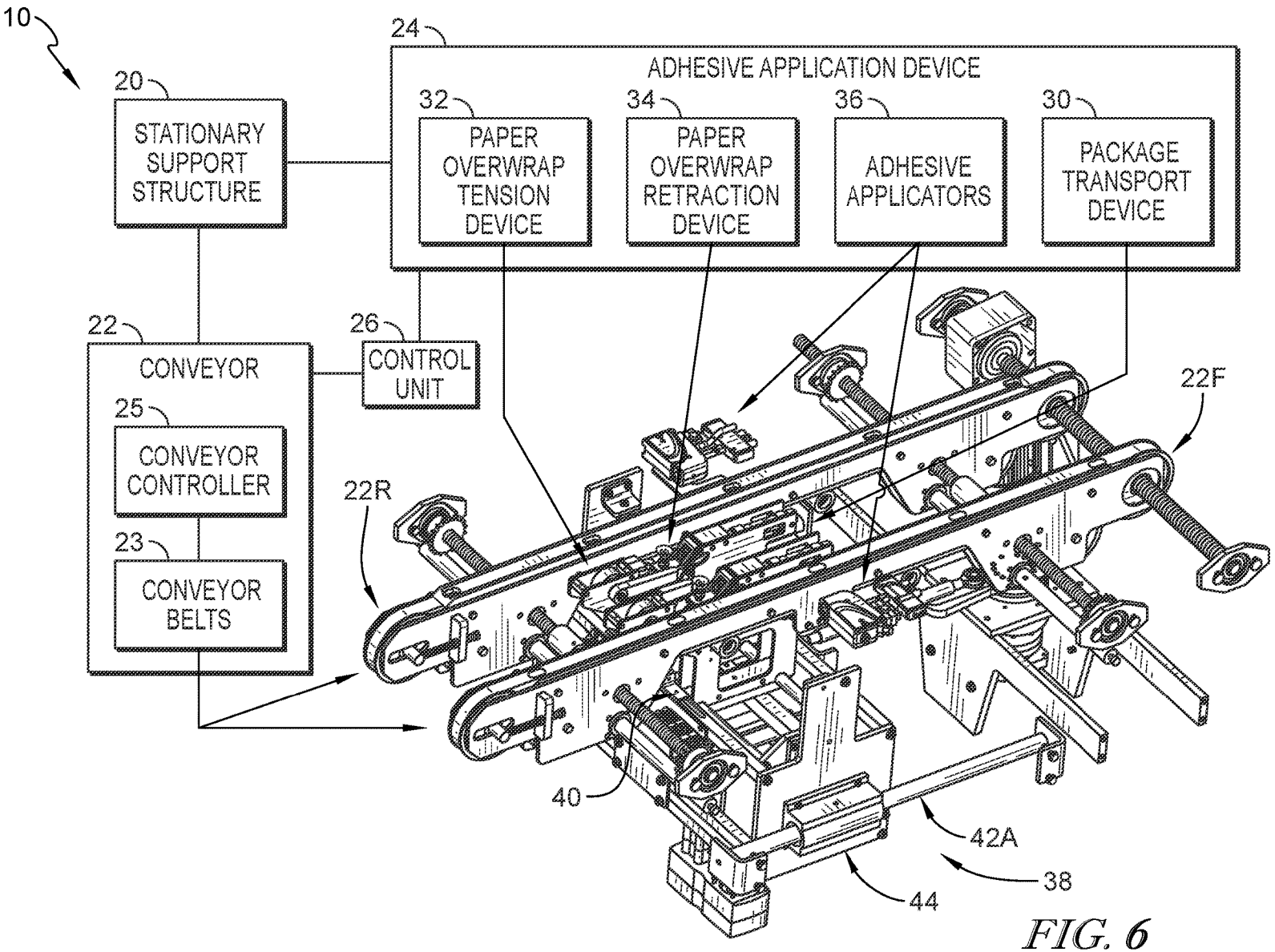
FIG. 6 is a perspective view of the device of FIG. 1 with the stationary support frame removed to show the conveyor and the adhesive application device.

A method 100 of tensioning and securing the paper overwrap 12 around the package 14 includes several steps or stages as shown in FIGS. 3-5. The method 100 includes a pre-adhesive application stage 110, a lifting and tensioning stage 112, a suction stage 114, an adhesive application stage 116, a lowering stage 118, and a post-adhesive application stage 120 as shown in FIGS. 3-5.

The method 100 also comprises providing the wrapped package 14 including the package 14 and the paper overwrap 12. The package 14 includes the tray 16 that defines the cavity 16C and the plurality of goods 18 located in the cavity 16C of the tray 16. The paper overwrap 12 extends around the bottom side 14B, the top side 14T, the front side 14F, and the rear side 14R of the package 14 so that free ends 12F, 12R of the paper overwrap 12 overlap on the bottom side 14B of the package 14.

In the pre-adhesive application stage 110, the wrapped package 14 is in a conveyor position in which the wrapped package 14 rests on the conveyor 22 to move in the conveyor direction C and the adhesive application device 24 is in a lowered mode in which the adhesive application device 24 is below the conveyor 22 so that the adhesive application device 24 is spaced apart from the wrapped package 14 and does not engaged the wrapped package 14. The method 100 further includes moving the wrapped package 14 in the conveyor direction C.

As the wrapped package continues to move in the conveyor direction C, the method 100 continues to the lifting and tensioning stage 112. In the lifting and tensioning 112, the adhesive application device 24 changes from the lowered mode to a lifted mode to cause the wrapped package 14 to move from the conveyor position to a raised position in which the wrapped package 14 is spaced apart from the conveyor 22. The method 100 includes lifting the wrapped package 14 from a conveyor orientation as shown in FIG. 12A in which the free ends 12F, 12R of the paper overwrap 12 are partially blocked to a lifted orientation as shown in FIGS. 12B and 12C in which the free ends 12F, 12R of the paper overwrap 12 on the bottom side 14B of the package 14 are exposed.

In the lifting and tensioning stage 112, the method 100 further includes pulling the free ends 12F, 12R of the paper overwrap 12 in opposed directions around the package 14 after the wrapped package 14 is in the lifted orientation to tension the paper overwrap 12 around the package 14 to keep the paper overwrap 12 taut around the bottom side 14B, the top side 14T, the front side 14F, and the rear side 14R of the package 14. Once the paper overwrap 12 is tensioned, the method 100 continues suction stage 114. In the suction stage, the adhesive application device 24 remains in the lifted mode with the paper overwrap 12 held in the taut position by the paper overwrap tension device while the paper overwrap retraction device 34 pivots the first free end 12F of the paper overwrap 12 in the first direction away from the bottom side 14B of the package 14. The method 100 includes moving the first free end 12F of the paper overwrap 12 in the first direction away from the bottom side 14B of the package 14 to a retracted position to uncover a portion of the bottom side 14B of the package 14 and the second free end 12R of the paper overwrap 12.

Next, the method 100 continues to the adhesive application stage 116. The method 100 further includes applying an adhesive to the portion of the bottom side 14B of the package 14 and the second free end 12R of the paper overwrap 12 while the first free end 12F of the paper overwrap 12 is in the retracted position. After applying the adhesive, the method 100 continues with moving the first free end 12F of the paper overwrap 12 in the second direction toward from the bottom side 12B of the package 14 to an engaged position to seal the first free end 12F with the bottom side 14B of the package 14 and the second free end 12R thereby fixing the paper overwrap 12 in place on the package.

Once the seam 12S is seals, the method 100 continues to the lowering stage 118 and the post-adhesive stage 120. In the lowering stage 118, the method 100 includes lowering the wrapped package 14 to the conveyor orientation.

The method 100 then repeats with the next wrapped package 14. To repeat the steps, the horizontal transporter 38 returns to the first horizontal position from the second position.

Another embodiment of a device 210 in accordance with the present disclosure is shown in FIGS. 13-29F. The device 210 is substantially similar to the device 10 shown in FIGS. 1-12D and described herein. Accordingly, similar reference numbers in the 200 series may indicate features that are common between the device 10 and the device 210, except in instances when it conflicts with the specific description and the drawings of the device 210.

An illustrative embodiment of another device 210 adapted to seal the paper overwrap 12 around the package 14 is shown in FIGS. 13-29F. The package 14 includes the tray 16 holding the plurality of goods 18 in the cavity 16C of the tray 16. The paper overwrap 12 is wrapped around the bottom side 14B of the package 14 defined by the tray 16, the top side 14T opposite the bottom side 14B, and front and rear sides 14F, 14R that extend between and interconnect the top and bottom sides 14T, 14B of the package 14 so that free ends 12 of the paper overwrap 12 overlap on the bottom side 14B of the package 14 to form the seam 12S or flap 12S. The device 210 is adapted to seal the seam 12S of the package overwrap 12 thereby fixing the paper overwrap 12 in place around the package 14 so that the paper overwrap 12 holds the plurality of goods 18 in place in the cavity 16C of the tray 16.

Figure 13:
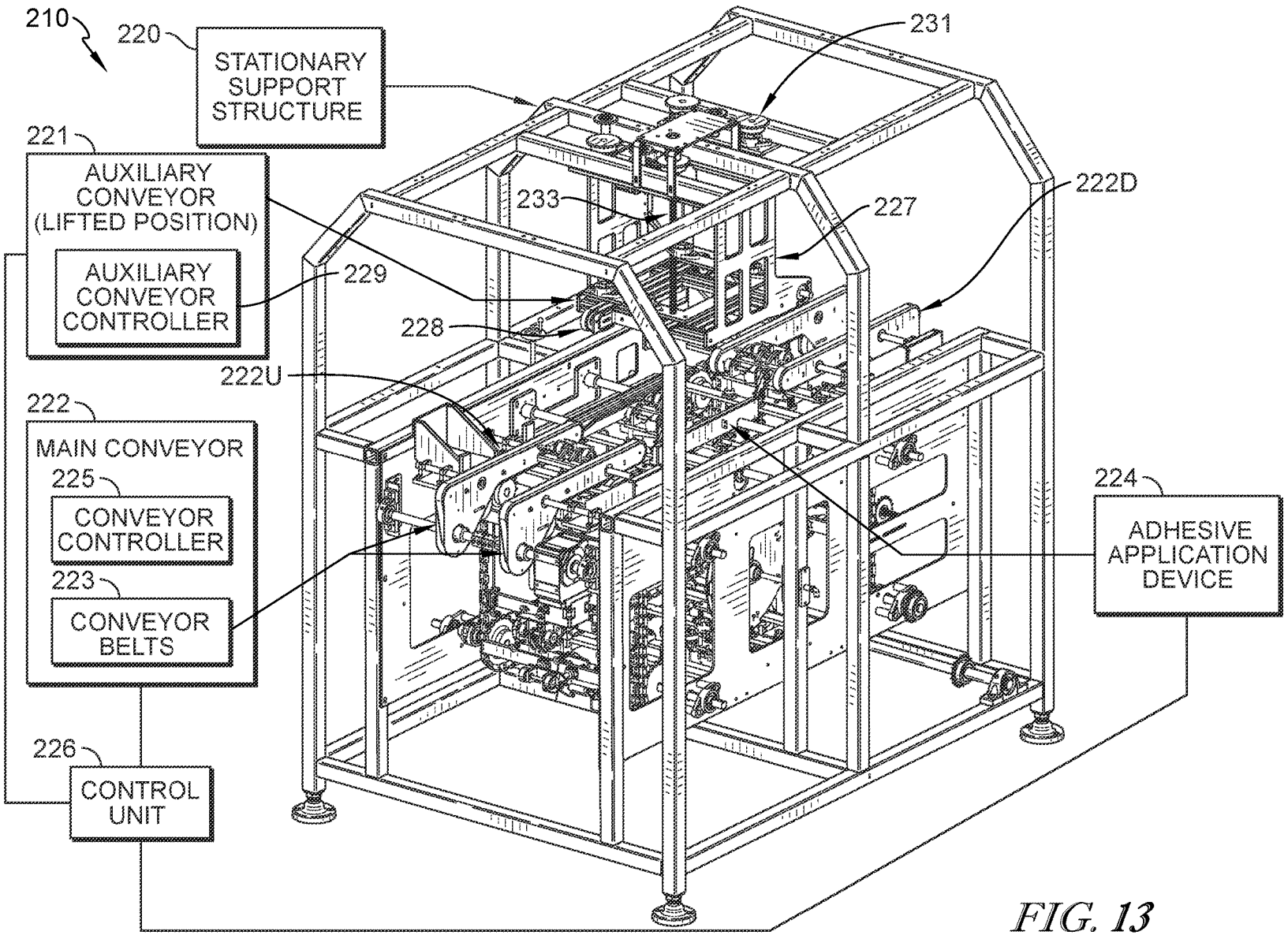
FIG. 13 is a perspective view of another embodiment of a device adapted to fix a paper overwrap around packages showing the device includes a stationary support frame, a main conveyor mounted to the support frame and configured to transport the package wrapped in the paper overwrap in a conveyor direction through the support frame to an adhesive application device mounted to the support frame that is configured to fix the paper overwrap to the package, and an auxiliary conveyor mounted to the stationary support frame to change between a lifted position to a lowered position as shown in FIG. 14 when the auxiliary adhesive device is not being used because the packages are being wrapped in shrink wrap instead of the paper overwrap.
Figure 14:
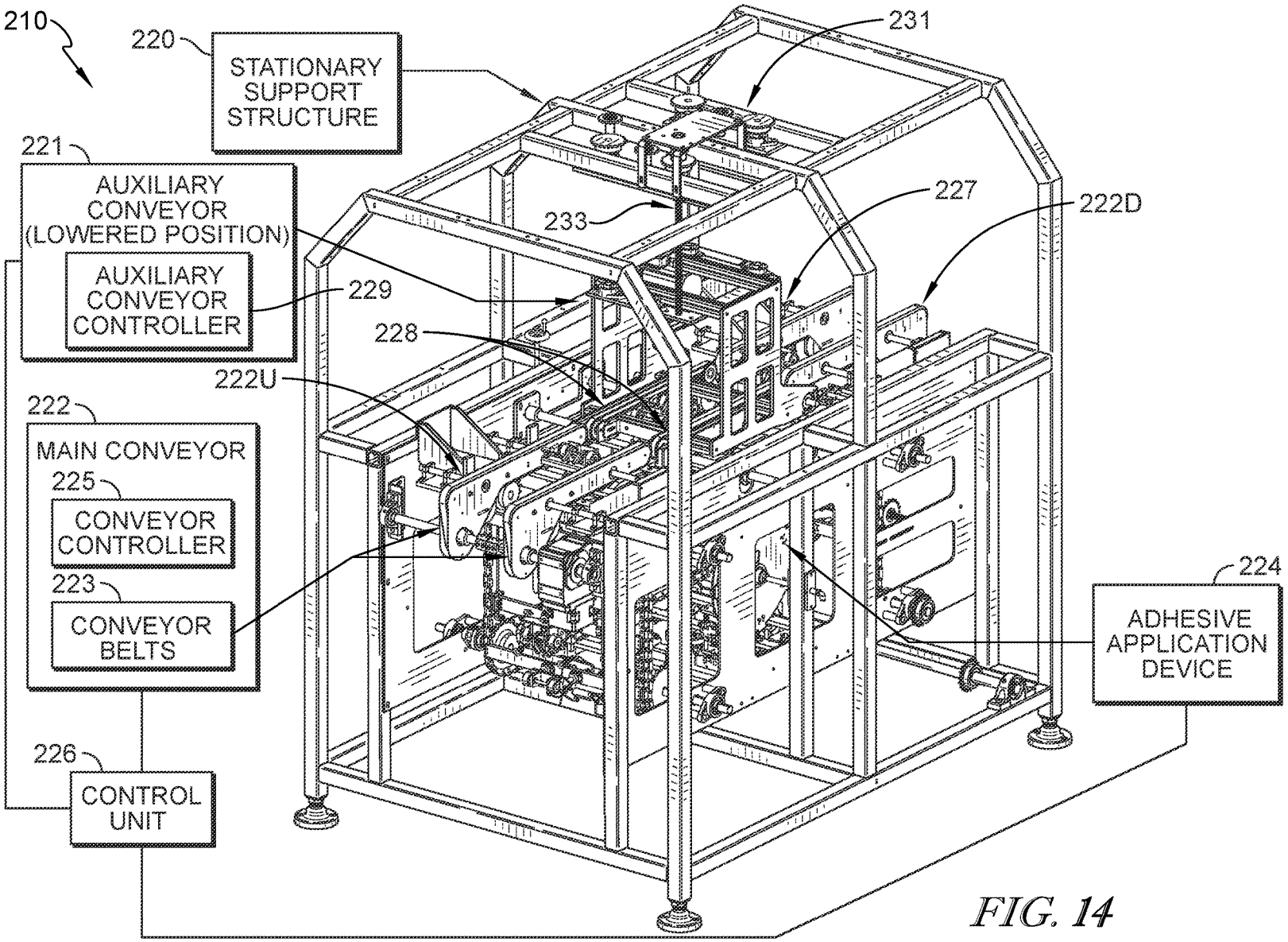
FIG. 14 is a perspective view similar to FIG. 13 showing the auxiliary conveyor in the lowered position so that the auxiliary conveyor bridges a gap between an upstream conveyor section and a downstream conveyor section of the main conveyor section so that shrink wrapped packages continue to move through the device without even though the adhesive application device is not needed that way the overall packaging system does can switch between using shrink wrap and paper overwrap to wrap the packages.

The device 210 includes a stationary support frame 220, a main conveyor 222 mounted to the support frame 220, an auxiliary conveyor 221, and an adhesive application device 224 mounted to the stationary support frame 220 as shown in FIGS. 13-25. The main conveyor 222 is configured to transport the package 14 wrapped in the paper overwrap 12 in a conveyor direction C through the support frame 220. The auxiliary conveyor 221 is mounted to the stationary support frame 220 to change between a lifted position as shown in FIG. 13 to a lowered position as shown in FIG. 14. The auxiliary conveyor 221 is configured to bridge a gap between an upstream conveyor section 222U and a downstream conveyor section 222D of the main conveyor 222 to convert the device 210 for shrink wrapping packages 14 instead of using the paper overwrap 12. The adhesive application device 224 is configured to tension the paper overwrap 12, while opening the seam 12S so that an adhesive may be applied to the bottom side 14B of the package 14 and the seam 12S sealed together.

The upstream and downstream conveyor sections 222U, 222D of the main conveyor 222 each includes a pair of conveyor belts 223 and a conveyor controller 225. The conveyor controller 225 is coupled to the conveyor belts 223 and configured to drive movement of the conveyor belts 223 in the conveyor direction C. The downstream conveyor section 222D is spaced apart from the upstream conveyor section 222U to define a gap therebetween. The adhesive application device 224 applies the adhesive to the bottom side 14B of the package 14 in the gap as the adhesive application device 224 moves the wrapped package 14 across the gap.

The auxiliary conveyor 221 includes a conveyor support frame 227, a pair of auxiliary conveyor belts 228, an auxiliary conveyor controller 229, and a frame drive system 231 as shown in FIGS. 13 and 14. The conveyor support frame 227 is mounted to the stationary support frame 220 for vertical movement between the lifted position and the lowered position. The pair of conveyor belts 228 are coupled to the conveyor support frame 227. The auxiliary conveyor controller 229 is coupled to the auxiliary conveyor belts 228 and configured to drive movement of the auxiliary conveyor belts 228 in the conveyor direction C. The frame drive system 231 is mounted to the stationary support frame 220. The frame drive system 231 is coupled to the conveyor support frame 227 to drive movement of the conveyor support frame 227 vertically between the lifted and lowered positions.

In the illustrative embodiment, the auxiliary conveyor 221 has a separate auxiliary conveyor controller 229 that drives movement of the conveyor belts 228. In some embodiments, the conveyor controller for the auxiliary conveyor belts 228 may be the same as the conveyor controller 225 for the main conveyor 222.

The frame drive system 231 includes a motor (not shown) and a drive shaft 233 coupled to the motor as shown in FIGS. 13 and 14. The drive shaft 233 is a threaded rod that transfers the rotational motion of the motor to linear motion to cause the horizontal transporter carriage 44 to reciprocate along the horizontal axis 38A in the illustrative embodiment. In other embodiments, another suitable drive system may be used such as a linear actuator.

The adhesive application device 210 includes a package transport device 230, a plurality of paper overwrap tension devices 232, and a plurality of paper overwrap retraction devices 234, and adhesive applicators 236 as shown in FIGS. 15-17 and 20-29F. The package transport device 230 provides package transport means for lifting the wrapped package 14 away from the main conveyor 222 along a vertical axis 240A perpendicular to the conveyor 222 as the wrapped package 14 continues to move in the conveyor direction C and for lowering the wrapped package 14 along the vertical axis 240A toward the main conveyor 222 after the adhesive has been applied. The paper overwrap tension devices 232 each provide means for pulling the free ends 12F, 12R of the paper overwrap 12 in opposed directions around the package 14 to tension the paper overwrap 12 around the package 14 and maintain the tension as the adhesive is applied. The paper overwrap retraction devices 234 each provide means for moving the first free end 12F of the paper overwrap 12 in a first direction away from the bottom side 14B of the package 14 after the paper overwrap 12 is tensioned around the package 14 to uncover a portion of the bottom side 14B of the package 14 and the second free end 12R of the paper overwrap 12 and for moving the first free end 12F of the paper overwrap 12 in a second direction opposite the first direction toward the bottom side 14B of the package 14 after the adhesive is applied. Each adhesive applicator 236 is configured to apply the adhesive to the uncovered portion of the bottom side 14B of the package 14 and the second free end 12R of the paper overwrap 12 when the first free end 12F is moved away from the bottom side 14B of the package 14.

The adhesive application device 224 includes package transport means for lifting the wrapped package 14 away from the main conveyor 222 along the vertical axis 240A perpendicular to the main conveyor 222 as the wrapped package 14 continues to move in the conveyor direction C and for lowering the wrapped package 14 along the vertical axis 40A toward the main conveyor 222 after the adhesive has been applied as shown in FIGS. 13-29F. The package transport means, or the package transport device 230, lifts the wrapped package 14 to expose the free ends 12F, 12R of the paper overwrap 12 on the bottom side 14B of the package 14 so that the free ends 12F, 12R of the paper overwrap 12 are free to be moved relative to the package 14 to tension the paper overwrap 12 before the adhesive is applied to the bottom side 14B of the package 14. The package transport device 230 lowers the wrapped package 14 along the vertical axis 240A toward the conveyor 222 after the adhesive has been applied to set the wrapped package 14 back on the conveyor 222.

The package transport device 230 comprises a package transport conveyor 238 configured to continuously cycle in the conveyor direction C, a plurality of package transport carriages 240 coupled to the package transport conveyor for movement therewith, and a transport carriage actuator 242. Each of the package transport carriages 240 are configured to move vertically along the vertical axis 240A as the package transport conveyor 238 moves the plurality of package transport carriages 240 in the conveyor direction C. The transport carriage actuator 242 that selectively engages each of the package transport carriages 240 to cause the plurality of package transport carriages 240 to move vertically as the package transport carriages 240 move in the conveyor direction C with the package transport conveyor 238.

The package transport conveyor 238 includes transport conveyor belts 244 and a transport conveyor drive system 246 as shown in FIGS. 16, 17, and 20-22. The transport conveyor drive system 246 is coupled to the transport conveyor belts 244 and configured to drive movement of the transport conveyor belts 244 in the conveyor direction C.

The package transport carriages 240 are spring biased toward a lowered configuration as shown in FIGS. 17-19 and 22-29F. The transport carriage actuator 242 selectively overcomes the bias force applied to the package transport carriage 240 to cause the package transport carriage 240 to move along the vertical axis 240A from the lowered configuration to a lifted configuration to lift the wrapped package 14 as shown in FIGS. 17-19 and 29A-F.

The transport carriage actuator 242 comprises a linear cam member 248 coupled to the stationary support frame 220 and a cam follower 250 coupled to each package transport carriage 240. The linear cam member 248 is formed to define a cam surface 248S. The cam follower 250 engages the cam surface 248S as the package transport carriage 240 moves in the conveyor direction C to cause each package transport carriage 240 to move vertically along the vertical axis 240A. The cam follower 250 engages the cam surface 248S to overcome the bias force, but when the cam follower 250 disengages the cam surface 248S, the bias force causes the package transport carriage 240 to return to the lowered configuration.

Each package transport carriage 240 includes a front carriage member 252 and a rear carriage member 254 as shown in FIGS. 17-29F. The rear carriage member 254 is spaced upstream of the front carriage member 252. One paper overwrap tension device 232 and one paper overwrap retraction device 234 is coupled to each package transport carriage 240 as shown in FIGS. 24-28. In the illustrative embodiment, the front and rear carriage members 252, 254 are independently controlled. For example, the transport carriage actuator 242 controls vertical movement of the front carriage member 252 independent of the rear carriage member 254.

Figure 18:
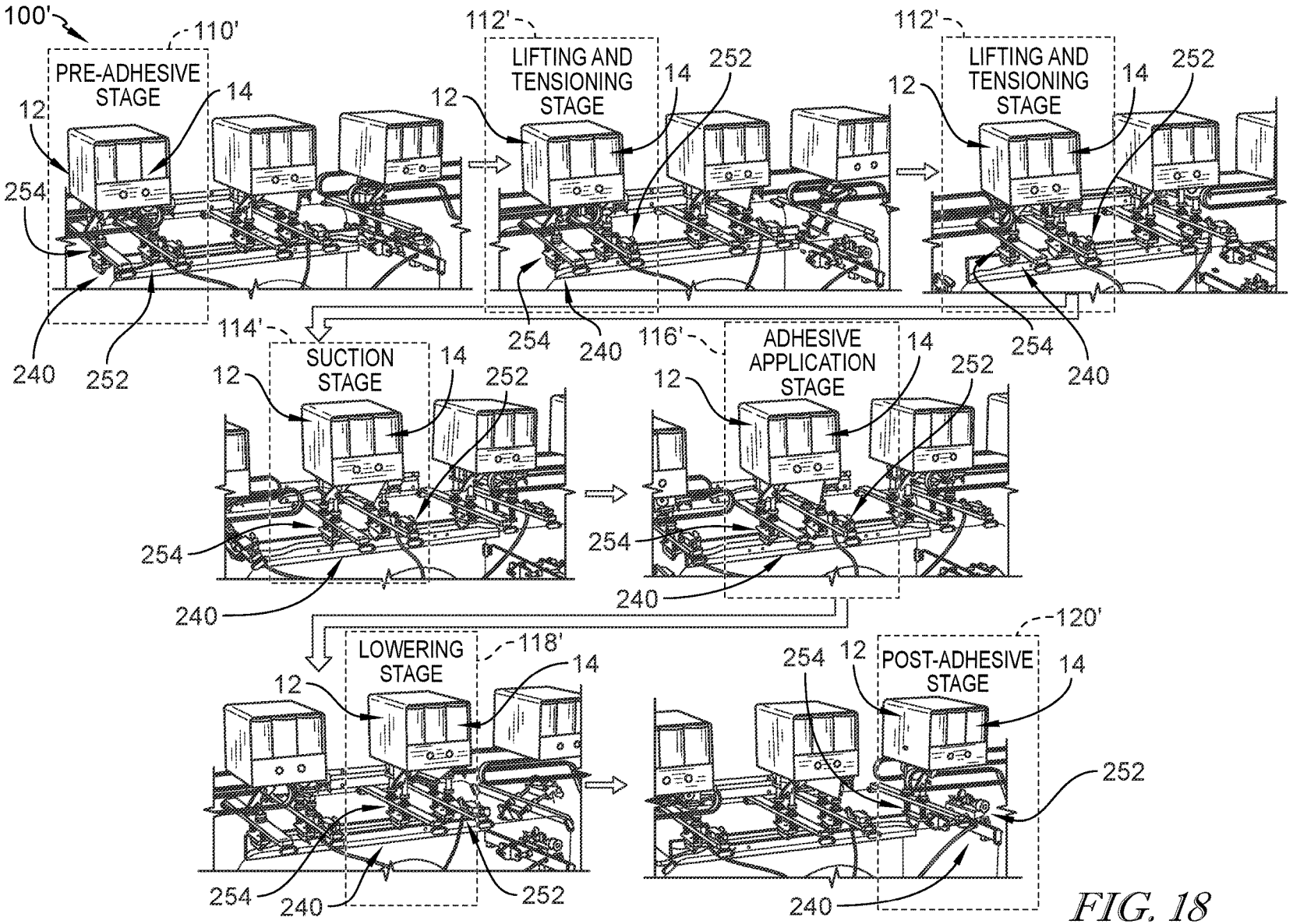
FIG. 18 is diagrammatic view of the device of FIG. 13 with the support frame hidden to show the adhesive application device moves through a pre-adhesive application stage, a lifting and tensioning stage, a suction stage, an adhesive application stage, a lowering stage, and a post-adhesive application stage.
Figure 19:
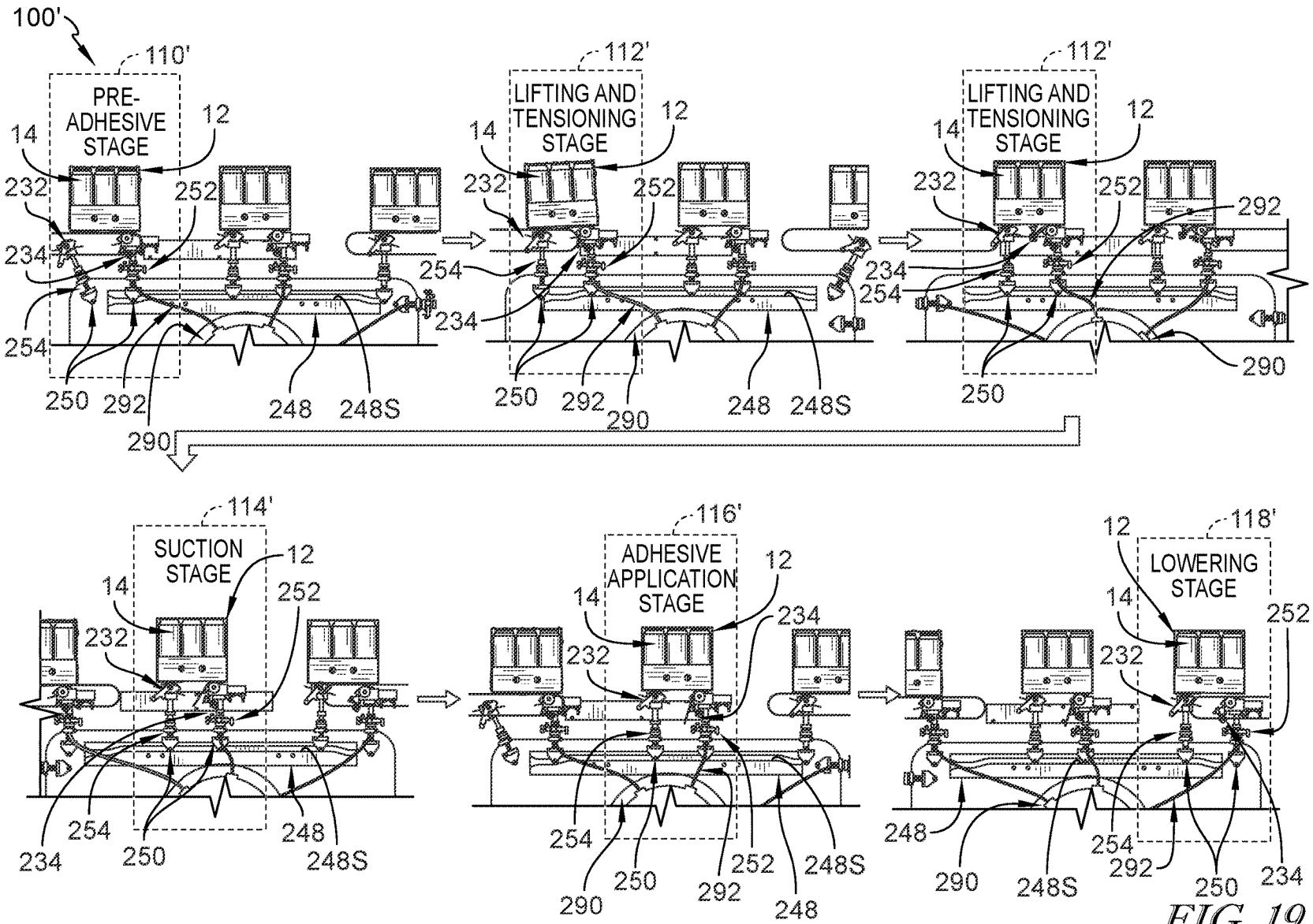
FIG. 19 is a diagrammatic view of the device of FIG. 13 showing the adhesive application device moves through (i) the pre-adhesive application stage in which the package wrapped in the paper overwrap is in a conveyor position in which the wrapped package rests on the conveyor to move in the conveyor direction and the adhesive application device is in a lowered mode in which the adhesive application device is below or in line with the, (ii) the lifting and tensioning stage in which the adhesive application device has changed from the lowered mode to a lifted mode to cause the wrapped package to move from the conveyor position to a raised position in which the wrapped package is spaced apart from the conveyor to expose the free ends of the paper overwrap so that the paper overwrap tension device may pull the free ends of the paper overwrap in opposed directions around the package to tension the paper overwrap around the package to keep the paper overwrap in a taut position around bottom, top, front, and rear sides of the package, (iii) the suction stage in which the adhesive application device remains in the lifted mode with the paper overwrap held in the taut position by the paper overwrap tension device while the paper overwrap retraction device pivots the first free end of the paper overwrap in a first direction away from the bottom side of the packaging to a retracted position in which a portion of the bottom side of the package and the second free end of the paper overwrap are uncovered so that the adhesive may be applied, (iv) the adhesive application stage in which adhesive is applied to the portion of the bottom side of the package and the second free end of the paper overwrap while the paper overwrap retraction device holds the first free end in the retracted position, (v) the lowering stage in which the adhesive application device changes from the lifted mode to the lowered mode to cause the wrapped package to move from the raised position back to the conveyor position while the paper overwrap retraction device also pivots the first free end of the paper overwrap in a second direction opposite the first direction toward the bottom side of the packaging to an engaged position in which the freed ends of the paper overwrap are fixed to the package to secure the paper overwrap around the package in the taut position.

Each front and rear carriage member 252, 254 has one cam follower 250 coupled thereto. Thus, when the front carriage member 252 moves toward the linear cam 248, the cam follower 250 coupled to the front carriage member 252 engages the cam surface 248S to cause the front carriage member 252 to lift vertically. The rear carriage member 254 follows the front carriage member 252 such that the cam follower 250 coupled to the rear carriage member 254 engages the cam surface 248S to cause the rear carriage member 254 to lift vertically after the front carriage member 252. Similarly, the cam follower 250 on the front carriage member 252 will disengage the cam surface 248S before the rear carriage member 254. The independent movement of the front and rear carriage members 252, 254 is shown in FIGS. 18 and 19.

Figure 24:
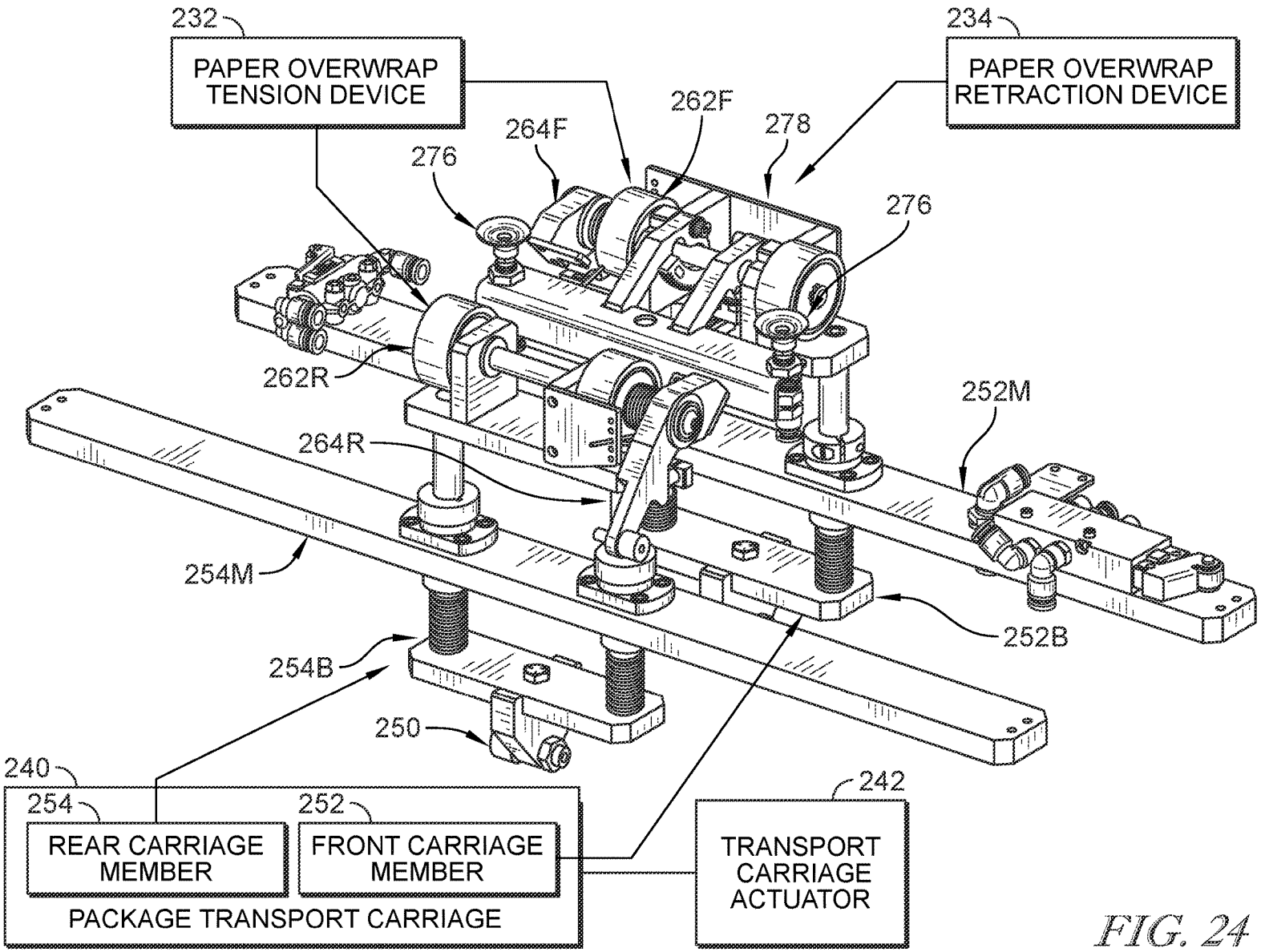
FIG. 24 is a perspective view of one the package transport carriages with the corresponding paper overwrap tension device and the corresponding paper overwrap retraction device showing the paper overwrap tension device has front roller wheels coupled to the front carriage member, rear roller wheels coupled to the rear carriage member, and corresponding front and rear clutch arms, and further showing the paper overwrap retraction device is coupled to the front carriage member the paper overwrap retraction device includes a set of suction cups, a cup mover coupled to the suction cups and pivotably coupled to the front carriage member, and a central suction device coupled to the suction cups.
Figure 25:
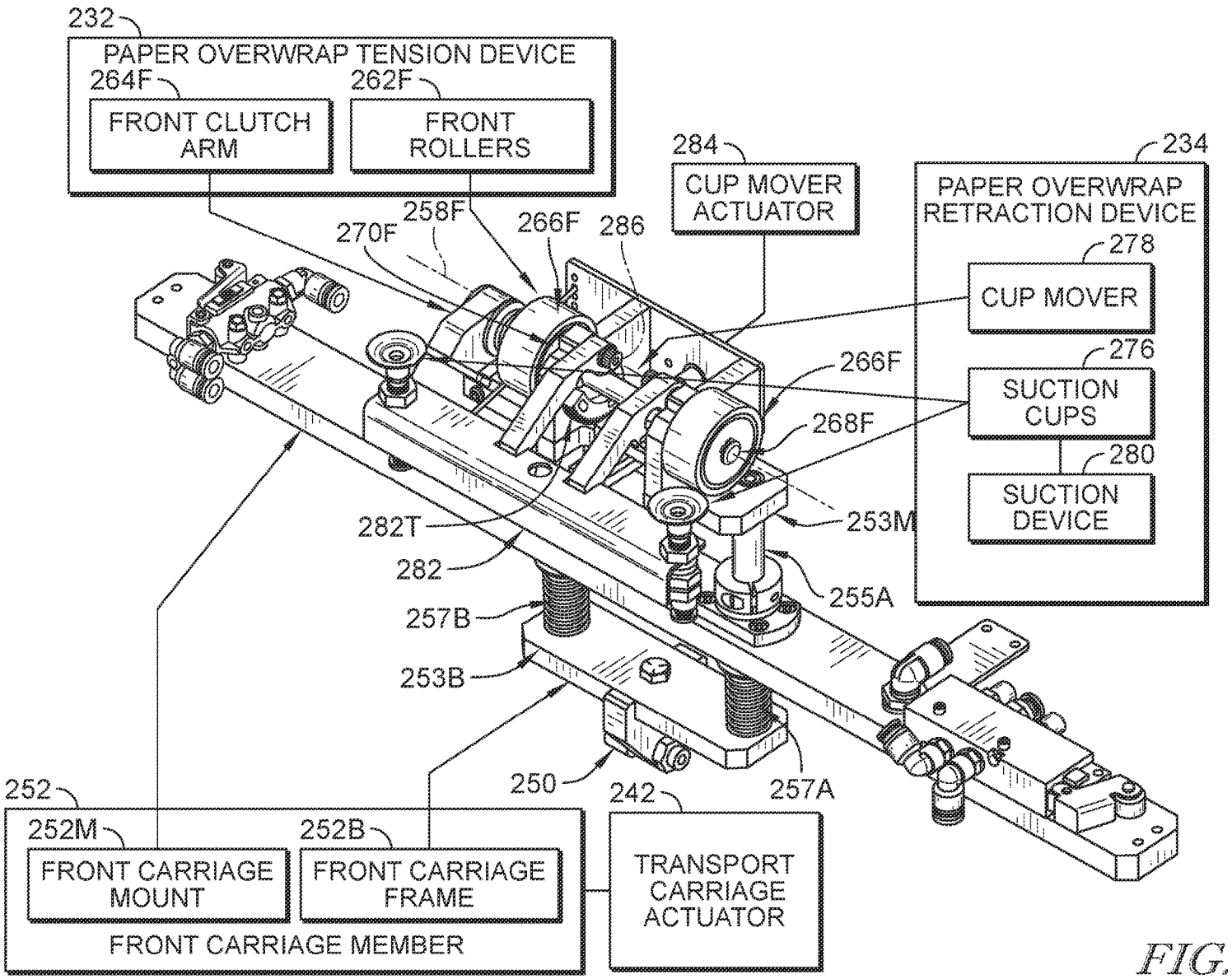
FIG. 25 is a rear perspective view of the front carriage member of the package transport carriage showing the front carriage member includes a front carriage mount configured to be coupled to the transport conveyor belts of the package transport conveyor and a front carriage frame mounted to the front carriage mount for vertical movement relative thereto.

The front carriage member 252 of the package transport carriage 240 includes a front carriage mount 252M and a front carriage frame 252B as shown in FIGS. 24 and 25. The front carriage mount 252M is configured to be coupled to the transport conveyor belts 244 of the package transport conveyor. Opposite ends of the front carriage mount 252M are each coupled to one of the transport conveyor belts 244. The front carriage frame 252B is mounted to the front carriage mount 252M for vertical movement relative thereto. In the illustrative embodiment, the cam follower 250 coupled to the front carriage frame 252B of the front carriage member 252.

The front carriage frame 252B includes a lower base 253B, an upper support member 253M, a pair of vertical guide rails 255A, 255B, and bias elements 257A, 257B as shown in FIGS. 22-29F. The lower base 253B is positioned vertically under the front carriage mount 252M, while the upper support member 253M is positioned vertically above the front carriage mount 252M. The vertical guide rails 255A, 255B extend vertically between the lower base 253B and the upper support member 253M through the front carriage mount 252M. The vertical guide rails 255A, 255B guide vertical movement of the front carriage frame 252B relative to the front carriage mount 252M. The bias elements 257A, 257B are positioned between the front carriage mount 252M and the lower base 253B to apply the bias force to the front carriage frame 252B to urge the front carriage frame 252B toward the lowered position. In the illustrative embodiment, the bias members 257A, 257B extend around the corresponding guide rail 255A, 255B.

Figure 26:
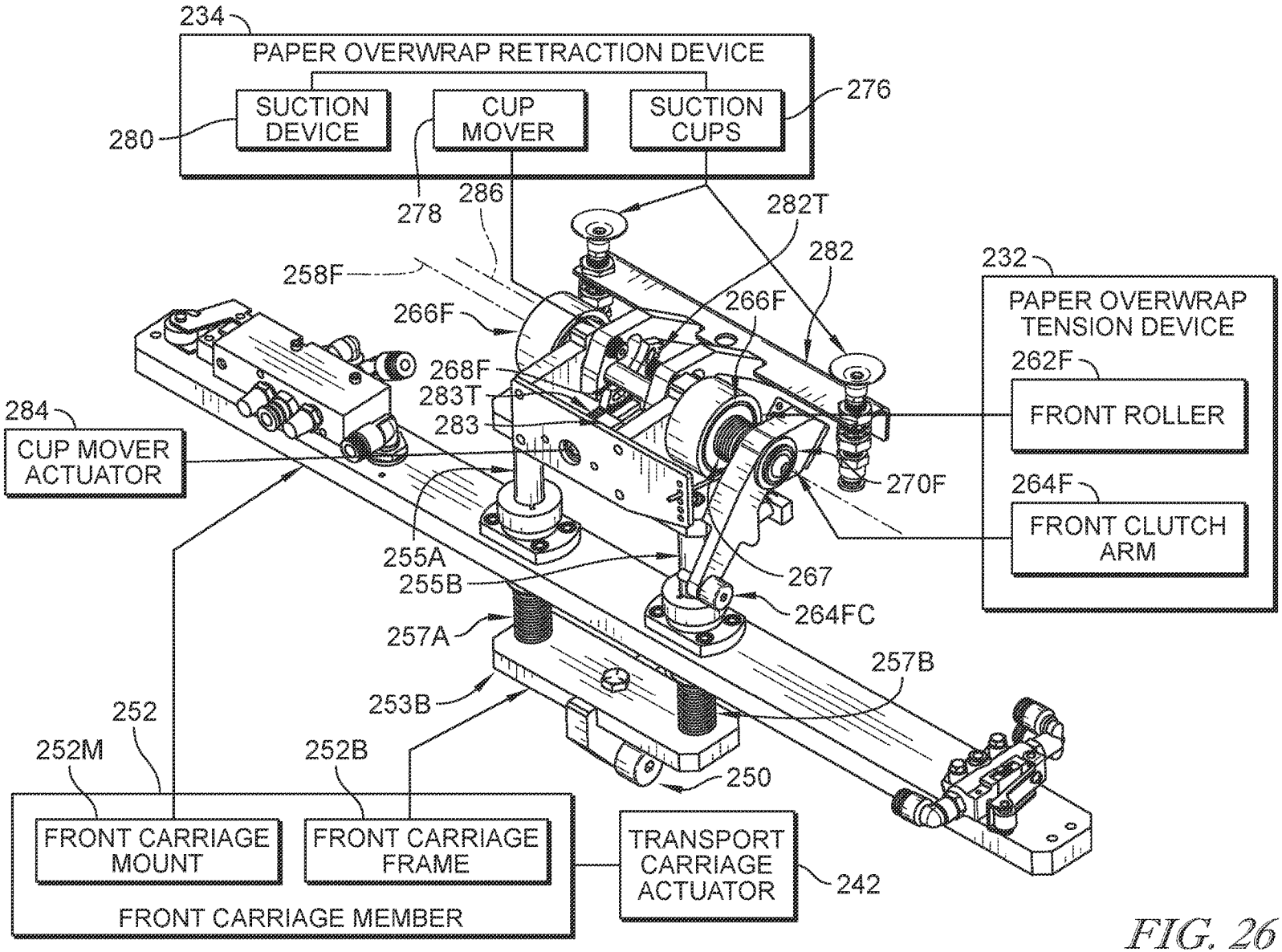
FIG. 26 is a front perspective view of the front carriage member of the package transport carriage in FIG. 25.
Figure 27:
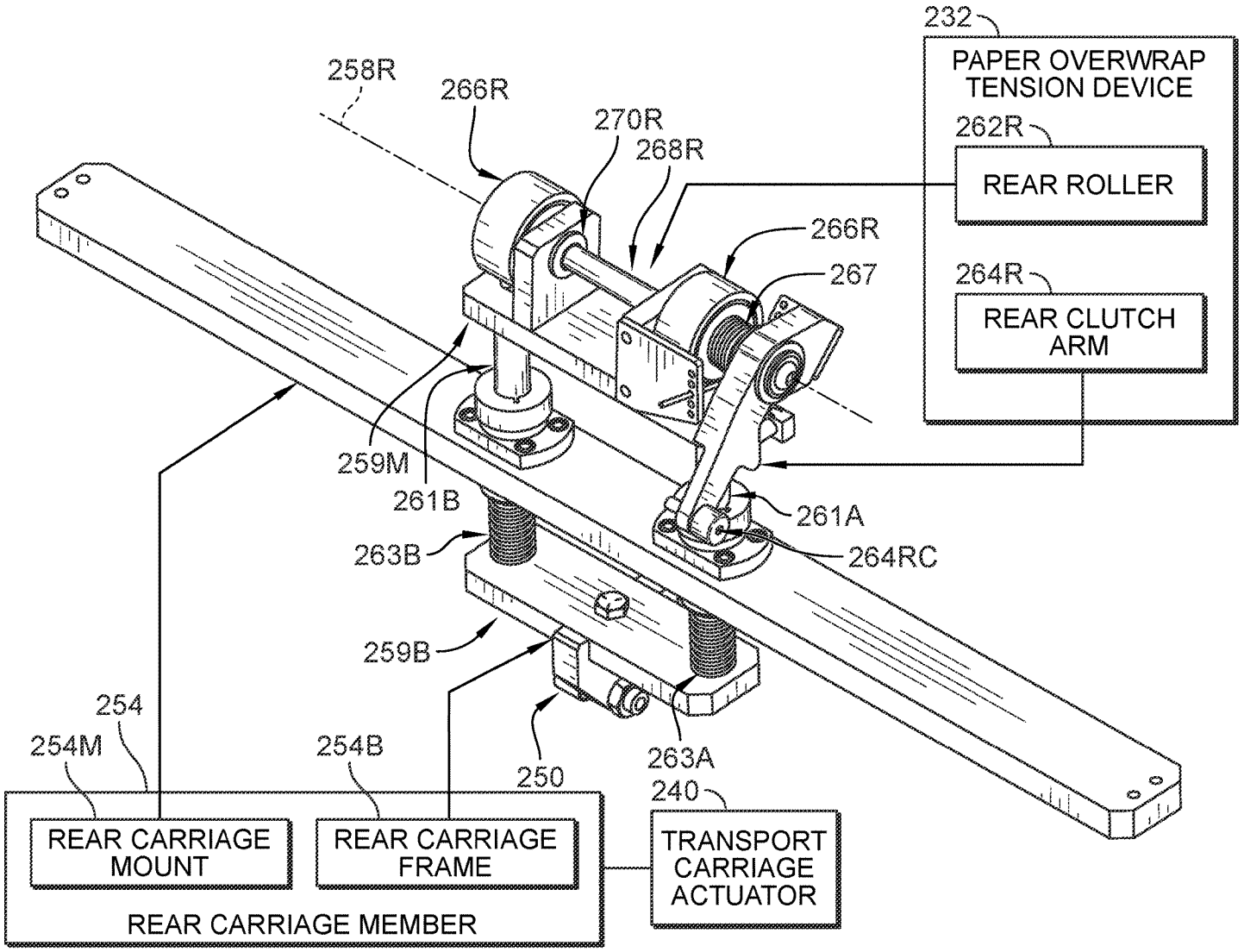
FIG. 27 is a rear perspective view of the rear carriage member of the package transport carriage showing the rear carriage member includes a rear carriage mount configured to be coupled to the transport conveyor belts of the package transport conveyor in spaced apart relation from the front carriage mount and a rear carriage frame mounted to the rear carriage mount for vertical movement relative thereto.
Figure 28:
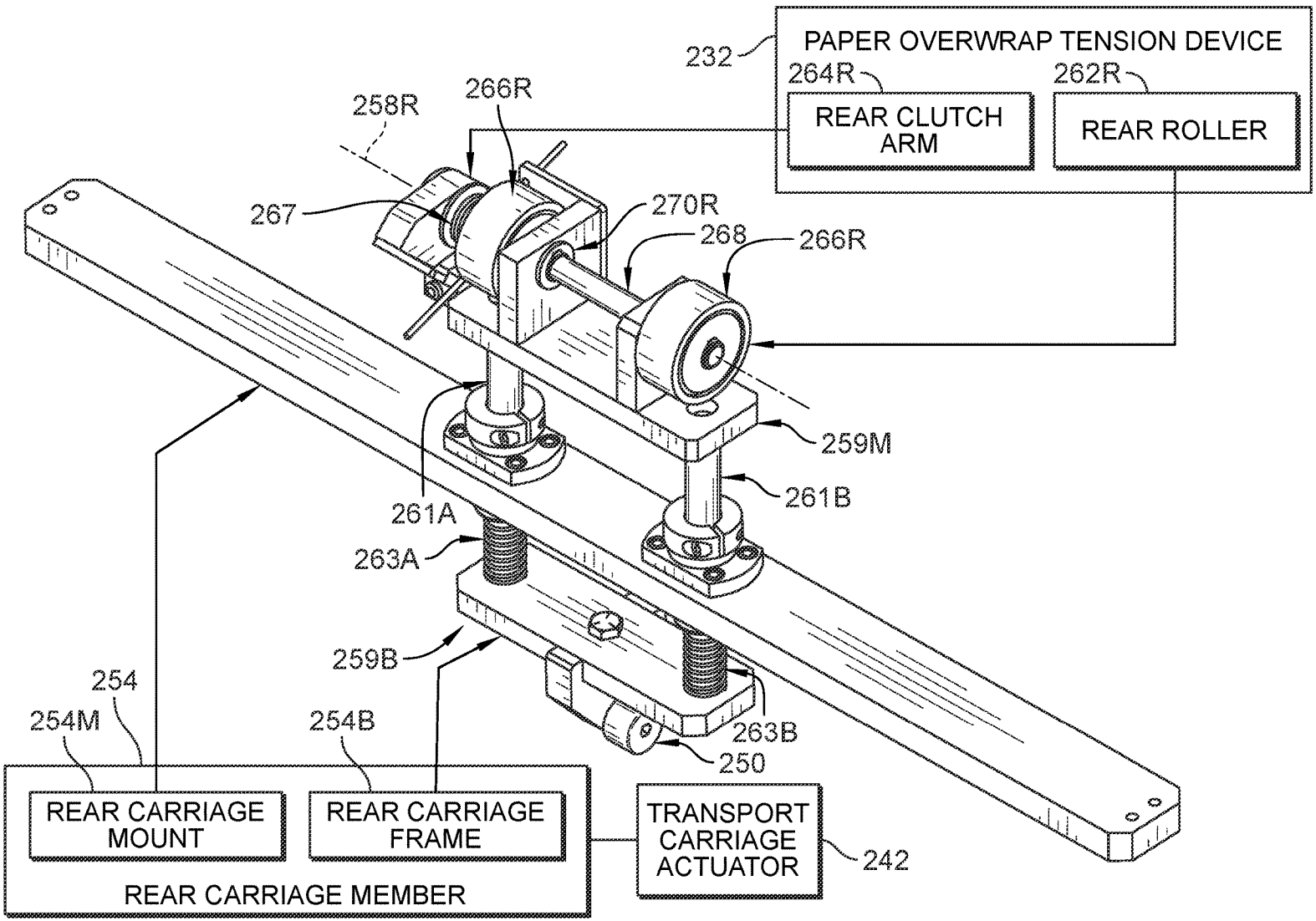
FIG. 28 is a front perspective view of the rear carriage member of the package transport carriage in FIG. 26.

The rear carriage member 254 of the package transport carriage 240 includes a rear carriage mount 254M and a rear carriage frame 254B as shown in FIGS. 26 and 27. The rear carriage mount 254M is configured to be coupled to the transport conveyor belts 244 of the package transport conveyor. Opposite ends of the rear carriage mount 254M are each coupled to one of the transport conveyor belts 244. The rear carriage frame 254B is mounted to the rear carriage mount 254M for vertical movement relative thereto. In the illustrative embodiment, the cam follower 250 coupled to the rear carriage mount 254M of the rear carriage member 254.

The rear carriage frame 254B includes a lower base 259B, an upper support member 259M, a pair of vertical guide rails 261A, 261B, and bias elements 263A, 263B as shown in FIGS. 22-29F. The lower base 259B is positioned vertically under the rear carriage mount 254M, while the upper support member 259M is positioned vertically above the rear carriage mount 254M. The vertical guide rails 261A, 261B extend vertically between the lower base 259B and the upper support member 259M through the rear carriage mount 254M. The vertical guide rails 261A, 261B guide vertical movement of the rear carriage frame 254B relative to the rear carriage mount 254M. The bias elements 263A, 263B are positioned between the rear carriage mount 254M and the lower base 259B to apply the bias force to the rear carriage frame 254B to urge the rear carriage frame 254B toward the lowered position. In the illustrative embodiment, the bias members 263A, 263B extend around the corresponding guide rail 261A, 261B.

In the illustrative embodiment, each paper overwrap tension device 232 is coupled to the front and rear upper support members 253M, 259M of the corresponding package transport carriage 240. In the illustrative embodiment, each paper overwrap retraction device 234 is coupled to the front upper support member 253M of the corresponding package transport carriage 240.

The adhesive application device 210 further includes paper overwrap tension controller means for pulling the free ends 12F, 12R of the paper overwrap 12 in opposed directions around the package 14 to tension the paper overwrap 12 around the package 14 as shown in FIGS. 13-29F. The paper overwrap tension controller means, or paper overwrap tension devices 232, pulls the free ends 12F, 12R of the paper overwrap 12 in opposed directions around the package 14 as or after the wrapped package 14 is lifted away from the conveyor 22 to tension the paper overwrap 12 around the package 14 before the adhesive is applied to the bottom side 14B of the package 14 to keep the paper overwrap 12 taut around the bottom, top, front, and rear sides 14B, 14T, 14F, 14R of the package 14. The paper overwrap 12 is kept taut around the package 14 as the adhesive is applied to the bottom side 14B of the package 14 so that the paper overwrap 12 remains taut once the seam 12S is sealed to hold the plurality of goods 18 in place in the cavity 16C of the tray 16 once the adhesive has been applied to fix the paper overwrap 12 in place on the package 14.

Each paper overwrap tension device 232 comprises a front roller 262F mounted to a corresponding front carriage member 252 of the package transport carriage 240, a rear roller 262R mounted to the corresponding rear carriage member 254 of the package transport carriage 240 as shown in FIGS. 22-29F. The front roller 262F is configured to rotate about a front roller axis 258F. The rear roller 262R is configured to rotate about a rear roller axis 258R in spaced apart relation to the pair of front rollers 262F as shown in FIGS. 22-29F.

In the illustrative embodiment, the front roller 262F is mounted to the front upper support member 253M of the front carriage frame 252B for rotation about the front roller axis 258F. In the illustrative embodiment, the rear roller 262R is mounted to the rear upper support member 259M of the rear carriage frame 254B for rotation about the rear roller axis 258R.

The paper overwrap tension device 232 further comprises front clutch means for rotating the pair of front rollers 262F in an upstream direction U around a front roller axis 258F to cause the pair of front rollers 262F to pull one of the free ends 12F in a first direction and rear clutch means for rotating the pair of rear rollers 262R in an downstream direction D around the rear roller axis 258R to cause the pair of rear rollers 262R to pull the other of the free ends 12R in a second direction opposite the first direction. The front clutch means and rear clutch means are activated independently in the illustrative embodiment.

In the illustrative embodiment, the front clutch means and the rear clutch means each include a clutch arm 264F, 264R that engages a cam surface 265S of a linear cam 265 coupled to the stationary support frame 220 as shown in FIGS. 22-29F. Each clutch arm 264F, 264R is coupled to the corresponding roller 262F, 262R for rotation therewith and is biased toward a first position by a bias element 267. The bias element 267 extends between the corresponding carriage member 252, 254 and the respective roller 262F, 262R coupled to the clutch arm 264F, 264R to apply the bias force to the clutch arm 264F, 264R. In the illustrative embodiment, the bias element 267 extends around the shaft 268F, 268R of the respective roller 262F, 262R.

Each clutch arm 264F, 264R provides a cam follower 264FC, 264RC that engages the cam surface 265S on the linear cam 265. As the clutch arm 264F, 264R follows the cam surface 265S of the linear cam 265, the engagement of the clutch arm 264F, 264R overcomes the bias force applied by the bias element 267 to cause the clutch arm 264F, 264R to rotate to a second position thereby rotating the respective roller 262F, 262R about the corresponding roller axis 258F, 258R.

In some embodiments, the front and rear clutch means is a clutch arm and a pneumatic actuator configured to rotate the clutch arm to cause the corresponding rollers 262F, 262R to rotate partway about the corresponding axis 258F, 258R. In some embodiments, the front and rear clutch means may be another suitable actuator to cause the front and rear rollers 262F, 262R to rotate. In some embodiments, the front and rear clutch means is another suitable actuator that causes the rollers 262F, 262R to rotate.

The front roller 262F and the rear roller 262R each include a pair of roller wheels 266F, 266R and a shaft 268F, 268R as shown in FIGS. 10-12. The roller wheels 266F, 266R are coupled to either ends of the corresponding shaft 268F, 268R for rotation therewith. The shaft 268F, 268R is supported by the corresponding carriage frame 252B, 254B for rotation about the roller axis 258F, 258R. In the illustrative embodiment, each clutch arm 264F, 264R is coupled to the corresponding shaft 268F, 268R of the associated roller 262F, 262R for rotation therewith to drive rotation of the rollers 262F, 262R.

In some embodiments, the front and rear rollers 262F, 262R may include bearings 270F, 270R as shown in FIGS. 24-28. The bearings 270F, 270R may support either end of the corresponding shaft 268F, 268R for rotation about the roller axis 258F, 258R. The bearings 270F, 270R may be coupled to the corresponding carriage frame 252B, 254B.

In some embodiments, the front and rear rollers 262F, 262R may include a single bearing. In some embodiments, one bearing 270F, 270R may be coupled to the respective clutch arm 264F, 264R.

The adhesive application device 210 further includes paper overwrap retraction means for moving a first free end 12F of the paper overwrap 12 in a first direction away from the bottom side 14B of the package 14 after the paper overwrap 12 is tensioned around the package 14 to uncover a portion of the bottom side 14B of the package 14 and the second free end 12R of the paper overwrap 12 and for moving the first free end 12F of the paper overwrap 12 in a second direction opposite the first direction toward the bottom side 14B of the package 14 after the adhesive is applied as shown in FIGS. 13-29F. The paper overwrap retraction means, or the paper overwrap retraction device 234, moves the first free end 12F of the paper overwrap 12 in the first direction so that the adhesive can be applied to the portion of the bottom side 14B of the package 14 and the second free end 12R. Then the paper overwrap retraction device 234 moves the first free end 12F of the paper overwrap 12 in the second direction opposite the first direction back toward the bottom side 14B of the package 14 after the adhesive is applied to seal the first free end 12F with the bottom side 14B of the package 14 and the second free end 12R thereby sealing the seam 12S and fixing the paper overwrap 12 in place on the package 14.

The paper overwrap retraction device comprises a pair of suction cups 276, a cup mover 278, and a suction device 280 as shown in FIGS. 22-29F. The pair of suction cups 276 are pivotably coupled to a corresponding package transport carriage 240 to pivot in the first direction away from the bottom side 14B of the package 14 and in the second direction opposite the first direction toward the bottom side of the package. The cup mover 278 is coupled to the pair of suction cups 276 and configured to pivot the suction cups in the first direction and the second direction. The suction device 280 is coupled to the pair of suction cups 276 and configured to apply a suction or vacuum force to the first free end 12F of the paper overwrap 12 through the pair of suction cups 276 to cause the first free end 12F of the paper overwrap 12 to be fixed to the pair of suction cups 276 so that the first free end 12F of the paper overwrap 12 moves with the pair of suction cups 276 in the first and second directions.

The cup mover 278 includes a suction cup mount 282, a mount rack 283, and an actuator 284 as shown in FIGS. 24-29F. The suction cups 276 are coupled to the suction cup mount 282 in spaced apart relation to each other. The suction cup mount 282 is pivotably coupled to the front carriage frame 252B to pivot between an engaged position as shown in FIGS. 29C and 29E and a retracted position as shown in FIGS. 29A, 29B, 29D, and 29F. The suction cup mount 282 is configured to pivot about a mover axis 286 relative to the package transport carriage 240 in the first and second directions with the suction cups 276. The suction cup mount 282 is formed with a portion of a pinon gear having gear teeth 282T that mate with corresponding teeth 283T on the mount rack 283 to form a rack and pinon actuator. The mount rack 283 is mounted to the upper support member 253M to be able to slide relative to the upper support member 253 and thereby drive pivoting motion of the suction cup mount 282. The actuator 284 is coupled to the mount rack 283 to linearly slide the mount rack 283 out and in, which causes the suction cup mount 282 to pivot relative to the package transport carriage 240 between the engaged and retracted positions.

In the illustrative embodiment, the actuator 284 is a linear actuator configured to move between an extended actuator position and a retracted position. In some embodiments, the actuator 284 is a pneumatic linear actuator. In some embodiments, another suitable actuator or drive system may be used.

Figure 29A:
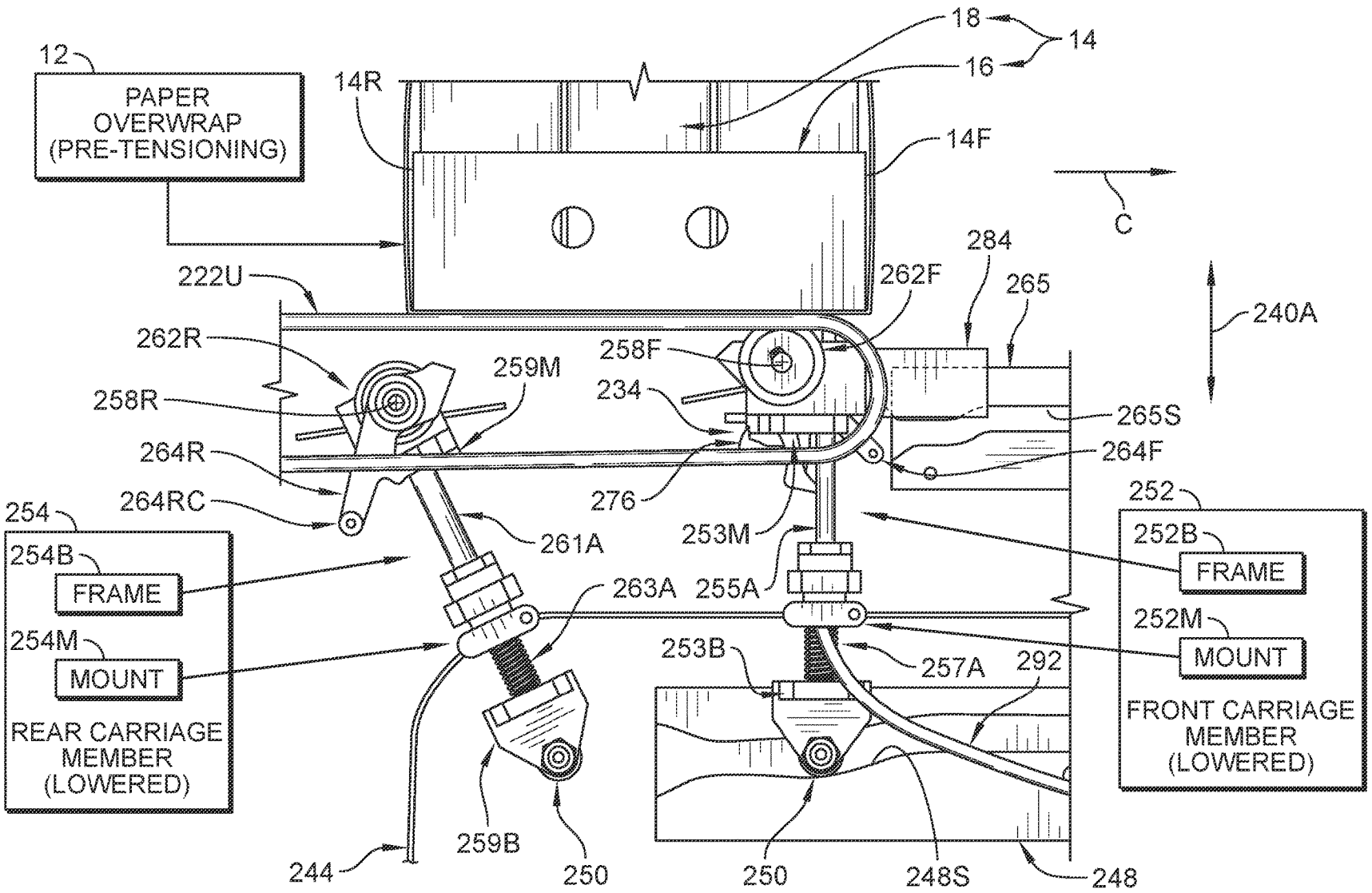
FIG. 29A is a side view similar to FIG. 22 showing one of the package transport carriages of the device is in the pre-adhesive stage in which the wrapped package remains resting on the main conveyor as the package transport conveyor moves the respective package transport carriages into position below the wrapped package so as to be able to vertically lift the package up off the main conveyor as shown in FIGS. 29B and 29C.
Figure 29B:
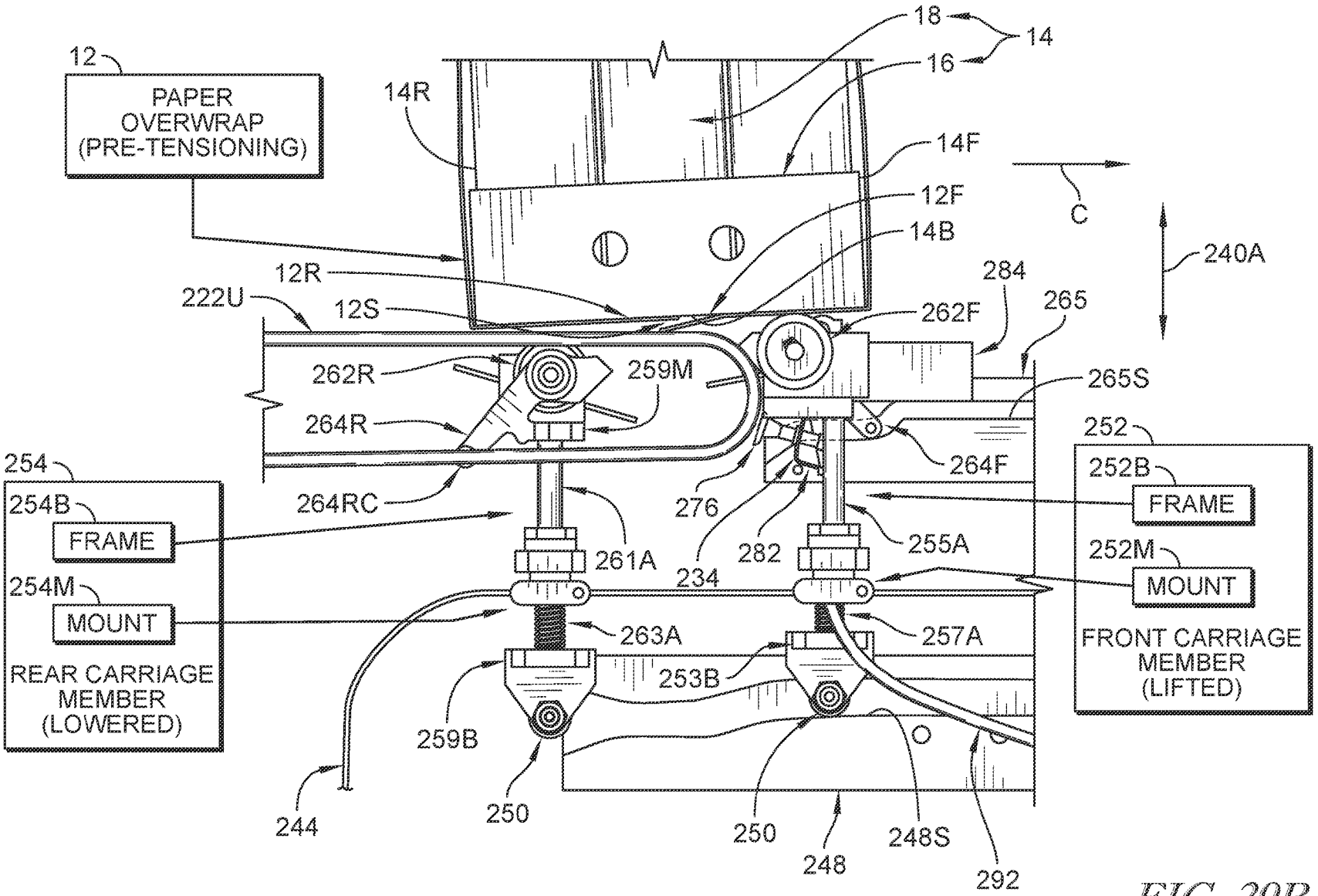
FIG. 29B is a view similar to FIG. 29A showing one of the package transport carriages of the device has moved in the conveyor direction to the lifting and tensioning stage in which the transport carriage actuator has caused the front carriage member to move from the lowered position to a lifted position to lift the first end of the wrapped package away from the main conveyor before the front clutch arm engages the linear cam to tension the paper overwrap.
Figure 29C:
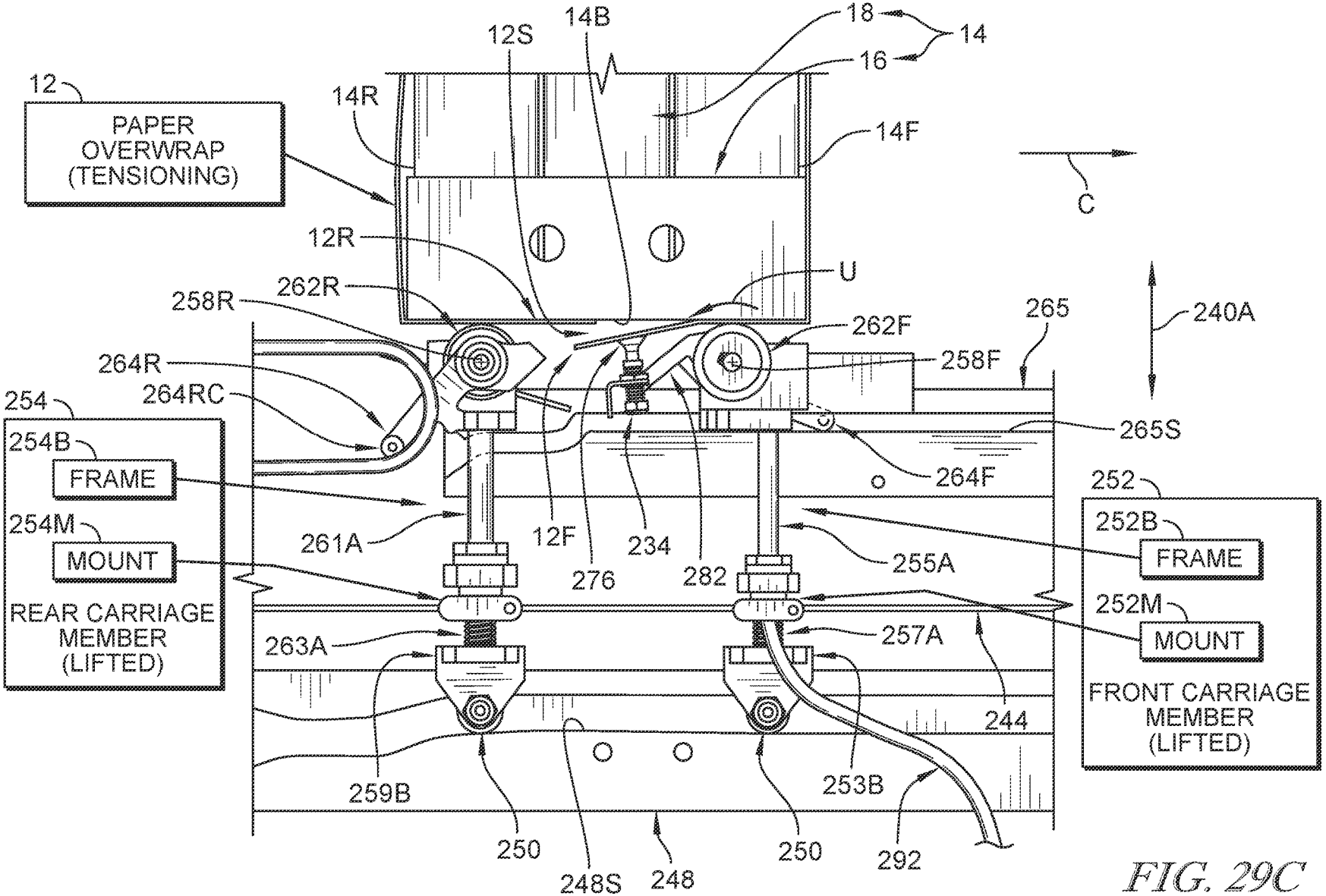
FIG. 29C is a view similar to FIG. 29B showing one of the package transport carriages of the device has continued to move in the conveyor direction to cause the front clutch arm to follow the cam surface of the linear cam thus causing the front clutch arm to rotate partway about the front roller axis in an upstream direction to tension one end of the paper overwrap around the package, showing the cup mover actuator has moved from the retracted position to the extended position to cause the cup mount to move from the retracted position as shown in FIG. 29B to the engaged position to engage the first free end of the paper overwrap with the suction force so that the first free end may be moved away from the bottom of the wrapped package to expose the bottom side of the package and the second free end of the paper overwrap so that the adhesive may be applied as shown in FIG. 29D, and further showing the transport carriage actuator has caused the rear carriage member to move from the lowered position to a lifted position to lift the other end of the wrapped package away from the main conveyor before the rear clutch arm engages the linear cam to tension the paper overwrap.
Figure 29D:
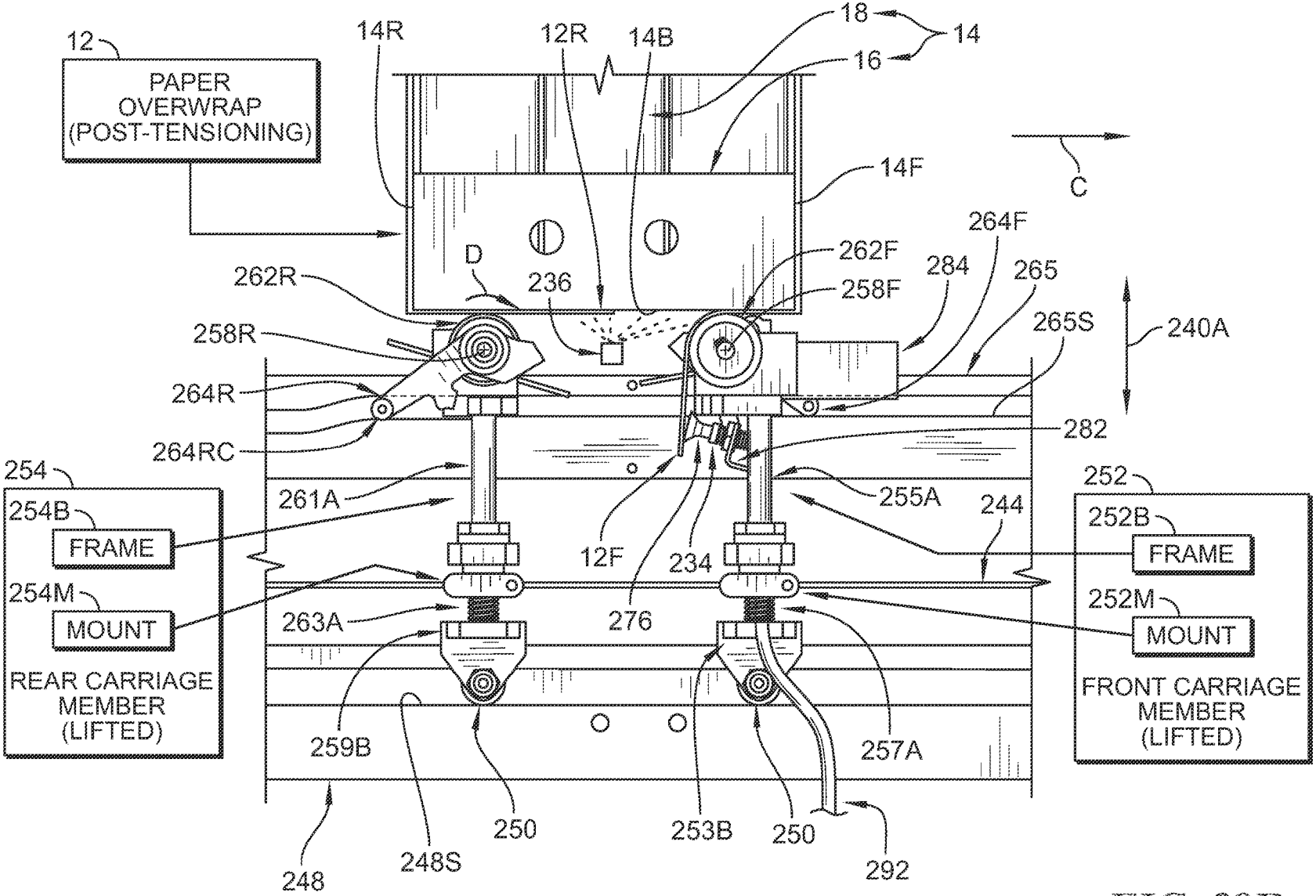
FIG. 29D is a view similar to FIG. 29C showing one of the package transport carriages of the device has continued to move in the conveyor direction to cause the rear clutch arm to follow the cam surface of the linear cam thus causing the rear clutch arm to rotate the rear roller partway about the rear roller axis in the downstream direction to tension the other end of the paper overwrap around the package so that the package transport carriage is in the suction stage in which the front and rear clutch arms keep the paper overwrap tensioned around the package as the cup mover actuator has moved from the extended position to the retracted position to cause the cup mount to move from the engaged position to the retracted position to pull the first free end of the paper overwrap away from the bottom side of the wrapped package so that the adhesive may be applied by the adhesive applicators.
Figure 29E:
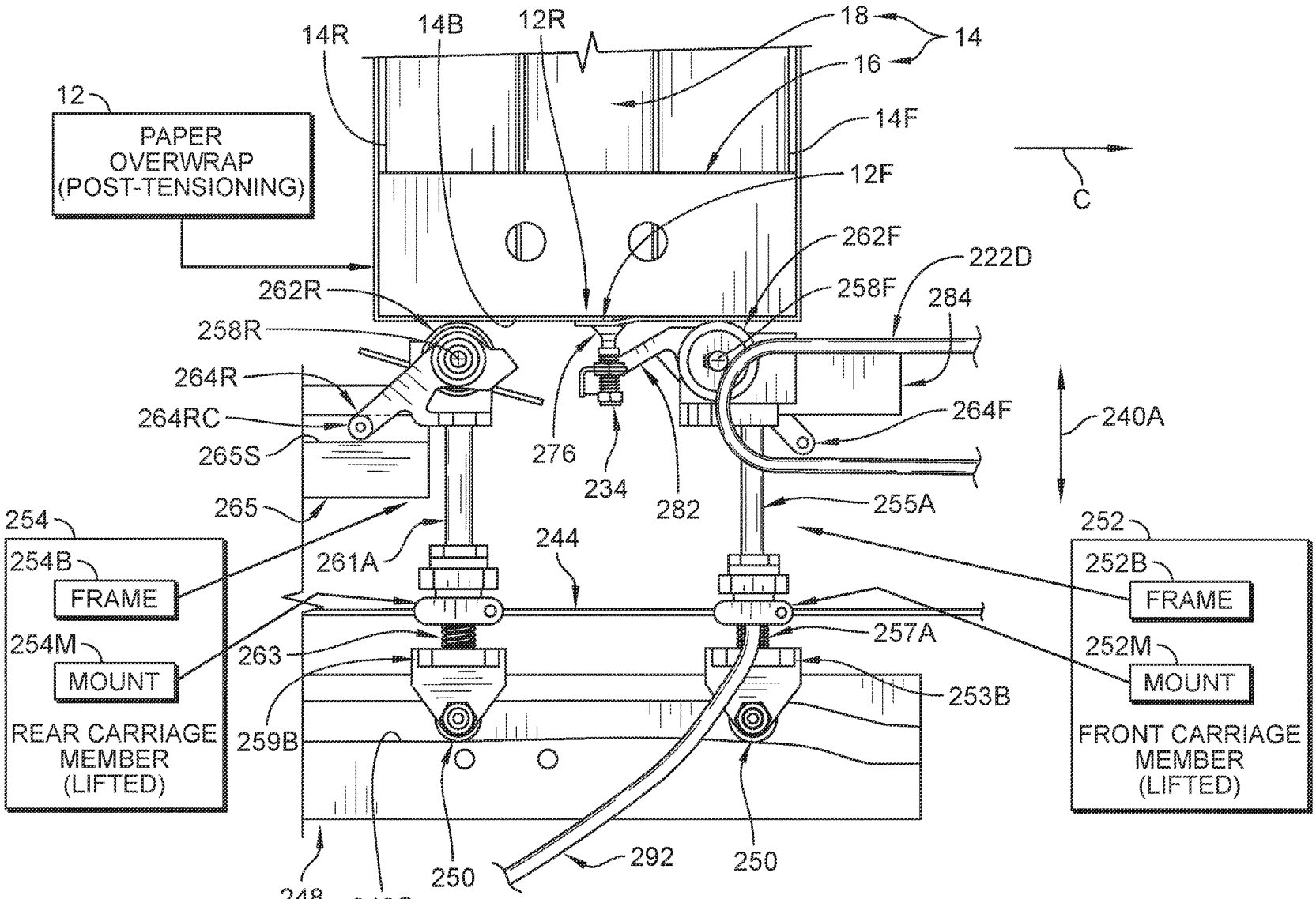
FIG. 29E is a view similar to FIG. 29D showing the cup mover actuator has moved from the retracted position to the extended position to cause the cup mount to move from the retracted position to the engaged position to engage the first free end with the adhesive applied by the adhesive applicator to the bottom side of the package and the second free end of the paper overwrap so as to seal the seam of the paper overwrap after the adhesive was applied in the adhesive application stage.
Figure 29F:
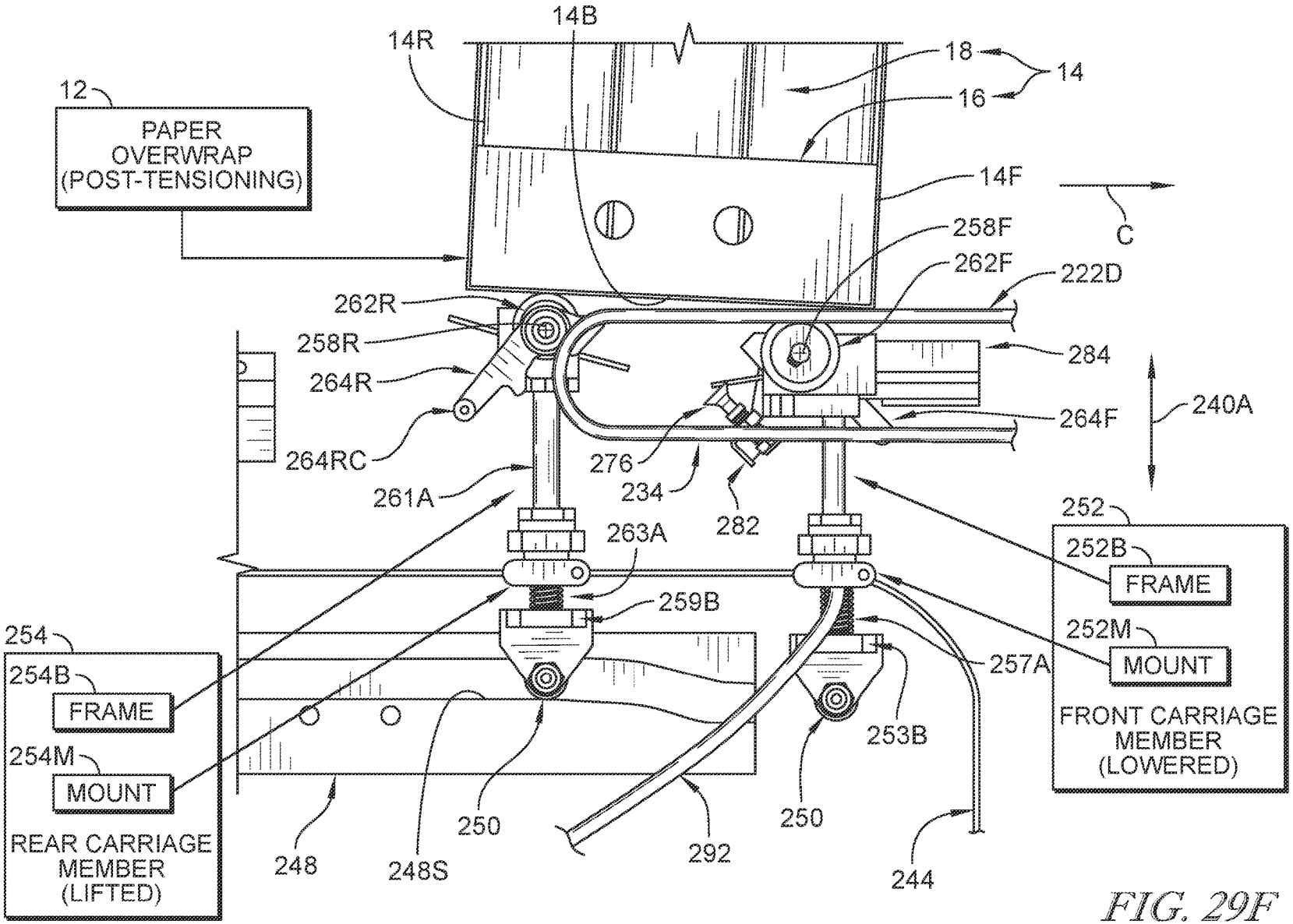
FIG. 29F is a view similar to FIG. 29E showing one of the package transport carriages of the device has continued to move in the conveyor direction to the lowering stage in which the transport carriage actuator has caused the front carriage member to lower the first end of the wrapped package toward the main conveyor to being lowering the wrapped package back onto the main conveyor.

The actuator 284 is in the extended position to cause the suction cup mount 282 to be in the engaged position in which the suction cup mount 282 is relatively parallel with the bottom side 14B of the wrapped package 14 so that the suction cups 276 engage the bottom side 14B of the wrapped package 14 as shown in FIGS. 29C and 29E. The actuator 284 is in the retracted position to cause the suction cup mount 282 to be in the retracted position in which the suction cup mount 282 is angled relative to the bottom side 14B of the wrapped package 14 so that the suction cups 276 are spaced apart from the bottom side 14B of the wrapped package 14 as shown in FIG. 29D.

The actuator 284 moves from the extended actuator position to the retracted actuator position to cause the mount rack 283 to slide in the conveyor direction C and thereby drive pivoting movement of the suction cup mount 282 from the engaged position to the retracted position so that a portion of the bottom side 14B of the package 14 and the second free end 12R of the paper overwrap 12 are uncovered to be able to apply the adhesive as shown in FIGS. 29C and 29D. The actuator 284 moves from the retracted actuator position to the extended actuator position to cause the mount rack 283 to slide in an opposite direction of the conveyor direction C and thereby drive pivoting movement of the suction cup mount 82 from the retracted position to the engaged position so that the first free end 12F is engaged with the adhesive on the portion of the bottom side 14B of the package 14 and the second free end 12R of the paper overwrap 12 to fix the paper overwrap 12 in place on the package 14 as shown in FIGS. 29D and 29E.

Figure 17:
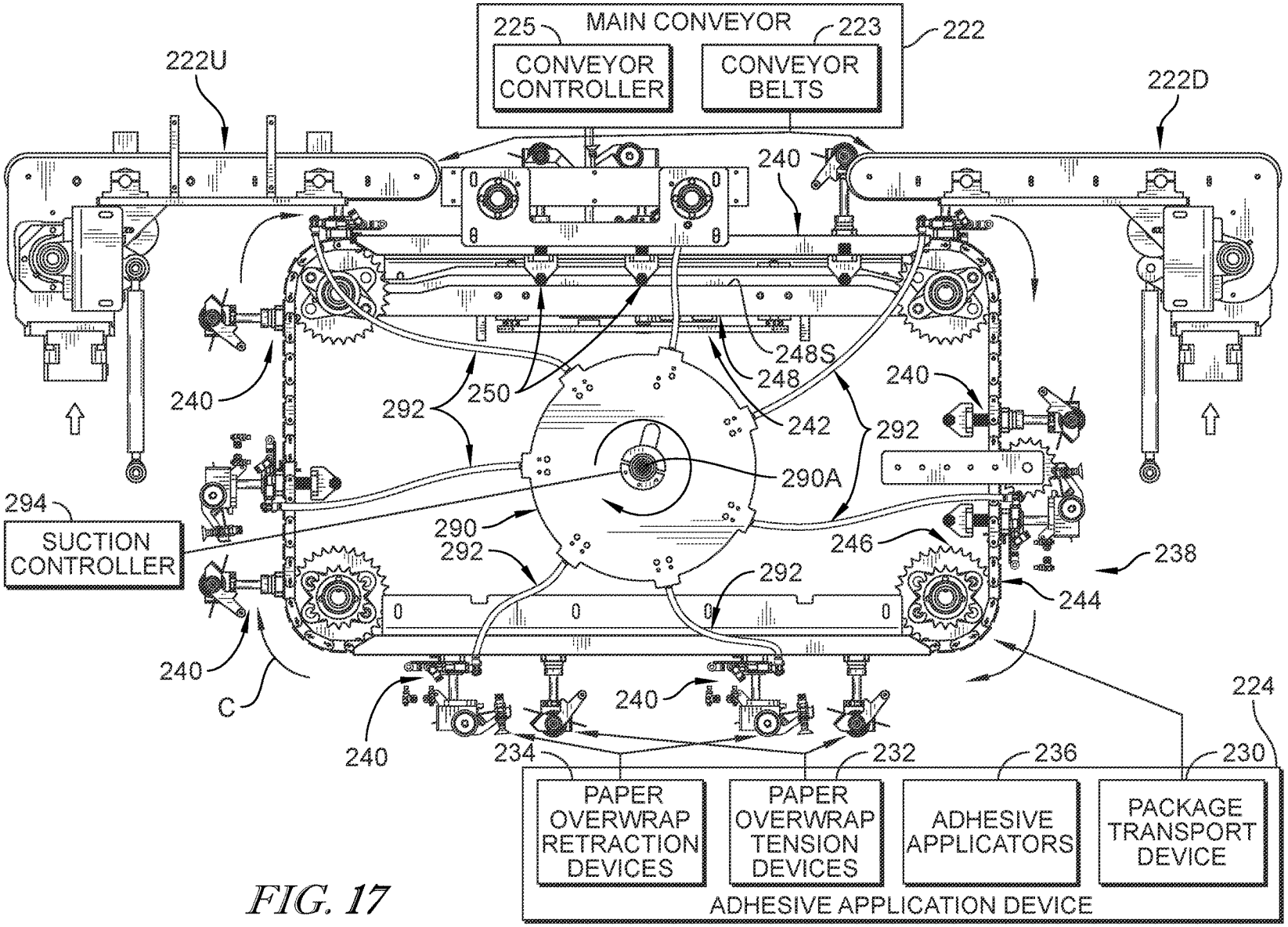
FIG. 17 is a side view of the device in FIG. 16 showing the package transport device includes a package transport conveyor configured to continuously cycle in the conveyor direction, a plurality of package transport carriages coupled to the package transport conveyor for movement therewith and configured to move vertically along a vertical axis, and a transport carriage actuator that selectively engages each of the package transport carriages to cause the plurality of package transport carriages to move vertically as the package transport carriages move in the conveyor direction.
Figure 20:
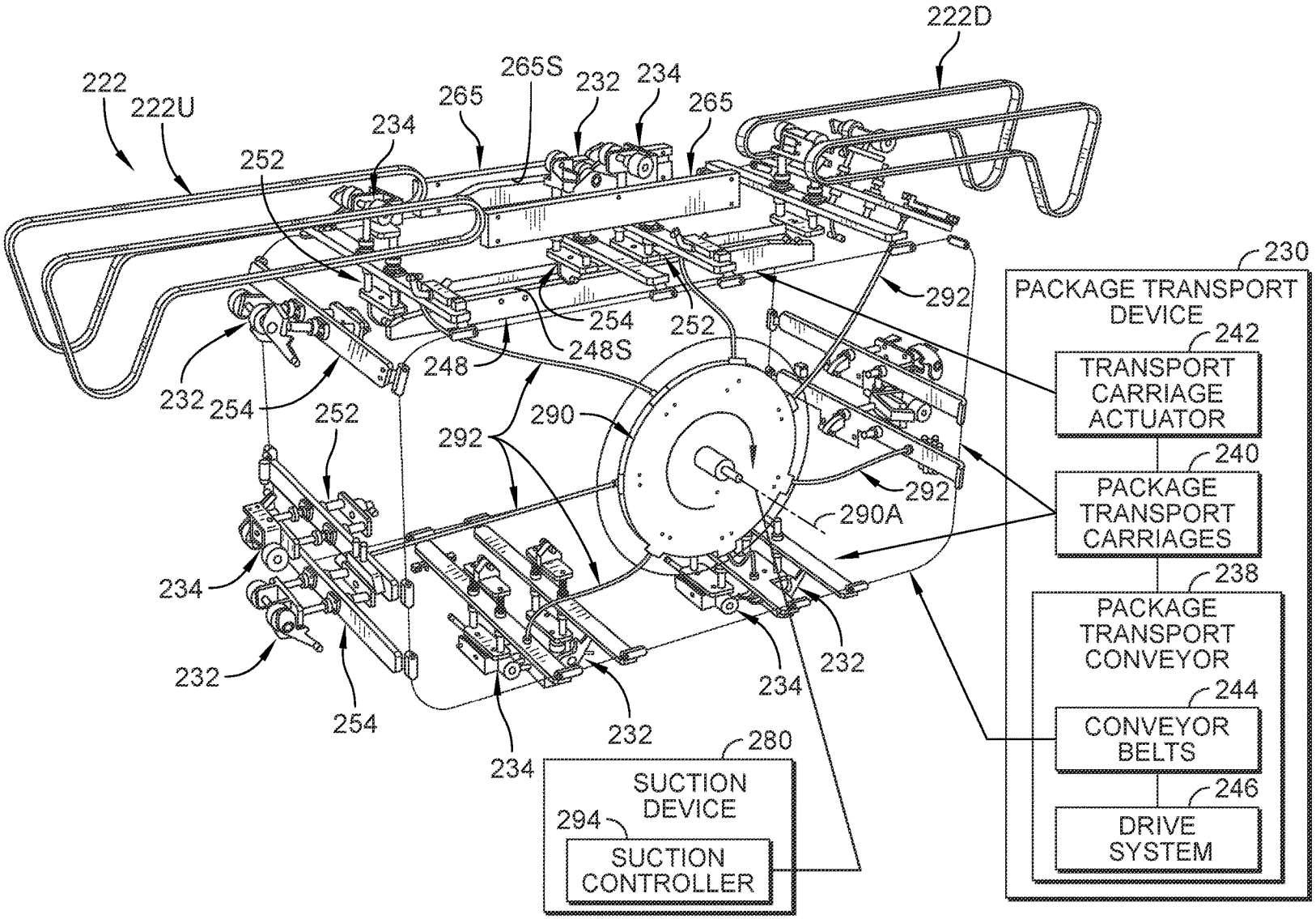
FIG. 20 is a view similar to FIG. 17 showing the package transport device includes the package transport conveyor, the plurality of package transport carriages, and the transport carriage actuator.
Figure 21:
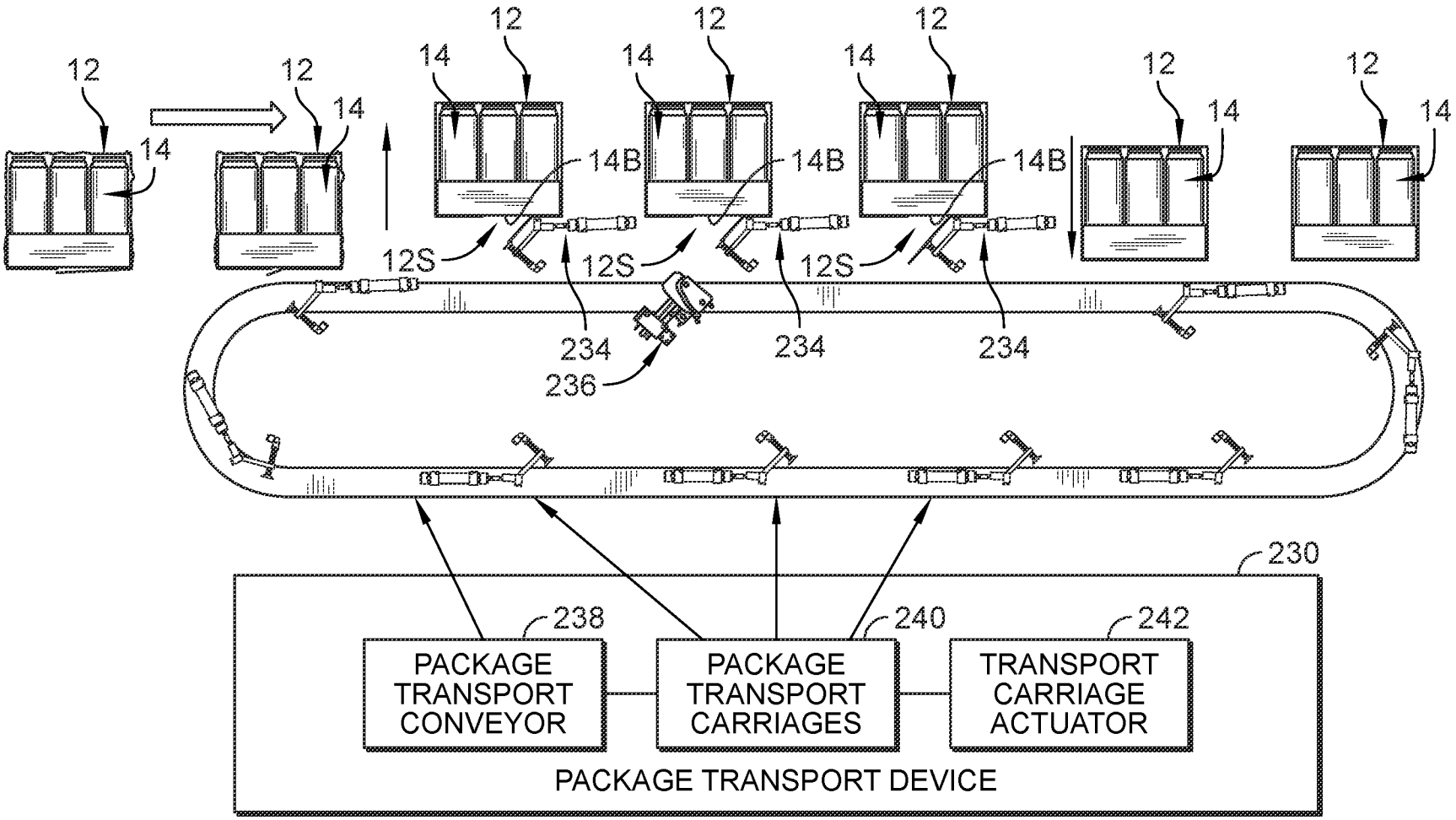
FIG. 21 is a side view of the device of FIG. 13 showing the package transport conveyor, the plurality of package transport carriages with the corresponding paper overwrap retraction devices coupled therewith, and the transport carriage actuator of the package transport device.
Figure 22:
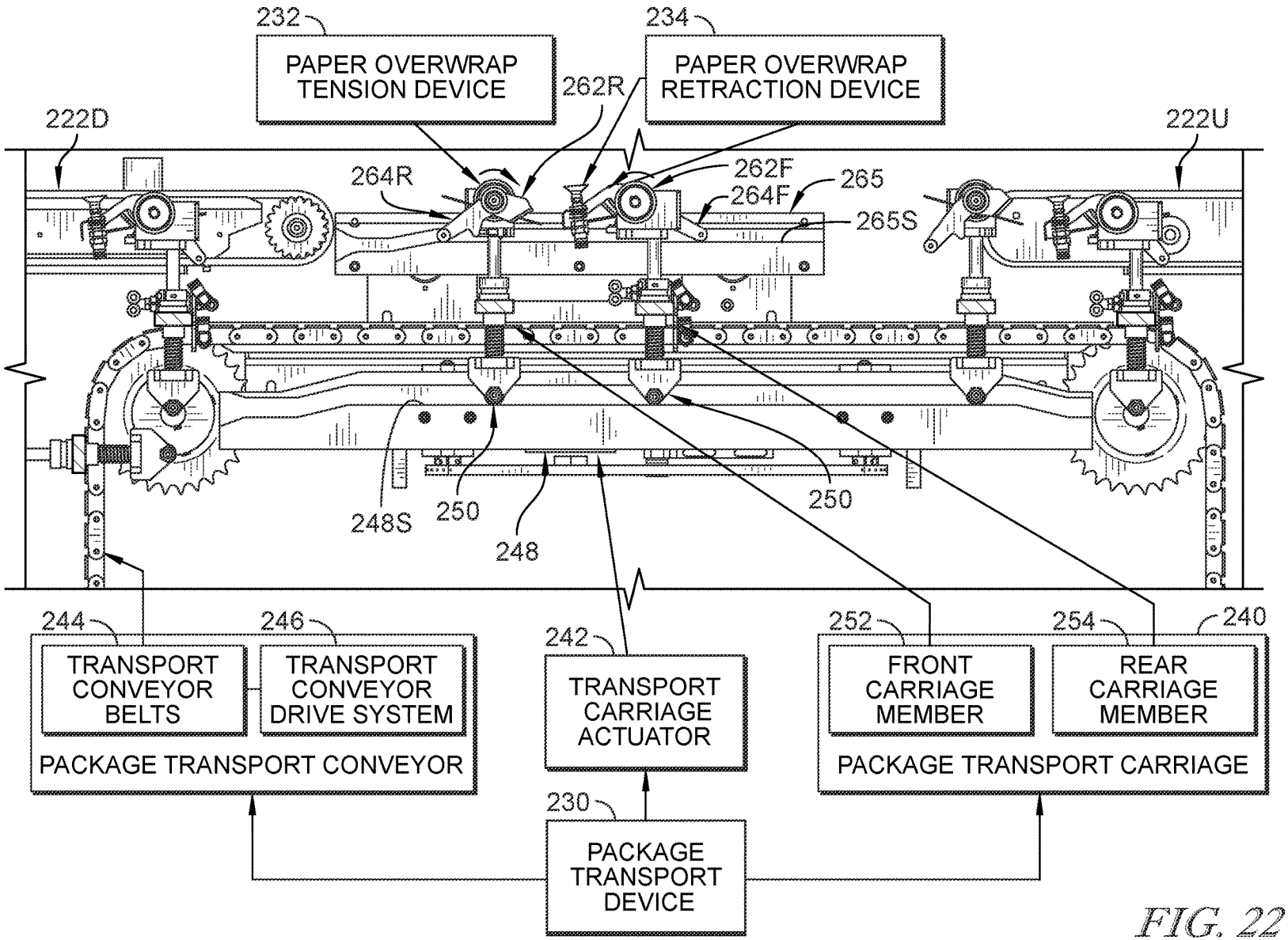
FIG. 22 is side view of the device of FIG. 13 showing the package transport conveyor includes transport conveyor belts and a transport conveyor drive system, showing each package transport carriage on the package transport conveyor includes a front carriage member and a rear carriage member, and showing one of the paper overwrap tension devices and one of the paper overwrap retraction devices is coupled to each of the package transport carriage.
Figure 23:
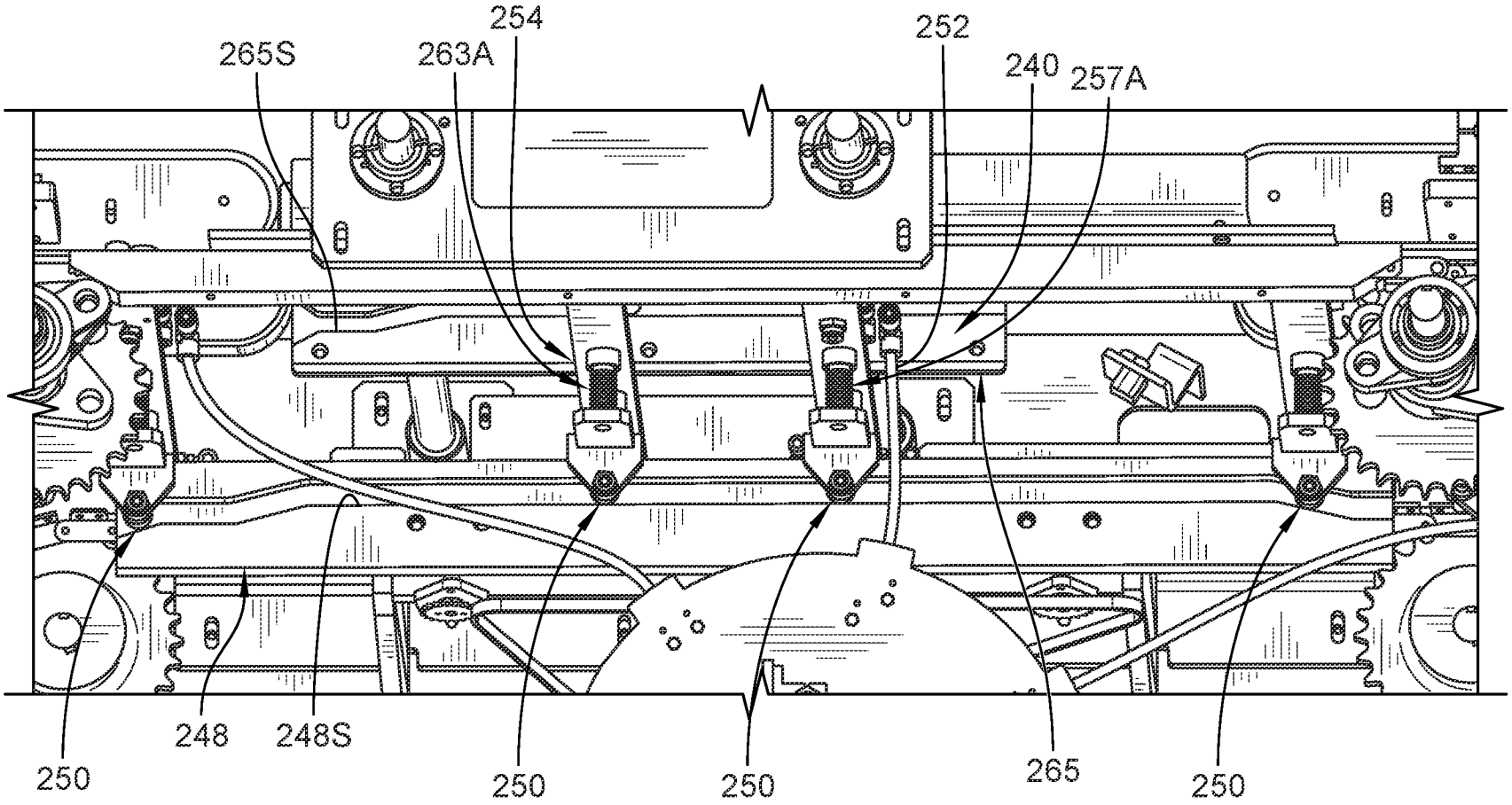
FIG. 23 is side view similar to FIG. 22 showing the transport carriage actor engaging the package transport carriages to drive vertical movement of the package transport carriages.

The suction device 280 includes a center manifold 290, a plurality of hoses 292, and a suction controller 294 as shown in FIGS. 17 and 20. The center manifold 290 is configured to rotate about a center axis 290A. The center manifold 290 defines a plurality of inlet ports and one outlet port in fluid communication with the plurality of inlet ports. The plurality of hoses 292 are coupled to the inlet ports, while the suction controller 294 is coupled to the outlet port to be in fluid communication with the plurality of inlet ports. The suction controller 294 may be a pneumatic pump or another suitable vacuum pump configured to apply the suction force. In the illustrative embodiments, the suction cups 276 may have additional hosing and valves to couple the suction cups 276 in fluid communication with the suction device 280.

Each inlet port is in fluid communication with the suction cups 276 on the corresponding paper overwrap retraction device 234 on the associated package transport carriage 240. The suction controller 294 is configured to apply the suction force through the different suction cups 276. As the plurality of inlet ports are all in fluid communication with the outlet port, when the suction controller 294 applies the suction force, suction occurs at each of the inlet ports such that suction is felt at each and every suction cup 276.

In the illustrative embodiment, the suction controller 294 applies suction continuously and the cup mover 278 of each paper overwrap retraction device 234 controls when suction is applied to fix the first free end 12F with the suction cups 276 by changing between the extended and retracted positions. In some embodiments, the suction controller 294 may be configured to control when the suction force is applied through the different suction cups 276. In some embodiments, the suction device 280 may have valves to control through which hose 292 is applied.

As the different package transport carriages 240 rotated around the center axis 294 in the conveyor direction C, the center manifold 290 rotates therewith so that the associated hoses 292 move along with the package transport carriage 240. When each of the package transport carriages 240 moves into the suction stage, the associated cup mover 278 of the corresponding paper overwrap retraction device 234 moves from the retracted position to the extended position to engaged the first free end 12F of the paper overwrap 12 to fix the first free end 12F with the associated suction cups 276. The other cup moves 278 remain in the retracted position, until the respective paper overwrap retraction device 234 is in the suction stage.

Figure 15:
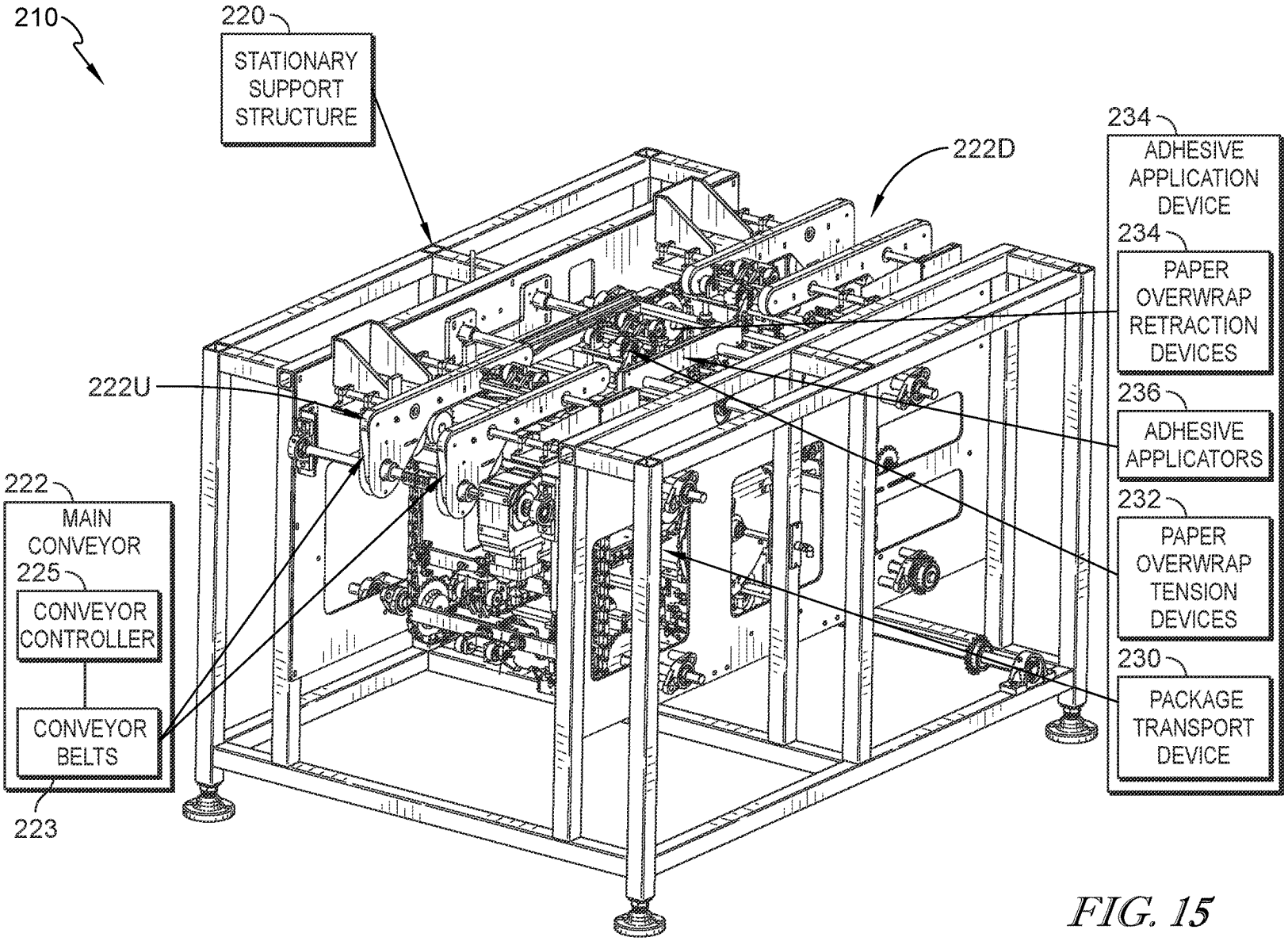
FIG. 15 is a perspective view of the device of FIG. 1 with a portion of the support frame broken away to show the conveyor includes a pair of conveyor belts and a conveyor controller configured to drive movement of the conveyor belts in the conveyor direction, and further showing the adhesive application device of the device includes a package transport device configured to lift and lower the wrapped package relative to the conveyor along a vertical axis perpendicular to the conveyor as the wrapped package continues to move in the conveyor direction to temporarily expose the free ends of the paper overwrap on a bottom side of the package as shown in FIGS. 18 and 19, a plurality of paper overwrap tension devices coupled to the package transport device and configured to pull the free ends of the paper overwrap in opposed directions around the package as the package is lifted away from the conveyor to tension the paper overwrap around the package before the adhesive is applied to the bottom side of the package as shown in FIGS. 18 and 19, and a plurality of paper overwrap retraction devices coupled to the package transport device and configured to pivot a first free end of the paper overwrap in away from the bottom side of the package after the paper overwrap is tensioned around the package to uncover a portion of the bottom side of the package and the second free end of the paper overwrap so that the adhesive may be applied before the package is lowered back onto the conveyor as shown in FIGS. 18 and 19.
Figure 16:
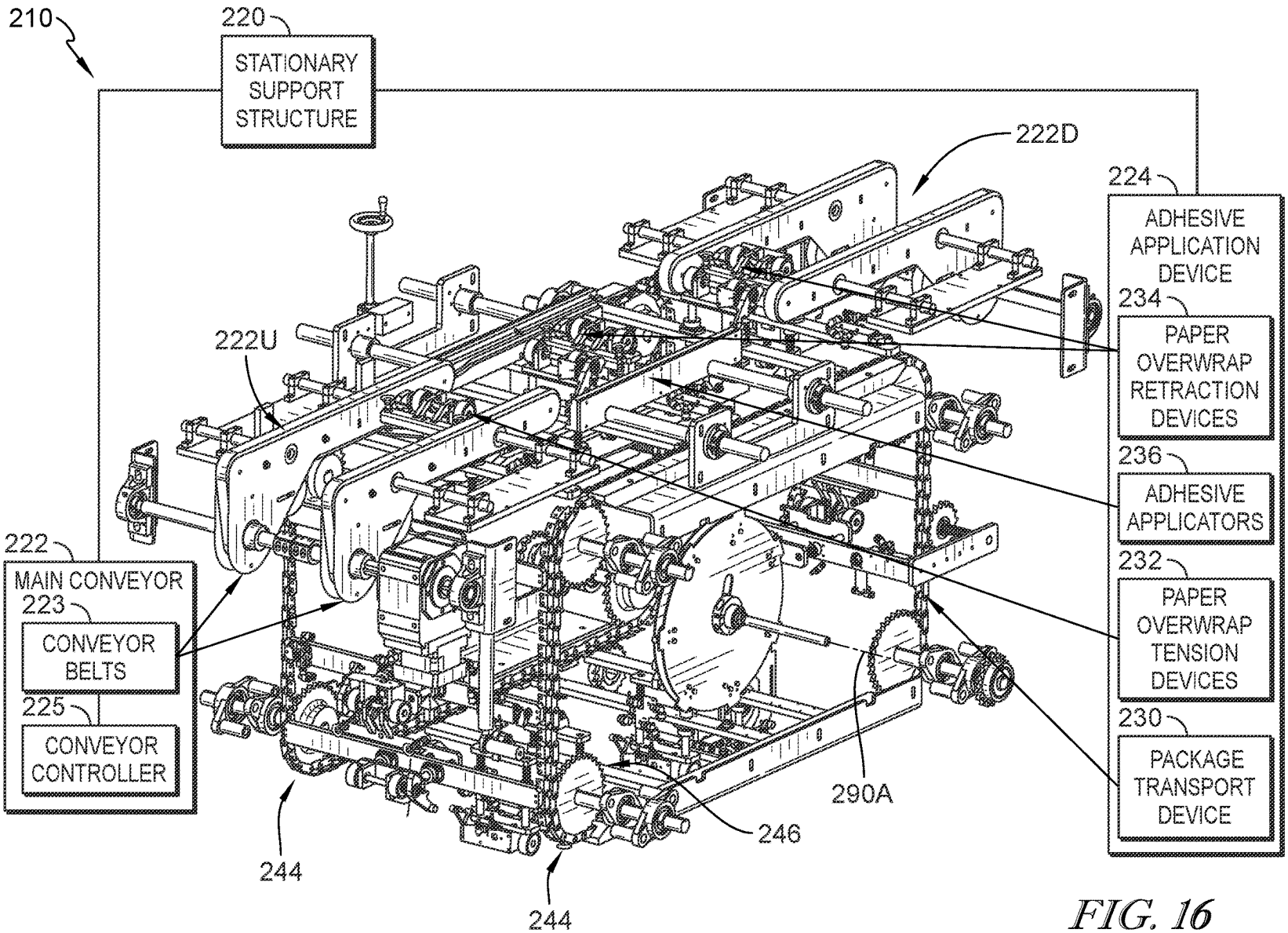
FIG. 16 is a perspective view of the device of FIG. 13 with the stationary support frame removed to show the conveyor and the adhesive application device.

The adhesive application device 224 includes the adhesive applicator 236 as shown in FIGS. 15 and 16. The adhesive applicator 236 is configured to apply the adhesive to the seam 12S on the package 14. The adhesive applicator 236 may be a glue gun, a tape dispenser, or another suitable adhesive applicator. The adhesive may be glue, tape, or another suitable adhesive.

In the illustrative embodiment, the device 210 includes the stationary support frame 220, the main conveyor 222 mounted to the support frame 220, the adhesive application device 224 mounted to the stationary support frame 20, the auxiliary conveyor 221, and a control unit 226 coupled to the main conveyor 222, the auxiliary conveyor 221, and the adhesive application device 224 as shown in FIGS. 13 and 14. The control unit 226 is configured to control movement of the main conveyor 222, the auxiliary conveyor 221, and the adhesive application device 224. The control unit 226 may be coupled to the conveyor controller 225 and/or auxiliary conveyor controller 229 to direct the respective controllers 225, 229 to start and stop the associated conveyor 222, 221. The control unit 226 may be configured to direct the auxiliary conveyor controller 229 to raise and lower the auxiliary conveyor 229.

The control unit 226 may be configured to start and stop the adhesive application device 224. The control unit 226 may be configured to adjust the speed of the main conveyor 222, the auxiliary conveyor 221, and the adhesive application device 224 and/or adjust the timing of the different stages. The control unit 226 may be configured to increase or decrease the suction force applied by the suction device 280. The control unit 226 may be configured to increase or decrease the amount of adhesive applied. The control unit 226 may have a user interface to allow a user to adjust different functions of the device 210.

A method 100' of tensioning and securing the paper overwrap 12 around the package 14 includes several steps or stages as shown in FIGS. 18 and 19. The method 100 100' includes a pre-adhesive application stage 110', a lifting and tensioning stage 112', a suction stage 114', an adhesive application stage 116', a lowering stage 118', and a post-adhesive application stage 120' as shown in FIGS. 3-5.

The method 100' also comprises providing the wrapped package 14 including the package 14 and the paper overwrap 12. The package 14 includes the tray 16 that defines the cavity 16C and the plurality of goods 18 located in the cavity 16C of the tray 16. The paper overwrap 12 extends around the bottom side 14B, the top side 14T, the front side 14F, and the rear side 14R of the package 14 so that free ends 12F, 12R of the paper overwrap 12 overlap on the bottom side 14B of the package 14.

In the pre-adhesive application stage 110', the wrapped package 14 is in a conveyor position in which the wrapped package 14 rests on the upstream conveyor section 222U of the main conveyor 222 to move in the conveyor direction C as the respective package transport carriage 240 gets into position. The method 100' further includes moving the wrapped package 14 in the conveyor direction C.

As the wrapped package continues to move in the conveyor direction C, the method 100' continues to the lifting and tensioning stage 112'. In the lifting and tensioning 112', the method 100' continues with lifting the wrapped package 14 from a conveyor orientation as shown in FIG. 12A in which the free ends 12F, 12R of the paper overwrap 12 are partially blocked to a lifted orientation as shown in FIGS. 12B and 12C in which the free ends 12F, 12R of the paper overwrap 12 on the bottom side 14B of the package 14 are exposed.

In the lifting and tensioning stage 112', the method 100' further includes pulling the free ends 12F, 12R of the paper overwrap 12 in opposed directions around the package 14 after the wrapped package 14 is in the lifted orientation to tension the paper overwrap 12 around the package 14 to keep the paper overwrap 12 taut around the bottom side 14B, the top side 14T, the front side 14F, and the rear side 14R of the package 14. Once the paper overwrap 12 is tensioned, the method 100' continues to the suction stage 114'. In the suction stage 114', the method 100' includes moving the first free end 12F of the paper overwrap 12 in the first direction away from the bottom side 14B of the package 14 to a retracted position to uncover a portion of the bottom side 14B of the package 14 and the second free end 12R of the paper overwrap 12.

Next, the method 100' moves to the adhesive application stage 116'. In the adhesive application stage 116', the method 100' includes applying an adhesive to the portion of the bottom side 14B of the package 14 and the second free end 12R of the paper overwrap 12 while the first free end 12F of the paper overwrap 12 is in the retracted position. After applying the adhesive, the method 100' continues with moving the first free end 12F of the paper overwrap 12 in the second direction toward from the bottom side 12B of the package 14 to an engaged position to seal the first free end 12F with the bottom side 14B of the package 14 and the second free end 12R thereby fixing the paper overwrap 12 in place on the package. Once the seam 12S is seals, the method 100' moves to the lowering stage 118' in which includes lowering the wrapped package 14 to the conveyor orientation.

Each step of the method 100' may be performed at about the same time or simultaneously as the package transport conveyor 238 moves the package transport carriages in the conveyor direction C around the center point. As one package transport carriage moves one wrapped package 14 from one stage to the next, the following wrapped package undergoes the previous step.

In some embodiments, the paper wrapping device 10, 210 may be placed downstream of an existing roll building packaging device (e.g., Douglas, Kister) such that the paper wrapping device 10, 210 will receive a tray of goods from upstream equipment. In some embodiments, the paper wrapping device 10, 210 may be used on combination with a device that includes a means for dispensing a paper overwrap. Such means for dispensing a paper overwrap may be loaded with a paper overwrap roll. In some embodiments, the paper wrapping device 10, 210 may include a means for dispensing the paper overwrap.

In some embodiments, the paper wrapping device 10, 210 may be used on combination with a device that includes means for feeding the paper overwrap onto the top portion of the tray and down two sides and onto the bottom of the tray. Particularly, the paper may be wrapped around the tray of goods with a wand as the tray moves into the device. In some embodiments, the paper wrapping device 10, 210 may include means for feeding the paper overwrap onto the top portion of the tray and down two sides and onto the bottom of the tray.

In some embodiments, the paper wrapping device 10, 210 may be used on combination with a device that includes means for cutting the paper overwrap at the correct length for the specific tray. Such means includes, but is not limited to a suitable knife. In some embodiments, the paper wrapping device 10, 210 may include means for cutting the paper overwrap at the correct length for the specific tray.

In some embodiments, the paper wrapping device 10, 210 includes means for moving and tensioning the paper overwrap. Such means may include an in-feed conveyor that is 6-8 foot long and utilized to tension paper under the tray of good to make the paper taut and transition onto transportation means for moving the tray. Such a transportation means may include a set of horizontal moving conveyor belts within the device.

In some embodiments, the paper wrapping device 10, 210 includes means for indexing the tray of goods to a first position whereby the tray is lifted. Such means of indexing may include belts that lift the tray.

In some embodiments, the paper wrapping device 10, 210 includes means for applying vacuum to the paper on the tray to open the paper flap/seam on the bottom portion of the tray. Once opened, the tray is passed over glue guns (or a tape dispenser) such that glue/adhesive/tape is applied at the paper seam.

In some embodiments, the paper wrapping device 10, 210 includes means for lowering the tray such that when the tray is lowered, the seam is pressed shut. The tray may then be moved and the next tray is loaded to repeat the process. In the illustrative embodiments, the paper wrapping device 10, 210 is adapted to use paper overwrap that includes a fully extensible multiwall paper that is burst and puncture resilient.

In some embodiments, a method of applying paper overwrap to a tray of goods may include dispensing a paper overwrap, feeding the paper overwrap onto a top portion of a tray holding a plurality of good and down two side portions of the tray and onto a bottom portion of the tray, and cutting the paper overwrap at a correct length for the specific tray. The method 100 may further include moving and tensioning the paper overwrap, indexing the tray of goods to a first position whereby the tray is lifted, applying vacuum to the paper on the tray to open the paper seam on the bottom portion of the tray, and lowering the tray such that when the tray is lowered, the seam is pressed or sealed shut.

Although specific embodiments of the present invention are herein illustrated and described in detail, the invention is not limited thereto. The above detailed descriptions are provided as exemplary of the present invention and should not be construed as constituting any limitation of the invention. Modifications will be obvious to those skilled in the art, and all modifications that do not depart from the spirit of the invention are intended to be included with the scope of the appended claims.

The invention claimed is:

1. A device adapted to seal a paper overwrap around a package having a tray holding a plurality of goods in a cavity of the tray, the device comprising:

a stationary support frame, a conveyor mounted to the support frame and configured to transport the package wrapped in the paper overwrap in a conveyor direction through the support frame, wherein the paper overwrap wraps around a bottom side that faces toward the conveyor, a top side opposite the bottom side, and front and rear sides that extend between and interconnect the top and bottom sides of the package so that free ends of the paper overwrap overlap on the bottom side of the package, and an adhesive application device mounted to the stationary support frame, the adhesive application device comprising:

package transport means for lifting the wrapped package away from the conveyor along a vertical axis perpendicular to the conveyor as the wrapped package continues to move in the conveyor direction to expose the free ends of the paper overwrap on the bottom side of the package so that the free ends of the paper overwrap are free to be moved relative to the package before an adhesive is applied to the bottom side of the package to fix the paper overwrap to the package and for lowering the wrapped package along the vertical axis toward the conveyor after the adhesive has been applied to set the wrapped package back on the conveyor, paper overwrap tension controller means for pulling the free ends of the paper overwrap in opposed directions around the package as or after the package is lifted away from the conveyor to tension the paper overwrap around the package before the adhesive is applied to the bottom side of the package to keep the paper overwrap taut around the bottom, top, front, and rear sides of the package as the adhesive is applied to the bottom side of the package so that the paper overwrap remains taut and holds the plurality of goods in place in the cavity of the tray once the adhesive has been applied to fix the paper overwrap in place on the package, and paper overwrap retraction means for moving a first free end of the paper overwrap in a first direction away from the bottom side of the package after the paper overwrap is tensioned around the package to uncover a portion of the bottom side of the package and the second free end of the paper overwrap so that the adhesive is applied to the portion of the bottom side of the package and the second free end and for moving the first free end of the paper overwrap in a second direction opposite the first direction toward the bottom side of the package after the adhesive is applied to seal the first free end with the bottom side of the package and the second free end thereby fixing the paper overwrap in place on the package.

2. The device of claim 1, wherein the package transport means includes a horizontal transporter mounted to the support frame for reciprocating horizontal movement along a horizontal axis and a vertical transporter mounted to the horizontal transporter for reciprocating vertical movement along the vertical axis perpendicular to the horizontal axis, wherein the horizontal transporter comprises a pair of horizontal guide rails mounted to the support frame, a horizontal transporter carriage mounted on the pair of horizontal guide rails to move horizontally back and forth relative to the horizontal axis, and a horizontal transporter drive system coupled to the horizontal transporter carriage to drive movement of the horizontal transporter carriage along the pair of horizontal guide rails, and wherein the vertical transporter comprises a pair of vertical guide rails mounted to the horizontal transporter carriage, a vertical transporter carriage mounted on the pair of vertical guide rails to move vertically back and forth relative to the vertical axis, and a vertical transporter drive system coupled to the vertical transporter carriage to drive movement of the vertical transporter carriage along the pair of vertical guide rails.

3. The device of claim 2, wherein the paper overwrap tension controller means comprises:

a pair of friction pads coupled to the vertical transporter carriage configured to engage the wrapped package, a pair of rollers mounted to the vertical transporter carriage to rotate about a roller axis and located upstream of the pair of friction pads, and a pair of clutch arms configured to rotate the pair of rollers in a downstream direction partway around the roller axis as the package is lifted to cause the pair of rollers to pull the free ends in opposite directions around the package.

4. The device of claim 2, wherein the paper overwrap retraction means comprises:

a pair of suction cups pivotably coupled to the vertical transporter carriage to pivot in the first direction away from the bottom side of the package and in the second direction opposite the first direction toward the bottom side of the package, a pair of cup movers coupled to the pair of suction cups and configured to drive movement of the pair of suction cups in the first direction and the second direction, and a suction device coupled to the pair of suction cups and configured to apply a suction force to the first free end of the paper overwrap through the pair of suction cups to cause the paper overwrap to be fixed to the pair of suction cups so that the first free end of the paper overwrap moves with the pair of suction cups in the first and second directions.

5. The device of claim 1, wherein the package transport means comprises:

a package transport conveyor configured to continuously cycle in the conveyor direction, a plurality of package transport carriages coupled to the package transport conveyor for movement therewith and configured to move vertically along the vertical axis, and a transport carriage actuator that selectively engages each of the package transport carriages to cause the plurality of package transport carriages to move vertically as the package transport carriages move in the conveyor direction.

6. The device of claim 5, wherein the transport carriage actuator comprises:

a linear cam member coupled to the stationary support frame and formed to define a cam surface, and a cam follower coupled to each package transport carriage that engages the cam surface as each package transport carriage moves in the conveyor direction to cause each package transport carriage to move vertically along the vertical axis.

7. The device of claim 5, wherein the paper overwrap tension controller means comprises, a pair of front roller wheels mounted to a corresponding package transport carriage to rotate about a front roller axis, a pair of rear roller wheels mounted to the corresponding package transport carriage to rotate about a rear roller axis in spaced apart relation to the pair of front roller wheels, a front clutch configured to rotate the pair of front roller wheels in an upstream direction partway around the front roller axis to cause the pair of front roller wheels to pull one of the free ends in a first direction, and a rear clutch configured to rotate the pair of rear roller wheels in a downstream direction partway around the rear roller axis to cause the pair of rear roller wheels to pull the other of the free ends in a second direction opposite the first direction.

8. The device of claim 7, wherein the front clutch comprises a front linear cam member coupled to the stationary support frame and formed to define a front cam surface and a front clutch arm coupled to the pair of front roller wheels that defines a front cam follower that engages the front cam surface as the package transport carriage moves in the conveyor direction to cause the front clutch arm to rotate the pair of front roller wheels in the first direction partway about the front roller axis, and wherein the rear clutch comprises a rear linear cam member coupled to the stationary support frame and formed to define a rear cam surface and a rear clutch arm coupled to the pair of rear roller wheels that defines a rear cam follower that engages the rear cam surface as the package transport carriage moves in the conveyor direction to cause the rear clutch arm to rotate the pair of rear roller wheels in the second direction partway about the rear roller axis.

9. The device of claim 7, wherein the front clutch comprises a front clutch arm coupled to the pair of front roller wheels for rotation therewith and a front pneumatic actuator coupled to the front clutch arm and configured to rotate the front clutch arm to cause the pair of front roller wheels to rotate in the first direction partway about the front roller axis, and wherein the rear clutch comprises a rear clutch arm coupled to the pair of rear roller wheels for rotation therewith and a rear pneumatic actuator coupled to the rear clutch arm and configured to rotate the rear clutch arm to cause the pair of rear roller wheels to rotate in the second direction partway about the rear roller axis.

10. The device of claim 5, wherein the paper overwrap retraction means comprises:

a pair of suction cups pivotably coupled to a corresponding package transport carriage to pivot in the first direction away from the bottom side of the package and in the second direction opposite the first direction toward the bottom side of the package, a cup mover coupled to the pair of suction cups and configured to drive movement of the pair of suction cups in the first direction and the second direction, and a suction device coupled to the pair of suction cups and configured to apply a suction force to the first free end of the paper overwrap through the pair of suction cups to cause the paper overwrap to be fixed to the pair of suction cups so that the first free end of the paper overwrap moves with the pair of suction cups in the first and second directions.

11. A device adapted to seal a paper overwrap around a package having a tray holding a plurality of goods in a cavity of the tray, the device comprising:

a stationary support frame, a conveyor mounted to the support frame and configured to transport the package wrapped in the paper overwrap in a conveyor direction through the support frame, wherein the paper overwrap wraps around a bottom side that faces toward the conveyor, a top side opposite the bottom side, and front and rear sides that extend between and interconnect the top and bottom sides of the package so that free ends of the paper overwrap overlap on the bottom side of the package, and an adhesive application device mounted to the stationary support frame, the adhesive application device comprising:

a package transport device configured to lift the wrapped package away from the conveyor along a vertical axis perpendicular to the conveyor as the wrapped package continues to move in the conveyor direction to expose the free ends of the paper overwrap on the bottom side of the package before an adhesive is applied and to lower the wrapped package along the vertical axis toward the conveyor after the adhesive has been applied to set the wrapped package back on the conveyor, a paper overwrap tension device coupled to the package transport device for movement therewith and configured to pull the free ends of the paper overwrap in opposed directions around the package as or after the package is lifted away from the conveyor to tension the paper overwrap around the package before the adhesive is applied to the bottom side of the package to keep the paper overwrap taut around the bottom, top, front, and rear sides of the package as the adhesive is applied to the bottom side of the package, and a paper overwrap retraction device configured to move a first free end of the paper overwrap in a first direction away from the bottom side of the package after the paper overwrap is tensioned around the package to uncover a portion of the bottom side of the package and the second free end of the paper overwrap and to move the first free end of the paper overwrap in a second direction opposite the first direction toward the bottom side of the package after the adhesive is applied to seal the first free end with the bottom side of the package and the second free end thereby fixing the paper overwrap in place on the package.

12. The device of claim 11, wherein the package transport device includes a horizontal transporter mounted to the support frame for reciprocating horizontal movement along a horizontal axis and a vertical transporter mounted to the horizontal transporter for reciprocating vertical movement along the vertical axis perpendicular to the horizontal axis, wherein the horizontal transporter comprises a pair of horizontal guide rails mounted to the support frame, a horizontal transporter carriage mounted on the pair of horizontal guide rails to move horizontally back and forth relative to the horizontal axis, and a horizontal transporter drive system coupled to the horizontal transporter carriage to drive movement of the horizontal transporter carriage along the pair of horizontal guide rails, and wherein the vertical transporter comprises a pair of vertical guide rails mounted to the horizontal transporter, a vertical transporter carriage mounted on the pair of vertical guide rails to move vertically back and forth relative to the vertical axis, and a vertical transporter drive system coupled to the vertical transporter carriage to drive movement of the vertical transporter carriage along the pair of vertical guide rails.

13. The device of claim 12, wherein the paper overwrap tension device comprises:

a pair of friction pads coupled to the vertical transporter configured to engage the wrapped package, a pair of rollers mounted to the vertical transporter to rotate about a roller axis and located upstream of the pair of friction pads, and a pair of clutch arms configured to rotate the pair of rollers in a downstream direction around the roller axis as the package is lifted to cause the pair of rollers to pull the free ends in opposite directions around the package.

14. The device of claim 12, wherein the paper overwrap retraction device comprises:

a pair of suction cups pivotably coupled to the vertical transporter to pivot in the first direction away from the bottom side of the package and in the second direction opposite the first direction toward the bottom side of the package, a pair of cup movers coupled to the pair of suction cups and configured to drive movement of the pair of suction cups in the first direction and the second direction, and a suction device coupled to the pair of suction cups and configured to apply a suction force to the first free end of the paper overwrap through the pair of suction cups to cause the paper overwrap to be fixed to the pair of suction cups so that the first free end of the paper overwrap moves with the pair of suction cups in the first and second directions.

15. The device of claim 11, wherein the package transport device comprises:

a package transport conveyor configured to continuously cycle in the conveyor direction, a plurality of package transport carriages coupled to the package transport conveyor for movement therewith and configured to move vertically along the vertical axis, and a transport carriage actuator that selectively engages each of the package transport carriages to cause the plurality of package transport carriages to move vertically as the package transport carriages move in the conveyor direction.

16. The device of claim 15, wherein the transport carriage actuator comprises:

a linear cam member coupled to the stationary support frame and formed to define a cam surface, and a cam follower coupled to each package transport carriage that engages the cam surface as the package transport carriage moves in the conveyor direction to cause each package transport carriage to move vertically along the vertical axis.

17. The device of claim 15, wherein the paper overwrap tension controller device comprises, a pair of front roller wheels mounted to a corresponding package transport carriage to rotate about a front roller axis, a pair of rear roller wheels mounted to the corresponding package transport carriage to rotate about a rear roller axis in spaced apart relation to the pair of front roller wheels, a front clutch configured to rotate the pair of front roller wheels in an upstream direction around the front roller axis to cause the pair of front roller wheels to pull one of the free ends in a first direction, and a rear clutch configured to rotate the pair of rear roller wheels in a downstream direction around the rear roller axis to cause the pair of rear roller wheels to pull the other of the free ends in a second direction opposite the first direction.

18. The device of claim 17, wherein the front clutch comprises a front linear cam member coupled to the stationary support frame and formed to define a front cam surface and a front clutch arm coupled to the pair of front roller wheels that defines a front cam follower that engages the front cam surface as the package transport carriage moves in the conveyor direction to cause the front clutch arm to rotate the pair of front roller wheels in the first direction partway about the front roller axis, and wherein the rear clutch comprises a rear linear cam member coupled to the stationary support frame and formed to define a rear cam surface and a rear clutch arm coupled to the pair of rear roller wheels that defines a rear cam follower that engages the rear cam surface as the package transport carriage moves in the conveyor direction to cause the rear clutch arm to rotate the pair of rear roller wheels in the second direction partway about the rear roller axis.

19. The device of claim 15, wherein the paper overwrap retraction device comprises:

a pair of suction cups pivotably coupled to a corresponding package transport carriage to pivot in the first direction away from the bottom side of the package and in the second direction opposite the first direction toward the bottom side of the package, a cup mover coupled to the pair of suction cups and configured to drive movement of the pair of suction cups in the first direction and the second direction, and a suction device coupled to the pair of suction cups and configured to apply a suction force to the first free end of the paper overwrap through the pair of suction cups to cause the paper overwrap to be fixed to the pair of suction cups so that the first free end of the paper overwrap moves with the pair of suction cups in the first and second directions.

20. A method comprising using the device of claim 1 providing a wrapped package including a package and a paper overwrap, the package including a tray that defines a cavity and a plurality of goods located in the cavity of the tray, and the paper overwrap extends around a bottom side, a top side, a front side and a rear side of the package so that free ends of the paper overwrap overlap on the bottom side of the package, moving the wrapped package in a conveyor direction, lifting the wrapped package from a conveyor orientation in which the free ends of the paper overwrap are partially blocked to a lifted orientation in which the free ends of the paper overwrap on the bottom side of the package are exposed as the wrapped package continues to move in the conveyor direction, pulling the free ends of the paper overwrap in opposed directions around the package after the wrapped package is in the lifted orientation to tension the paper overwrap around the package to keep the paper overwrap taut around the bottom, top, front, and rear sides of the package, moving a first free end of the paper overwrap in a first direction away from the bottom side of the package to a retracted position after the paper overwrap is tensioned around the package to uncover a portion of the bottom side of the package and the second free end of the paper overwrap, applying an adhesive to the portion of the bottom side of the package and the second free end of the paper overwrap while the first free end of the paper overwrap is in the retracted position, moving the first free end of the paper overwrap in a second direction away from the bottom side of the package to an engaged position after applying the adhesive to seal the first free end with the bottom side of the package and the second free end thereby fixing the paper overwrap in place on the package, and lowering the wrapped package to the conveyor orientation.

* * * * *